US007135277B2

(12) United States Patent
Ohzeki

(10) Patent No.: US 7,135,277 B2
(45) Date of Patent: Nov. 14, 2006

(54) PHOTOTHERMOGRAPHIC MATERIAL AND IMAGE FORMING METHOD

(75) Inventor: Tomoyuki Ohzeki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/143,647

(22) Filed: Jun. 3, 2005

(65) Prior Publication Data

US 2005/0277072 A1 Dec. 15, 2005

(30) Foreign Application Priority Data

Jun. 10, 2004 (JP) ..... 2004-172396

(51) Int. Cl.
*G03C 1/00* (2006.01)
*G03C 1/005* (2006.01)
*G03C 1/494* (2006.01)

(52) U.S. Cl. ..... 430/619; 430/617; 430/618; 430/620; 430/567

(58) Field of Classification Search ..... 430/617–620, 430/567
See application file for complete search history.

(56) References Cited

U.S. PATENT DOCUMENTS

2005/0266361 A1* 12/2005 Funakubo et al. ..... 430/619
2005/0277073 A1* 12/2005 Funakubo ..... 430/619

* cited by examiner

*Primary Examiner*—Geraldine Letscher
(74) *Attorney, Agent, or Firm*—Margaret A. Burke; Sheldon J. Moss

(57) ABSTRACT

Provided are a photothermographic material which includes, on at least one side of a support, an image forming layer containing at least a photosensitive silver halide, a non-photosensitive organic silver salt, a reducing agent, and a binder, and is X-ray exposed with a fluorescent intensifying screen, wherein (1) the photosensitive silver halide includes tabular grains having a mean aspect ratio of 2 to 100 and a mean equivalent spherical diameter of 0.3 μm to 10 μm, (2) an exposure value necessary for obtaining an image density of fog+0.5 after exposing the photothermographic material with monochromatic light having the same wavelength as the main emission peak wavelength of the fluorescent intensifying screen and having a half width of 15 nm±5 nm and thermally developing the photothermographic material is from $1\times10^{-6}$ watt·sec·m$^{-2}$ to $1\times10^{-3}$ watt·sec·m$^{-2}$, and (3) haze of the photothermographic material after thermal devolpment is less than 80% of that before thermal development; and an image forming method using the same.

13 Claims, 5 Drawing Sheets

PHOTOTHERMOGRAPHIC MATERIAL AND IMAGE FORMING METHOD

CROSS-REFERENCE TO RELATED APPLICATION

This application claims priority under 35 USC 119 from Japanese Patent Application No. 2004-172396, the disclosure of which is incorporated by reference herein.

BACKGROUND OF THE INVENTION

1. Field of the Invention

The present invention relates to a photothermographic material and an image forming method. More particularly, the invention relates to a high image quality photothermographic material with high sensitivity and preferable gradation and an image forming method using the same.

2. Description of the Related Art

In recent years, in the medical field and the graphic arts field, there has been a strong desire for providing a dry photographic process from the viewpoints of protecting the environment and economy of space. Further, the development of digitization in these fields has resulted in the rapid development of systems in which image information is captured and stored in a computer, and then when necessary processed and output by transmitting it to a desired location. Here the image information is output onto a photosensitive material using a laser image setter or a laser imager, and developed to form an image at the location. It is necessary for the photosensitive material to be able to record an image with high-intensity laser exposure and that a clear black-tone image with a high resolution and sharpness can be formed. While various kinds of hard copy systems using pigments or dyes, such as ink-jet printers or electrophotographic systems, have been distributed as general image forming systems using such digital imaging recording materials, images on the digital imaging recording materials obtained by such general image forming systems are insufficient in terms of the image quality (sharpness, granularity, gradation, and tone) needed for medical images used in making diagnoses, and high recording speeds (sensitivity). These kinds of digital imaging recording materials have not reached a level at which they can replace medical silver halide film processed with conventional wet development.

Photothermographic materials utilizing organic silver salts are already known. Photothermographic materials have an image forming layer in which a reducible silver salt (for example, an organic silver salt), a photosensitive silver halide, and if necessary, a toner for controlling the color tone of developed silver images are dispersed in a binder.

Photothermographic materials form a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region. Photothermographic materials are described in "Thermally Processed Silver Systems", appearing in "Imaging Processes and Materials", Neblette, 8th edition, edited by J. M. Sturge, V. Warlworth, and A. Shepp, chapter 8, pages 279 to 291, 1989, and the Fuji Medical Dry Imager FM-DPL is an example of a medical image forming system that has been made commercially available.

Since this kind of image forming system utilizing an organic silver salt has no fixing step, undeveloped silver halide remains inside the film after thermal development. Thus, there have intrinsically been two serious problems in the system.

One of them involves image instorability after a thermal developing process, particularly fogging due to print-out when the material is exposed to light. As a means to improve print-out, a method of using silver iodide is known. Silver iodide has the characteristic of causing less print-out than silver bromide or silver iodobromide having an iodide content of 5 mol % or less, and has a potential for fundamentally solving the problem. However, the sensitivity of silver iodide grains known until now is extremely low, and the silver iodide grains do not achieve a level of sensitivity that is applicable for an actual system. When means of preventing recombination between photoelectrons and holes is performed to improve the sensitivity, it is an inherent problem that the characteristic of being excellent in the print-out property will be lost.

As means of increasing the sensitivity of a silver iodide photographic emulsion, the literature discloses addition of a halogen acceptor such as sodium nitrite, pyrogallol, hydroquinone or the like, immersion in an aqueous silver nitrate solution, sulfur sensitization at a pAg of 7.5, and the like. However, the sensitization effect of these halogen acceptors is very small and extremely insufficient for use in photothermographic materials.

Another problem is that light scattering due to the remaining silver halide grains may cause cloudiness whereby the film turns translucent or opaque and image quality is degraded. To solve this problem, means in which the grain size of photosensitive silver halide grains is made fine (to within a range of practical use of 0.08 μm to 0.15 μm) and the addition amount is reduced as much as possible to suppress the cloudiness caused by the silver halide have been practically employed. However, the compromise results in decreasing the sensitivity further, the problem of cloudiness is not completely solved, and a dark milky color continues to remain and generate haze in the film.

In the case of a conventional wet developing process, the remaining silver halide is removed by processing with a fixing solution containing a silver halide solvent after the developing process. For the silver halide solvent, many kinds of inorganic and organic compounds are known which can form complexes with silver ions.

Even in the case of a dry thermal developing process, many attempts to introduce similar fixing measures in the material have been made. For example, a method has been proposed where a compound capable of forming complexes with silver ions is incorporated in the film and the silver halide is solubilized (usually referred to as fixing) through thermal development. However, this proposal only applies to silver bromide and silver chlorobromide, and the process also requires an additional heat treatment step for fixing, and the heating conditions require a high temperature within a range of from 155° C. to 160° C. Thus, the system is one in which fixing is difficult to achieve. In another proposal, a separate sheet (referred to as a fixing sheet) that includes a compound able to form complexes with silver ions is prepared, and after thermally developing the photothermographic material to form an image, the fixing sheet is overlaid on the developed photothermographic material, heating is carried out, and the remaining silver halide is dissolved and removed. However, since this proposal requires two sheets, from a practical viewpoint the obstacles are that the processing step is complicated and the operational stability of the process is hard to maintain, and that there is a necessity to discard the fixing sheets after processing, resulting in generation of waste.

As another fixing method usable in thermal development, a method is proposed where a fixing agent for the silver halide is encapsulated in microcapsules, and thermal development releases the fixing agent and causes it to act. However, it is difficult to achieve a design that effectively releases the fixing agent. A method for fixing using a fixing solution after thermal development is also proposed, but it requires a wet process and therefore is not adequate for a completely dry process.

As described above, known methods for improving the turbidity of film have negative effects, and there have been substantial difficulties in their practical application.

On the other hand, attempts have also been made at applying the above-mentioned photothermographic material as photosensitive material for photographing. The term "photosensitive material for photographing" as used herein means a photosensitive material on which images are recorded by a one-shot exposure through a lens, rather than by writing the image information by a scanning exposure with a laser beam or the like. Conventionally, photosensitive materials for photographing are generally known in the field of wet developing photosensitive materials, and include films for medical use such as direct or indirect radiography films, mammography films and the like, various kinds of photomechanical films used in printing, industrial recording films, films for photographing with general-purpose cameras, and the like. For example, an X-ray photothermographic material coated on both sides using a blue fluorescent intensifying screen, a photothermographic material containing tabular silver iodobromide grains described in Japanese Patent Application Laid-Open (JP-A) No. 59-142539, and a photosensitive material for medical use containing tabular grains that have a high content of silver chloride and have (100) major faces, and that are coated on both sides of a support, which is described in JP-A No. 10-282606, are known. However, according to these disclosed examples, fine particle silver halide grains having a grain size of 0.1 μm or less are used, and the sensitivity is very low. Therefore, it has been difficult to obtain a sensitivity required for use in photographing. On the other hand, in the case of using silver halide grains having a grain size of 0.5 μm or more, because the remaining silver halide may increase the haze and worsen the print-out, deterioration of the image quality is severe, and the grains are not applicable for practical use.

The problem of low sensitivity has been a fundamental problem and a significant obstacle, and therefore it was largely unclear what other problems existed for practical use.

SUMMARY OF THE INVENTION

A first aspect of the invention is to provide a photothermographic material used for a method of forming an image, which comprises performing X-ray imagewise exposure with a fluorescent intensifying screen and thermal development, wherein the photothermographic material comprising: on at least one side of a support, an image forming layer comprising at least a photosensitive silver halide, a non-photosensitive organic silver salt, a reducing agent, and a binder, wherein (1) the photosensitive silver halide comprises tabular grains having a mean aspect ratio of 2 to 100 and a mean equivalent spherical diameter of 0.3 μm to 10 μm, (2) an exposure value necessary for obtaining an image density of fog+0.5 after exposing the photothermographic material with monochromatic light having the same wavelength as the main emission peak wavelength of the fluorescent intensifying screen and having a half width of 15 nm±5 nm and thermally developing the photothermographic material is from $1\times10^{-6}$ watt·sec·m$^{-2}$ to $1\times10^{-3}$ watt·sec·m$^{-2}$, and (3) haze of the photothermographic material after thermal devolpment is less than 80% of that before thermal development.

A second aspect of the invention is to provide an image forming method comprising: subjecting the photothermographic material according to the first aspect to imagewise exposure, and thermally developing the material by means of a thermal developing apparatus having a heating means, wherein the image forming method comprises preheating the photothermographic material at a temperature of from 40° C. to 105° C. for a time period of from 0.1 sec to 90 sec prior to heating the material at a temperature of thermal development.

DETAILED DESCRIPTION OF THE INVENTION

Figure 1:
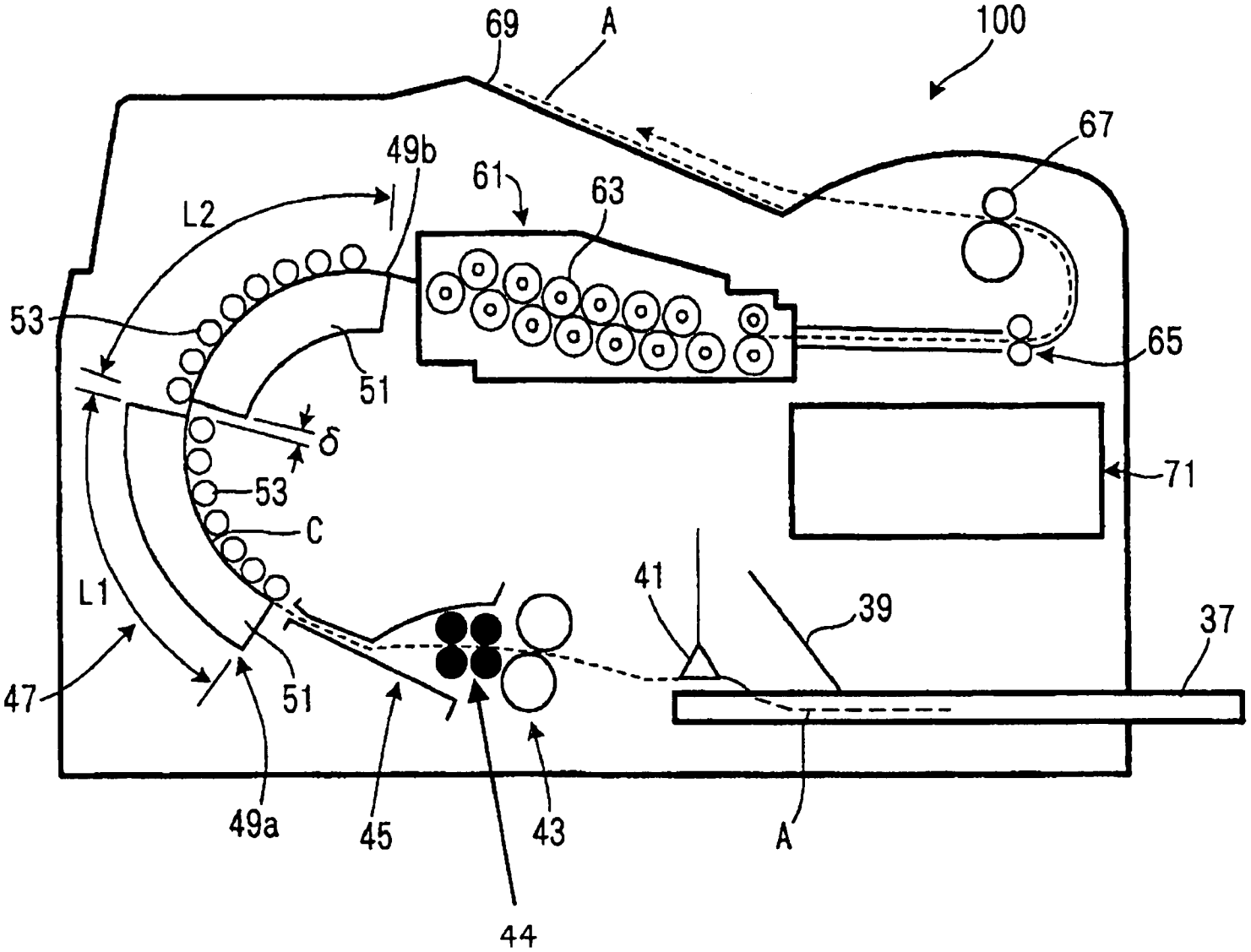
FIG. 1 is a structural diagram illustrating a first embodiment of a thermal developing apparatus according to the present invention.

An object of the present invention relates to a photothermographic material which exhibits high sensitivity and high image quality, and a method of forming an image and, in particular, is to provide an improved photothermographic material, which gives images with preferable gradation, and a method of forming an image using the same.

The present invention will be described in detail below.

1. Photothermographic Material

The photothermographic material of the present invention is subjected to X-ray exposure using a fluorescent intensifying screen.

In the present invention, photographic properties are expressed by a photographic characteristic curve. A photographic characteristic curve is a D-log E curve representing a relationship between the common logarithm (log E) of a light exposure value, i.e., the exposure energy, and the optical density (D), i.e., a scattered light photographic density, by plotting the former on the abscissa axis and the latter on the ordinate axis. In the invention, the photothermographic material is exposed with monochromatic light having the same wavelength as the main emission peak wavelength of the fluorescent intensifying screen and having a half width of 15 nm±5 nm.

In the present invention, sensitivity is expressed as an exposure value necessary for obtaining an image density after thermal development of fog+0.5. The image whose sensitivity is to be measured is an image formed on an exposed side of the support. In the case of a double-sided type photothermographic material according to the invention, measurement is performed after removing the image forming layer that is disposed on the opposite side from an exposure face.

Sensitivity of the photothermographic material according to the invention is from $1\times10^{-6}$ watt·sec·m$^{-2}$ to $1\times10^{-3}$ watt·sec m$^{-2}$, preferably from $6\times10^{-6}$ watt·sec·m$^{-2}$ to $6\times10^{-4}$ watt·sec·m$^{-2}$, and more preferably from $1\times10^{-5}$ watt·sec·m$^{-2}$ to $4\times10^{-4}$ watt-sec·m$^{-2}$.

Gradation in the present invention is expressed as a gradient of a line joining the points at fog+(image density of 0.25) and fog+(image density of 2.0) on a photographic characteristic curve (i.e., the value equals tan when the angle between the line and the horizontal axis is). In the present invention, an average gradient is preferably from 1.8 to 5.0, and more preferably from 2.0 to 4.3.

It is a feature of the photothermographic material of the present invention that haze after thermal development is decreased to less than 80% of that before thermal development. Preferably, haze after thermal development is decreased to less than 75% of that before thermal development, and more preferably less than 70%.

The photothermographic material of the present invention has an image forming layer, on at least one side of a support, comprising at least a photosensitive silver halide, a non-photosensitive organic silver salt, a reducing agent, and a binder. The image forming layer may be disposed on one side, or may be disposed on both sides of the support. Further, the image forming layer may have disposed thereon an intermediate layer or a surface protective layer, or a back layer, a back protective layer, or the like may be disposed on the opposite side of the support from the image forming layer.

The photothermographic material of the present invention may contain a nucleator.

The photothermographic material of the present invention preferably contains an ammonium ion (herein often abbreviated as $NH_4^+$) in an amount of 1 mmol/m$^2$ or less, and more preferably 0.3 mmol/m$^2$ or less, per one side.

In the photothermographic material of the invention, the presence of volatile bases such as ammonia in a membrane is not preferred because they are liable to volatilize during coating and thermal development, and even during storage. The quantification of $NH_4^+$ in a membrane can be performed using an ionic chromatography apparatus Type 8000 (based on an electric conductivity method), produced by Tosoh Corporation, a TSK gel IC-Cation, produced by Tosoh Corporation, as a separation column, and a TSK guard column IC-C, produced by Tosoh Corporation, as a guard column. The measurement is carried out using 2 mM nitric acid aqueous solution as an eluate at a flow rate of 1.2 mL/min. The temperature of the thermostat for the column is set to 40° C.

Extraction of $NH_4^+$ from the photothermographic material is carried out using the mixed solution of acetic acid: ion-exchange water (1:148) as an extractor, by soaking a sample having the size of 1 cm×3.5 cm in 5 mL of the extractor for 2 hours. After the extraction, the extract is filtered using a filter having an pore size of 0.45 μm and then the resulting solution is measured.

The constitutions and preferable components of these layers will be explained in detail below.

(Photosensitive Silver Halide)

Grains in the photosensitive silver halide of the present invention are tabular grains having a mean aspect ratio of from 2 to 100 and a mean equivalent spherical diameter of from 0.3 μm to 10 μm.

The photosensitive silver halide preferably has an average silver iodide content of 40 mol % or higher, more preferably 80 mol % or higher, and even more preferably 90 mol % or higher.

1) Halogen Composition

For the photosensitive silver halide used in the invention, there is no particular restriction on the halogen composition and silver chloride, silver chlorobromide, silver bromide, silver iodobromide, silver iodochlorobromide, and silver iodide can be used. Among these, silver bromide, silver iodobromide, and silver iodide are preferable.

The photosensitive silver halide of the invention preferably has an average silver iodide content of 40 mol % or higher, more preferably 80 mol % or higher, and most preferably 90 mol % or higher.

Other components are not particularly limited and can be selected from silver halides such as silver chloride, silver bromide, and the like and organic silver salts such as silver thiocyanate, silver phosphate and the like.

The distribution of the halogen composition in a grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. A core-high-silver iodide-structure which has a high content of silver iodide in the core part, and a shell-high-silver iodide-structure which has a high content of silver iodide in the shell part can also be preferably used. Further, a technique of localizing silver bromide or silver iodide on the surface of a grain as form epitaxial parts can also be preferably used.

The silver halide having a high silver iodide content of the invention can assume any content of β phase or γ phase. The term "β phase" described above means a high silver iodide structure having a wurtzite structure of a hexagonal system and the term "γ phase" means a high silver iodide structure having a zinc blende structure of a cubic crystal system. A content of γ phase in the present invention is determined by a method presented by C. R. Berry. In the method, a content of γ phase is calculated from the peak ratio of the intensity owing to γ phase (111) to that owing to β phases (100), (101), and (002) in powder X ray diffraction method. Detail description, for example, is described in Physical Review, volume 161, No. 3, p. 848 to 851 (1967).

2) Grain Size

Concerning the photosensitive silver halide grains used in the present invention, any grain size enough to reach the required high sensitivity can be selected. In the present invention, a mean equivalent spherical diameter of the tabular silver halide is from 0.3 μm to 10.0 μm, preferably from 0.35 μm to 7.0 μm, and more preferably from 0.4 μm to 5.0 μm. The term "equivalent spherical diameter" used here means a diameter of a sphere having the same volume as the volume of one silver halide grain. As for measuring method, the volume of a grain is calculated from projected area and thickness of individual grains by observation through electron microscope, and thereafter the equivalent spherical diameter is determined by converting the volume to a sphere having the volume equivalent to the obtained volume.

3) Coating Amount

In the present invention, a coating amount of silver halide is preferably in a range of from 0.04 $g/m^2$ to 0.4 $g/m^2$, more preferably from 0.1 $g/m^2$ to 0.3 $g/m^2$, per one side.

Generally, in the case of a photothermographic material where silver halide grains remain in the layer after thermal development, the increase of the coating amount of silver halide grains may result in depressing the transparency of the film and degrading the image quality. Therefore, the coating amount is limited to a low level in spite of the demand for increasing sensitivity. However, in the case of the present invention, the haze of the film can be lowered by the thermal developing process, so more silver halide grains can be coated on the material.

In the practice of the present invention, the coating amount of the silver halide is preferably from 0.5 mol % to 100 mol % per 1 mol of silver contained in the non-photosensitive organic silver salt, and more preferably from 5 mol % to 50 mol %.

4) Method of Grain Formation

The method of forming photosensitive silver halide is well-known in the relevant art and, for example, methods described in Research Disclosure No. 17029, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

Concerning the method of forming tabular silver iodide grains, preferably used are those described in JP-A Nos. 59-119350 and 59-119344.

5) Grain Form

The grain form of tabular silver halide according to the present invention can be expressed by an aspect ratio which is well known in the art. A mean aspect ratio of the tabular silver halide grains according to the invention is from 2 to 100, more preferably from 5 to 80, and even more preferably from 8 to 50.

A mean grain thickness of the tabular silver halide according to the invention is preferably 0.3 μm or less, more preferably 0.2 μm or less, and even more preferably 0.15 μm or less.

The silver halide having high silver iodide content of the invention can take a complicated form, and as the preferable form, there are listed, for example, connecting grains as shown in R. L. JENKINS et al., J. of Phot. Sci., vol. 28 (1980), p164, FIG. 1. Tabular grains as shown in FIG. 1 of the same literature can also be preferably used. Silver halide grains which are rounded at corners can also be used preferably. The surface indices (Miller indices) of the outer surface of a photosensitive silver halide grain is not particularly restricted, and it is preferable that the ratio occupied by the [100] face is large, because of showing high spectral sensitization efficiency when a spectral sensitizing dye is adsorbed. The ratio is preferably 50% or more, more preferably 65% or more and, further preferably 80% or more. The ratio of the [100] face, Miller index, can be determined by a method described in T. Tani; J. Imaging Sci., vol. 29, page 165, (1985) utilizing adsorption dependency of the [111] face and [100] face in adsorption of a sensitizing dye.

6) Heavy Metal

The photosensitive silver halide grain of the invention can contain metals or complexes of metals belonging to groups 3 to 14 of the periodic table (showing groups 1 to 18). Preferably, the photosensitive silver halide grain can contain metals or complexes of metals belonging to groups 6 to 10 of the periodic table. The metal or the center metal of the metal complex from groups 6 to 10 of the periodic table is preferably ferrum, rhodium, ruthenium, or iridium. The metal complex may be used alone, or two or more kinds of complexes comprising identical or different species of metals may be used together. The content is preferably in a range from $1\times10^{-9}$ mol to $1\times10^{-3}$ mol per 1 mol of silver. The heavy metals, metal complexes and the addition method thereof are described in JP-A No. 7-225449, in paragraph Nos. 0018 to 0024 of JP-A No. 11-65021, and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4''}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion, and lithium ion, ammonium ion, and alkyl ammonium ion (for example, tetramethyl ammonium ion, tetraethyl ammonium ion, tetrapropyl ammonium ion, and tetra(n-butyl) ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin. The addition amount of the hexacyano metal complex is preferably from $1\times10^{-5}$ mol to $1\times10^{-2}$ mol and, more preferably, from $1\times10^{-4}$ mol to $1\times10^{-3}$, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization, and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of an emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complexes is added after addition of an aqueous silver nitrate just before completion of grain formation, it can be adsorbed to the outermost surface of the silver halide grain and most of them form an insoluble salt with silver ions on the surface of the grain. Since silver salt of hexacyano iron (II) is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

7) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and low molecular weight gelatin having a molecular weight of 500 to 60,000 is preferably used. These low molecular weight gelatins may be used at grain formation or at the time of dispersion after desalting treatment and it is preferably used at the time of dispersion after desalting treatment.

8) Chemical Sensitization

The photosensitive silver halide in the present invention can be used without chemical sensitization, but is preferably chemically sensitized by at least one of a chalcogen sensitizing method, gold sensitizing method, and reduction sensitizing method. The chalcogen sensitizing method includes sulfur sensitizing method, selenium sensitizing method and tellurium sensitizing method.

In sulfur sensitization, unstable sulfur compounds can be used. Such unstable sulfur compounds are described in Chimie et Pysique Photographique, written by P. Grafkides, (Paul Momtel, 5th ed., 1987) and Research Disclosure (vol. 307, Item 307105), and the like. As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea, or carboxymethyltrimethylthiourea), thioamides (e.g., thioacetamide), rhodanines (e.g., diethylrhodanine or 5-benzylydene-N-ethylrhodanine), phosphinesulfides (e.g., trimethylphosphinesulfide), thiohydantoins, 4-oxo-oxazolidin-2-thiones, disulfides or polysulfides (e.g., dimorphorinedisulfide, cystine, or lenthionine (1,2,3,5,6-pentathiepane)), polythionates, and sulfur element, and active gelatin can be used. Specifically, thiosulfates, thioureas, and rhodanines are preferred.

In selenium sensitization, unstable selenium compounds can be used. These unstable selenium compounds are described in Japanese Patent Application Publication (JP-B) Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea, or acetyltrimethylselemourea), selenoamides (e.g., selenoamide or N,N-diethylphenylselenoamide), phosphineselenides (e.g., triphenylphosphineselenide or pentafluorophenyl-triphenylphosphineselenide), selenophosphates (e.g., tri-p-tolylselenophosphate or tri-n-butylselenophosphate), selenoketones (e.g., selenobenzophenone), isoselenocyanates, selenocarbonic acids, selenoesters, diacylselenides, or the like can be used. Furthermore, non-unstable selenium compounds such as selenius acid, salts of selenocyanic acid, selenazoles, and selenides described in JP-B Nos. 46-4553 and 52-34492, and the like can also be used. Specifically, phosphineselenides, selenoureas, and salts of selenocyanic acids are preferred.

In tellurium sensitization, unstable tellurium compounds are used. Unstable tellurium compounds described in JP-A Nos. 4-224595, 4-271341, 4-333043, 5-303157, 6-27573, 6-175258, 6-180478, 6-208186, 6-208184, 6-317867, 7-140579, 7-301879, 7-301880 and the like, can be used as a tellurium sensitizer.

As typical examples of a tellurium sensitizer, phosphinetellurides (e.g., butyl-diisopropylphosphinetelluride, tributylphosphinetelluride, tributoxyphosphinetelluride, or ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride, or bis(ethoxycarmonyl)telluride), telluroureas (e.g., N,N'-dimethylethylenetellurourea or N,N'-diphenylethylenetellurourea), telluramides, or telluroesters may be used. Specifically, diacyl(di)tellurides and phosphinetellurides are preferred. Especially, the compounds described in paragraph No. 0030 of JP-A No. 11-65021 and compounds represented by formulae (II), (III), or (IV) in JP-A No. 5-313284 are preferred.

Specifically, as for the chalcogen sensitization of the invention, selenium sensitization and tellurium sensitization are preferred, and tellurium sensitization is particularly preferred.

In gold sensitization, gold sensitizer described in Chimie et Physique Photographique, written by P. Grafkides, (Paul Momtel, 5th ed., 1987) and Research Disclosure (vol. 307, Item 307105) can be used. More specifically, chloroauric acid, potassium chloroaurate, potassium aurithiocyanate, gold sulfide, gold selenide, or the like can be used. In addition to these, the gold compounds described in U.S. Pat. Nos. 2,642,361, 5,049,484, 5,049,485, 5,169,751, and 5,252,455, Belg. Patent No. 691857, and the like can also be used. Noble metal salts other than gold such as platinum, palladium, iridium and the like, which are described in Chimie et Pysique Photographique, written by P. Grafkides, (Paul Momtel, 5th ed., 1987) and Research Disclosure (vol. 307, Item 307105), can also be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The addition amount of chalcogen sensitizer used in the invention may vary depending on the silver halide grain used, the chemical ripening condition, and the like, and it is from $10^{-8}$ mol to $10^{-1}$ mol, and preferably from about $10^{-7}$ mol to about $10^{-2}$ mol, per 1 mol of silver halide.

Similarly, the addition amount of the gold sensitizer used in the invention may vary depending on various conditions and it is generally from $10^{-7}$ mol to $10^{-2}$ mol and, more preferably, from $10^{-6}$ mol to $5\times10^{-3}$ mol, per 1 mol of silver halide. There is no particular restriction on the condition for the chemical sensitization and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is from 3 to 10, preferably, from 4 to 9; and the temperature is at from 20° C. to 95° C., preferably, from 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide, or dimethylamine borane is preferred, as well as use of stannous chloride, aminoimino methane sulfonic acid, hydrazine derivatives, borane compounds, silane compounds, polyamine compounds, and the like are preferred. The reduction sensitizer may be added at any stage in the photosensitive emulsion production process from crystal growth to the preparation step just before coating. Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally from $10^{-7}$ mol to $10^{-1}$ mol and, more preferably, from $10^{-6}$ mol to $5\times10^{-2}$ mol per 1 mol of silver halide.

In the silver halide emulsion used in the invention, a thiosulfonate compound may be added by the method shown in EP-A No. 293917.

The photosensitive silver halide grain in the invention is preferably chemically sensitized by at least one method of gold sensitizing method and chalcogen sensitizing method for the purpose of designing a high-sensitivity photothermographic material.

9) Compound that Can be One-Electron-Oxidized to Provide a One-Electron Oxidation Product which Releases One or More Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is preferably a compound selected from the following Groups 1 or 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation reaction.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications. In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

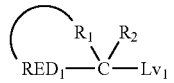

Formula (2)

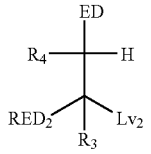

In formulae (1) and (2), $RED_1$ and $RED_2$ each independently represent a reducing group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

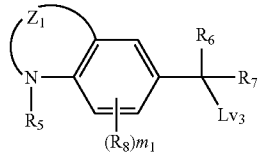

Formula (4)

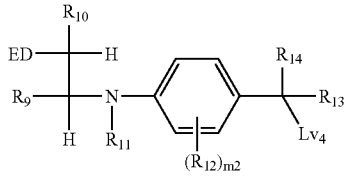

-continued

Formula (5)

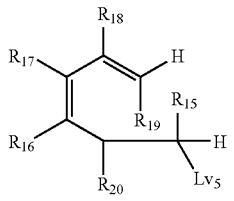

In formulae (3), (4), and (5), $Z_1$ represents an atomic group capable to form a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent, however, in the case where $R_{20}$ represents a group other than an aryl group, $R_{16}$ and $R_{17}$ bind each other to form an aromatic ring or a hetero aromatic ring. $R_8$ and $R_{12}$ represent a substituent capable of substituting for a hydrogen atom on a benzene ring. $m_1$ represents an integer of 0 to 3, and m2 represents an integer of 0 to 4. $Lv_3$, $Lv_4$, and $Lv_5$ each independently represent a leaving group.

Formula (6)

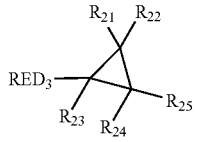

Formula (7)

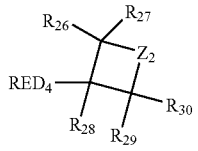

In formulae (6) and (7), $RED_3$ and $RED_4$ each independently represent a reducing group. $R_{21}$ to $R_{30}$ each independently represent a hydrogen atom or a substituent. $Z_2$ represents one selected from —$CR_{111}R_{112}$—, —$NR_{113}$—, or —O—. $R_{111}$ and $R_{112}$ each independently represent a hydrogen atom or a substituent. $R_{113}$ represents one selected from a hydrogen atom, an alkyl group, an aryl group, or a heterocyclic group.

Formula (8)

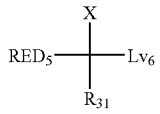

In formula (8), $RED_5$ is a reducing group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, or a heterocyclic amino group. $Lv_6$ is a leaving group and represents a carboxyl group or a salt thereof, or a hydrogen atom.

Reaction formula (1)

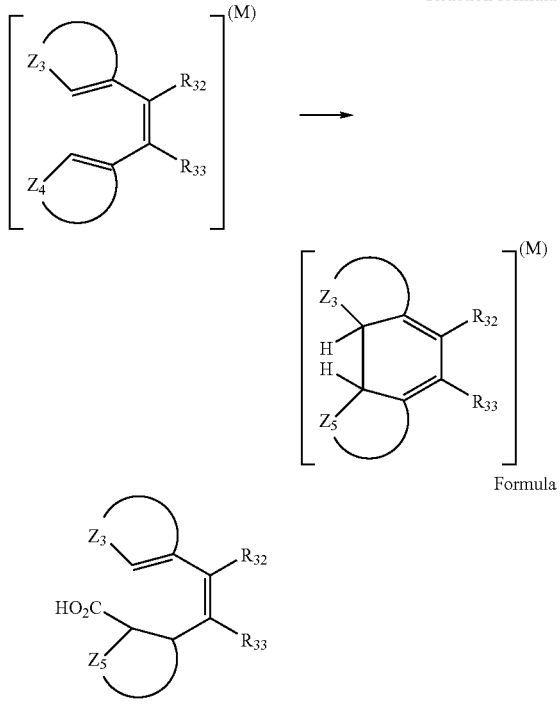

Formula (9)

The compound represented by formula (9) is a compound that undergoes a bonding reaction represented by reaction fomula (1) after undergoing two-electrons-oxidation accompanied by decarbonization and further oxidized. In reaction formula (1), $R_{32}$ and $R_{33}$ represent a hydrogen atom or a substituent. $Z_3$ represents a group to form a 5 or 6-membered heterocycle with C═C. $Z_4$ represents a group to form a 5 or 6-membered aryl group or heterocyclic group with C═C. M represents one selected from a radical, a radical cation, and a cation. In formula (9), $R_{32}$, $R_{33}$, and $Z_3$ are the same as those in reaction formula (1). $Z_5$ represents a group to form a 5 or 6-membered cyclic aliphatic hrdrocarbon group or heterocyclic group with C—C.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) which can undergo the chemical reaction represented by reaction formula (1). The preferable range of these compounds is the same as the preferable range described in the quoted specification.

$RED_6$—Q—Y Formula (10)

In formula (10), $RED_6$ represents a reducing group which can be one-electron-oxidized. Y represents a reactive group containing a carbon-carbon double bond part, a carbon-carbon triple bond part, an aromatic group part, or benzo-condensed nonaromatic heterocyclic part which can react with one-electron-oxidized product formed by one-electron-oxidation of $RED_6$ to form a new bond. Q represents a linking group to link $RED_6$ and Y.

Reaction formula (1)

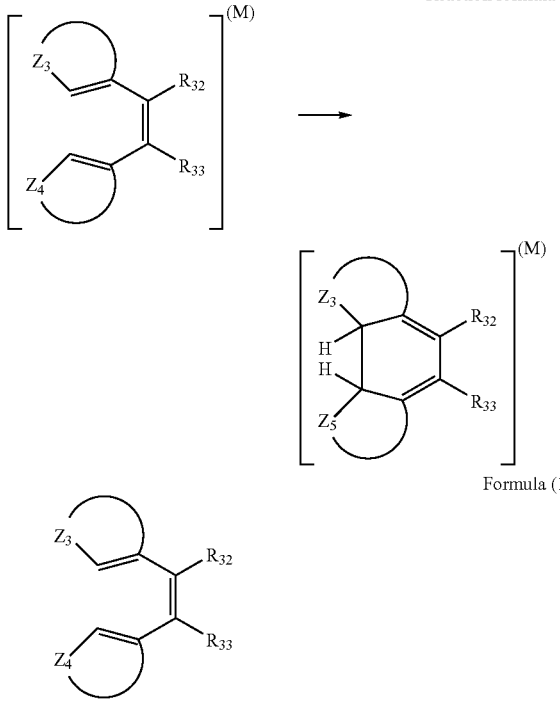

Formula (11)

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group to form a 5 or 6-membered heterocycle with C═C. $Z_4$ represents a group to form a 5 or 6-membered aryl group or heterocyclic group with C═C. $Z_5$ represents a group to form a 5 or 6-membered cyclic aliphatic hydrocarbon group or heterocyclic group with C—C. M represents one selected from a radical, a radical cation, and a cation. In formula (11), $R_{32}$, $R_{33}$, $Z_3$, and $Z_4$ are the same as those in reaction formula (1).

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different with each other.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having —NH— group as a partial structure of heterocycle capable to form a silver imidate (>NAg) (e.g., a benzotriazole group, a benzimidazole group, an indazole group, or the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5 or 6-membered aromatic heterocyclic group containing a quaternary nitrogen atom is further preferably used. Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Groups 1 or 2 having a quaternary salt of nitrogen or phosphorus as an adsorptive group is represented by formula (X).

$$(P—Q_1—)_i—R(—Q_2—S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

Specific examples of the compounds of Groups 1 or 2 according to the invention are shown below without intention of restricting the scope of the invention.

1

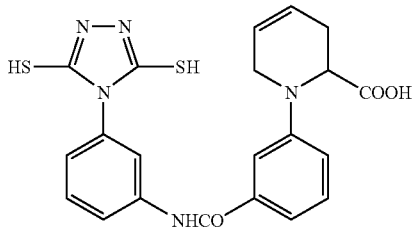

2

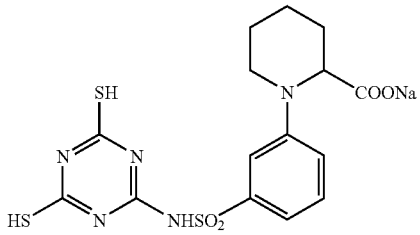

3

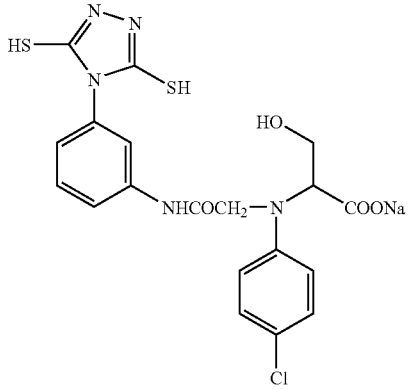

4

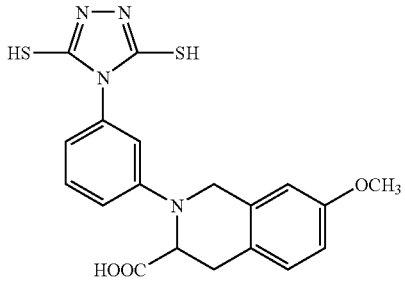

5

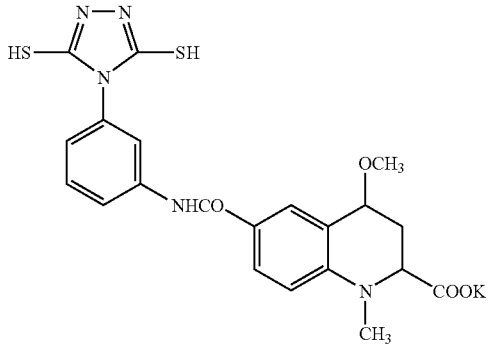

6

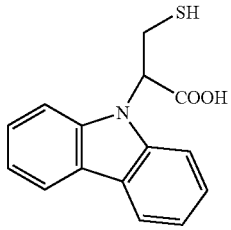

7

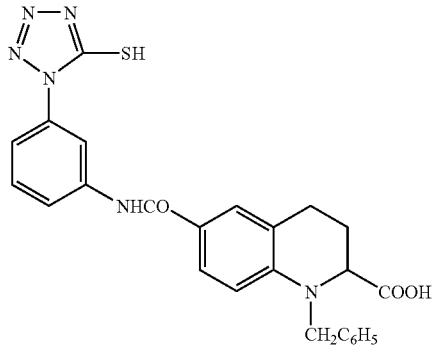

8

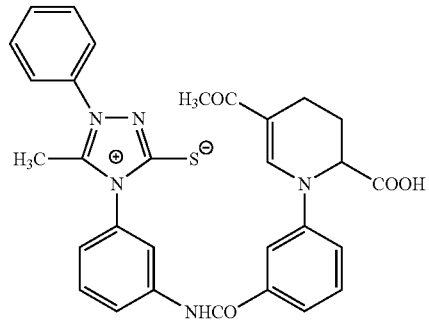

-continued
9
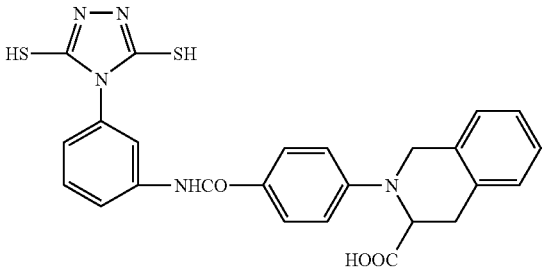
10
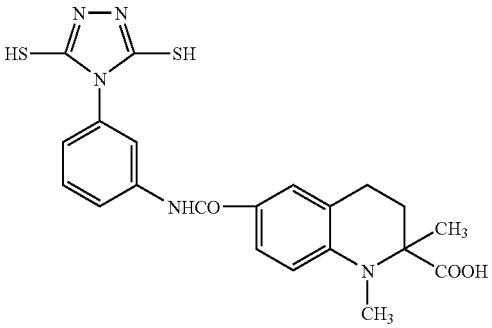
11
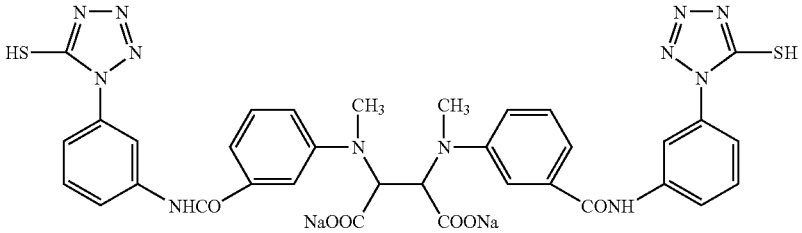
12
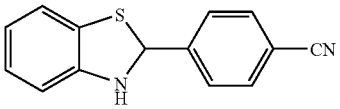
13
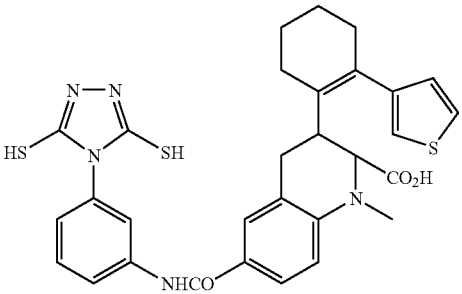
14
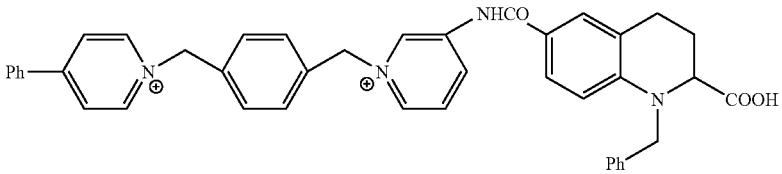
15
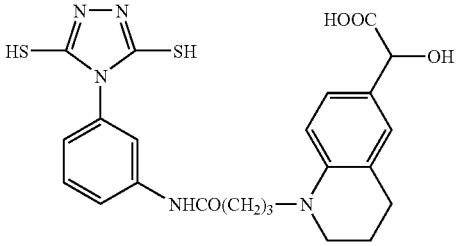
16
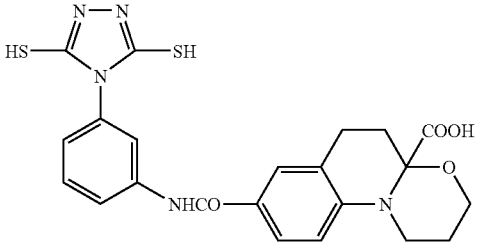

-continued
17
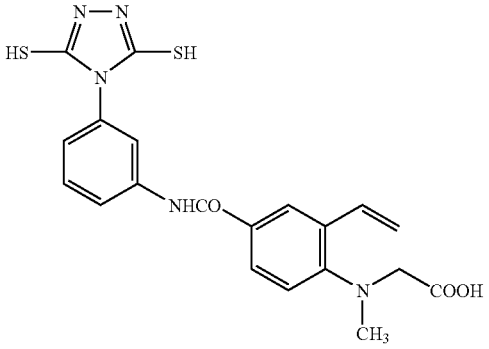
18
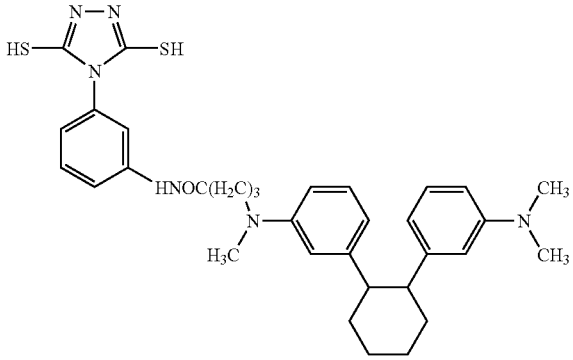
19
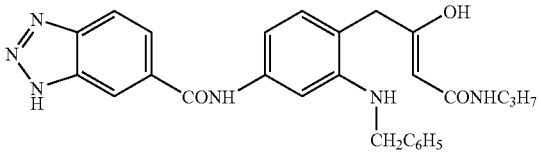
20
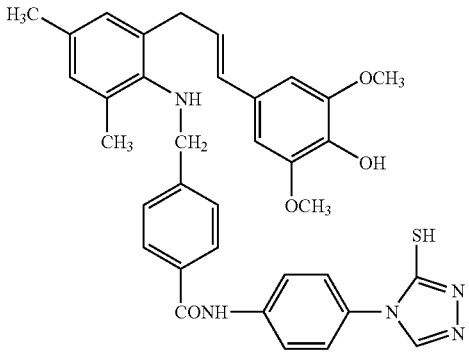
21
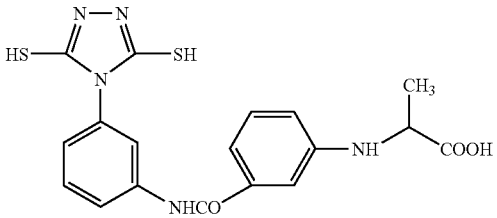
22
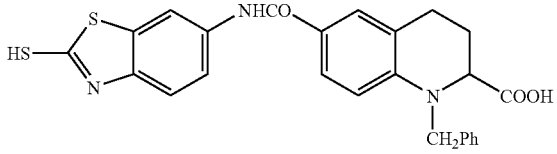
23
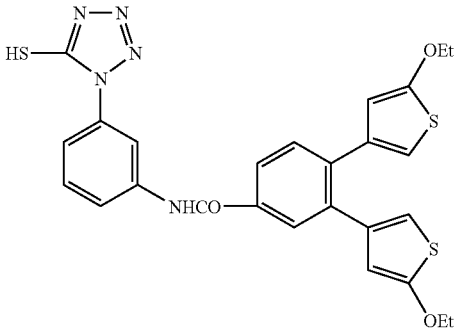
24
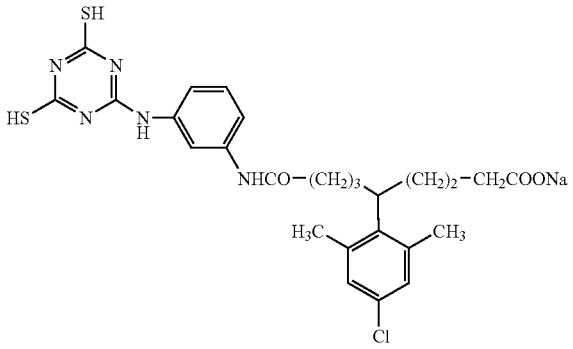

-continued
25
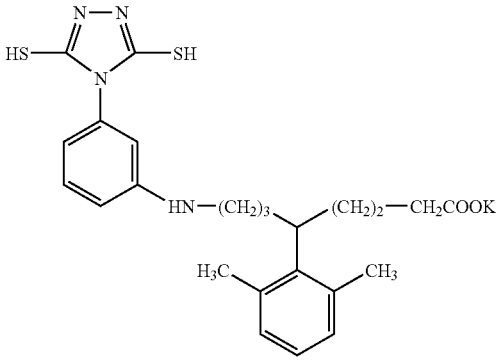
26
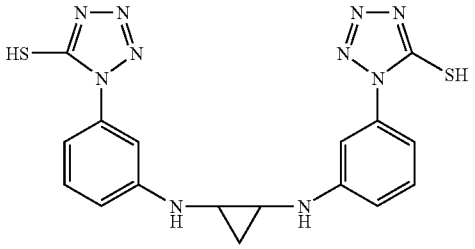
27
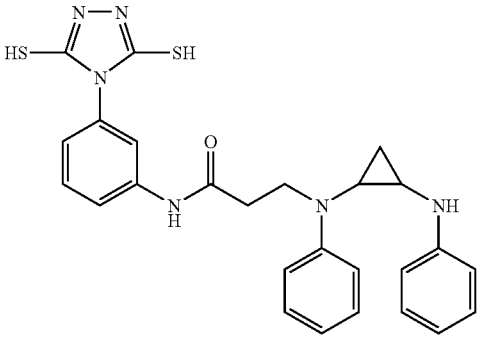
28
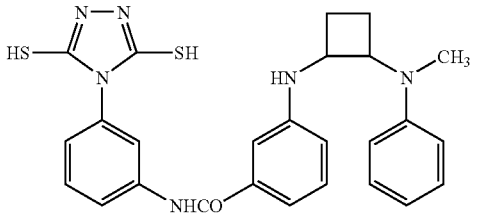
29
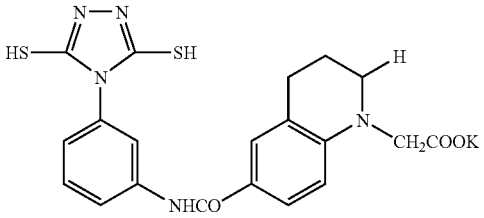
30
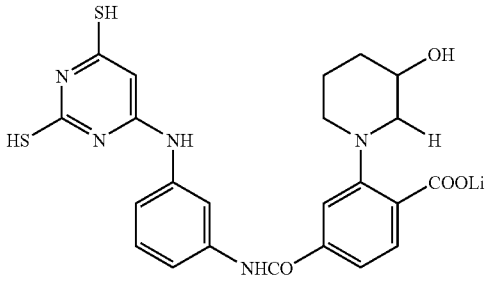
31
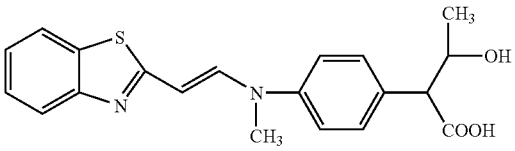
32
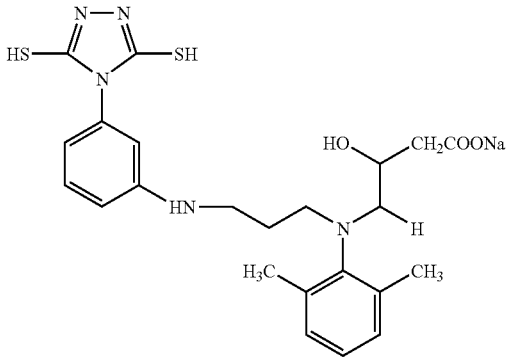

-continued
33
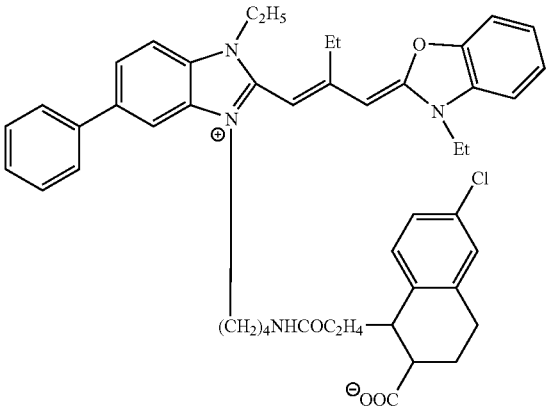
34
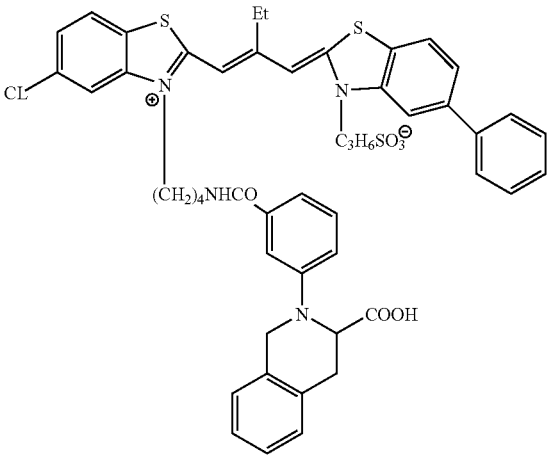
35
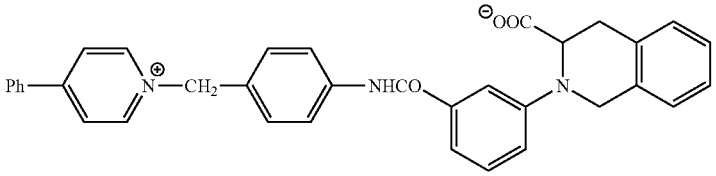
36
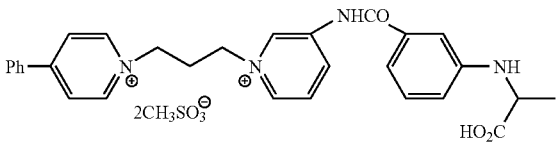
37
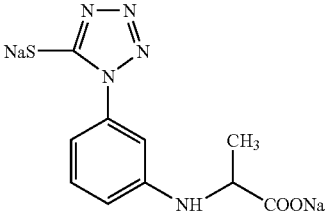
38
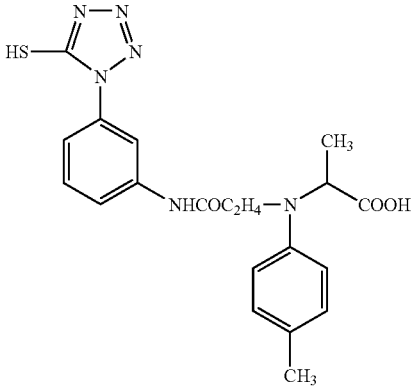
39
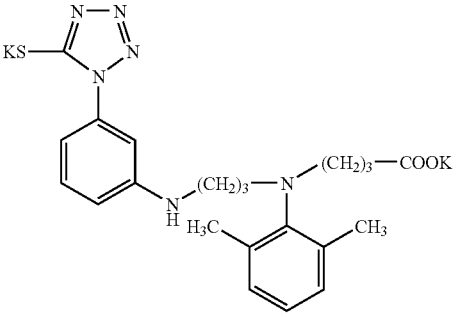

-continued
40
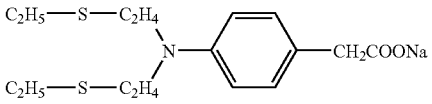
41
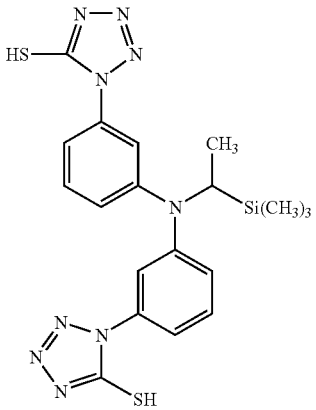
42
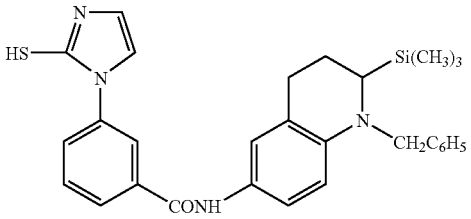
43
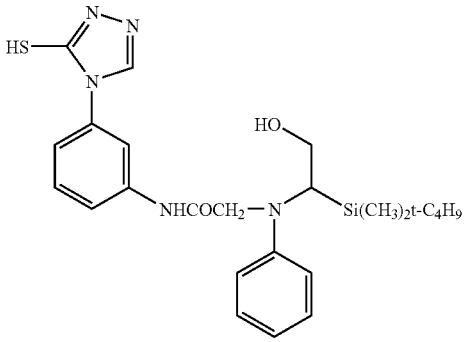
44
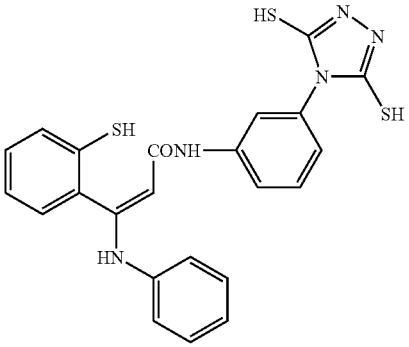
45
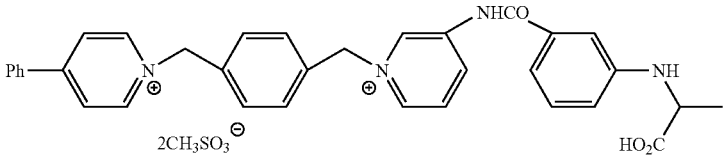
46
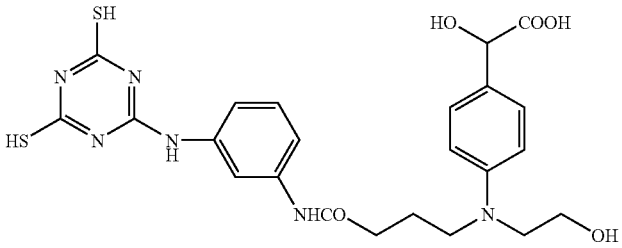

-continued

47

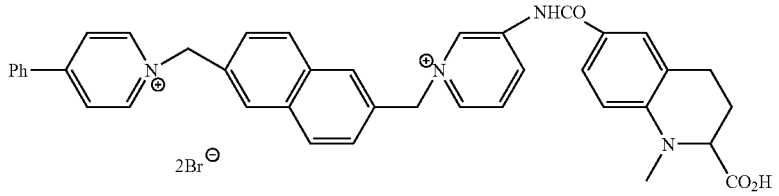

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added at the chemical sensitization step or before coating.

It is preferred that the compound of Groups 1 or 2 according to the invention is dissolved in water, a water-soluble solvent such as methanol and ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer. The compound may be added to a surface protective layer, or an intermediate layer, as well as the image forming layer, to be diffused to the image forming layer in the coating step. The compound may be added before or after addition of a sensitizing dye. Each compound is contained in the image forming layer preferably in an amount of from $1\times10^{-9}$ mol to $5\times10^{-2}$ mol, more preferably from $1\times10^{-8}$ mol to $2\times10^{-3}$ mol, per 1 mol of silver halide.

10) Compound Having Adsorptive Group and Reducing Group

The photothermographic material of the present invention preferably comprises a compound having an adsorptive group to silver halide and a reducing group in a molecule. It is preferred that the compound is represented by the following formula (I).

A—(W)n-B Formula (I)

In formula (I), A represents a group capable of adsorption to a silver halide (hereafter, it is called an adsorptive group); W represents a divalent linking group; n represents 0 or 1; and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also include a linear or cyclic thioamide group, thiouredide group, thiourethane group, and dithiocarbamate ester group. The heterocyclic group, as an adsorptive group, which contains at least one atom selected from a nitrogen atom, a sulfur atom, a selenium atom, or a tellurium atom represents a nitrogen-containing heterocyclic group having —NH— group, as a partial structure of a heterocycle, capable to form a silver iminate (>NAg) or a heterocyclic group, having an —S— group, a —Se— group, a —Te— group or a ═N— group as a partial structure of a heterocycle, and capable to coordinate to a silver ion by a chelate bonding. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzophthiophene group, a benzothiazole group, a benzoxazole group, a thiadiazole group, an oxadiazole group, a triazine group, a selenoazole group, a benzoselenazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group capable to form an imino-silver (>NAg) as a partial structure of heterocycle (e.g., a benzotriazole group, a benzimidazole group, an indazole group, or the like) are preferable, and more preferable as an adsorptive group are a 2-mercaptobenzimidazole group and a 3,5-dimercapto-1,2,4-triazole group.

In formula (I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol: pH 6.5 Britton-Robinson buffer=10%:90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (I), a reducing group represented by B is preferably a residue which is obtained by removing one hydrogen atom from hydroxylamines, hydroxamic acids, hydroxyureas, hydroxysemicarbazides, reductones, phenols, acylhydrazines, carbamoylhydrazines, or 3-pyrazolidones.

The compound of formula (I) according to the present invention may have the ballasted group or polymer chain in it generally used in the non-moving photographic additives as a coupler. And as a polymer, for example, the polymer described in JP-A No. 1-100530 can be selected.

The compound of formula (I) according to the present invention may be bis or tris type of compound. The molecular weight of the compound represented by formula (I) according to the present invention is preferably from 100 to 10000, more preferably from 120 to 1000, and particularly preferably from 150 to 500.

The examples of the compound represented by formula (I) according to the present invention are shown below, but the present invention is not limited in these.

(1)

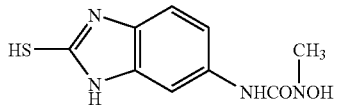

(2)

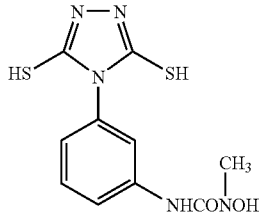

(3)

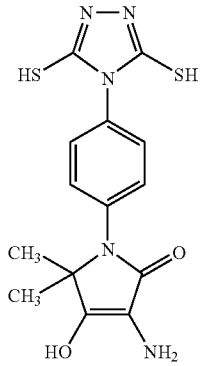

-continued (4)

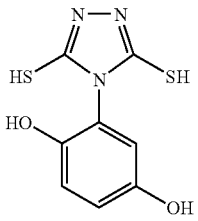

(5)

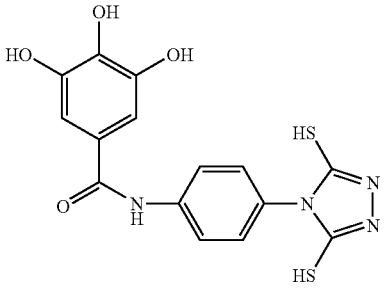

(6)

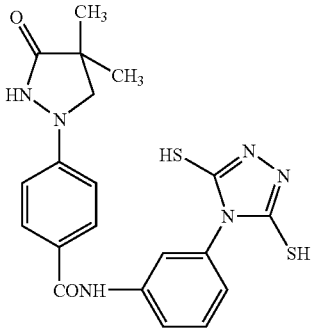

(7)

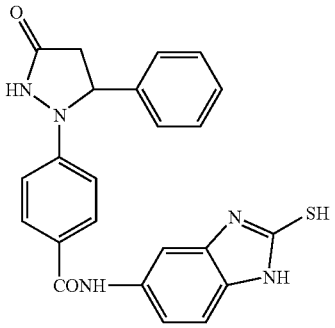

(8)

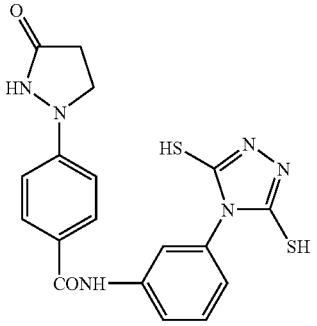

-continued (9)

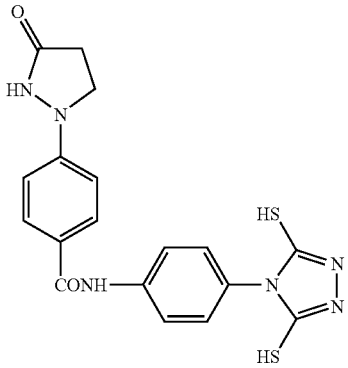

(10)

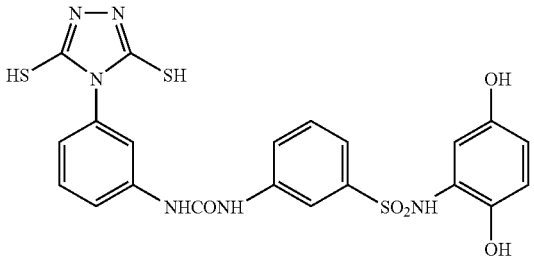

(11)

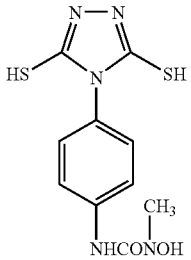

(12)

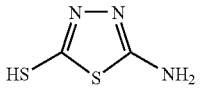

(13)

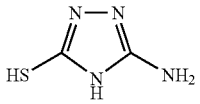

Further, example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method. The compound of formula (I) in the present invention can be used alone, but it is preferred to use two or more kinds of the compounds in combination. When two or more kinds of the compounds are used in combination, those may be added to the same layer or the different layers, whereby adding methods may be different from each other.

The compound represented by formula (I) according to the present invention is preferably added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the kind of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (I) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

(Compound which Substantially Reduces Haze by Photosensitive Silver Halide after Thermal Development)

In the present invention, it is preferred that the photothermographic material contains a compound which substantially reduces haze by photosensitive silver halide after thermal development relative to before thermal development.

In the present invention, it is particularly preferred that a silver iodide complex-forming agent is used as the compound which substantially reduces haze by photosensitive silver halide after thermal development.

<Silver Iodide Complex-forming Agent>

Concerning the silver iodide complex-forming agent according to the present invention, at least one of a nitrogen atom or a sulfur atom in the compound can contribute to a Lewis acid-base reaction which gives an electron to a silver ion, as a ligand atom (electron donor: Lewis base). The stability of the complex is defined by successive stability constant or total stability constant, but it depends on the combination of silver ion, iodo ion and the silver complex forming agent. As a general guide, it is possible to obtain a large stability constant by a chelate effect from intramolecular chelate ring formation, by means of increasing the acid-base dissociation constant, or the like.

In the present invention, the haze of the photosensitive silver halide can be measured by a commercially available tubidimeter or a haze measuring apparatus. When the absorption derived from other compounds added to the photothermographic material overlaps with the absorption of photosensitive silver halide, the haze of photosensitive silver halide can be observed by using, independently or in combination, the means of difference spectrum or removal of other compounds by solvent, or the like.

As a silver iodide complex-forming agent according to the present invention, a 5 to 7-membered heterocyclic compound containing at least one nitrogen atom is preferable. In the case where the compound does not have a mercapto group, a sulfide group, or a thione group as a substituent, the said nitrogen containing 5 to 7-membered heterocycle may be saturated or unsaturated, and may have another substituent. The substituent on a heterocycle may bind to each other to form a ring.

As preferable examples of 5 to 7-membered heterocyclic compounds, pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, 1,2,4-triazine, 1,3,5-triazine, pyrrolidine, imidazolidine, pyrazolidine, piperidine, piperazine, morpholine, indoline, isoindoline, and the like can be described. More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzotriazole, 1,2,4-triazine, 1,3,5-triazine, and the like can be described. Particularly preferably, pyridine, imidazole, pyrazine, pyrimidine, pyridazine, phtharazine, triazine, 1,8-naphthylizine, 1,10-phenanthroline, and the like can be described.

These rings may have a substituent and any substituent can be used as far as it does not negatively impact the photographic property. As preferable examples, a halogen atom (fluorine atom, chlorine atom, bromine atom, or iodine atom), an alkyl group (a straight, a branched, a cyclic alkyl group containing a bicycloalkyl group and an active methine group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, an N-acylcarbamoyl group, an N-sulfonylcarbamoyl group, an N-carbamoylcarbamoyl group, an N-sulfamoylcarbamoyl group, a carbazoyl group, a carboxyl group and a salt thereof, an oxalyl group, an oxamoyl group, a cyano group, a carbonimidoyl group, a formyl group, a hydroxy group, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamide group, a ureido group, a thioureido group, an imide group, an alkoxycarbonylamino group, an aryloxycarbonylamino group, a sulfamoylamino group, a semicarbazide group, an ammonio group, an oxamoylamino group, an N-alkylsulfonylureido group, an N-arylsulfonylureido group, an N-acylureido group, an N-acylsulfamoylamino group, a nitro group, a heterocyclic group containing a quaternary nitrogen atom (e.g., a pyridinio group, an imidazolio group, a quinolinio group, or an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, an N-acylsulfamoyl group, an N-sulfonylsulfamoyl group and a salt thereof, a phosphino group, a phosphinyl group, a phosphinyloxy group, a phosphinylamino group, a silyl group, and the like are described. Here, an active methine group means a methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group. Herein, two electron-attracting groups may bind each other to form a cyclic structure. And, the salt means a salt formed with positive ion such as an alkaline metal, an alkaline earth metal, a heavy metal, or the like, or organic positive ion such as an ammonium ion, a phosphonium ion, or the like. These substituents may be further substituted by these substituents.

These heterocycles may be further condensed by another ring. In the case where the substituent is an anion group (e.g., $—CO_2^-$, $—SO_3^-$, $—S^-$, or the like), the heterocycle containing nitrogen atom of the invention may become a positive ion (e.g., pyridinium, 1,2,4-triazolium, or the like) and may form an intramolecular salt.

In the case where a heterocyclic compound is pyridine, pyrazine, pyrimidine, pyridazine, phthalazine, triazine, naththilizine, or phenanthroline derivative, the acid dissociation constant (pKa) of a conjugated acid of nitrogen containing heterocyclic part in acid dissociation equilibrium of the said compound is preferably from 3 to 8 in the mixture solution of tetrahydrofuran/water (3/2) at 25° C., and more preferably, the pKa is from 4 to 7.

As the heterocyclic compound, pyridine, pyridazine, and phtharazine derivative are preferable, and particularly preferable are pyridine and phthalazine derivative. In the case where these heterocyclic compounds have a mercapto group, a sulfide group or a thione group as the substituent, pyridine, thiazole, isothiazole, oxazole, isoxazole, imidazole, pyrazole, pyrazine, pyrimidine, pyridazine, triazine, triazole, thiadiazole, and oxadiazole derivatives are preferable, and thiazole, imidazole, pyrazole, pyrazine, pyrimidine, pyridazine, triazine, and triazole derivatives are particularly preferable. For example, as the said silver iodide complex-forming agent, the compound represented by the following formulae (1) or (2) can be used.

Formula (1)

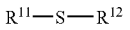

Formula (2)

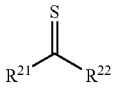

In formula (1), $R^{11}$ and $R^{12}$ each independently represent a hydrogen atom or a substituent. In formula (2), $R^{21}$ and $R^{22}$ each independently represent a hydrogen atom or a substituent. However, both of $R^{11}$ and $R^{12}$ are not hydrogen atoms together and both of $R^{21}$ and $R^{22}$ are not hydrogen atoms together. As the substituent herein, the substituent explained as the substituent of a 5 to 7-membered nitrogen containing heterocyclic type silver iodide complex-forming agent mentioned above can be described.

Further, the compound represented by formula (3) described below can also be used preferably.

Formula (3)

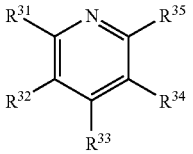

In formula (3), $R^{31}$ to $R^{35}$ each independently represent a hydrogen atom or a substituent. As the substituent represented by $R^{31}$ to $R^{35}$, the substituent of a 5 to 7-membered nitrogen containing heterocyclic type silver iodide complex-forming agent mentioned above can be used. In the case where the compound represented by formula (3) has a substituent, preferred substituting position is $R^{32}$ to $R^{34}$. $R^{31}$ to $R^{35}$ may bind each other to form a saturated or an unsaturated ring. A preferred substituent is a halogen atom, an alkyl group, an aryl group, a carbamoyl group, a hydroxy group, an alkoxy group, an aryloxy group, a carbamoyloxy group, an amino group, an acylamino group, a ureido group, an alkoxycarbonylamino group, an aryloxycarbonylamino group, or the like.

In the compound represented by formula (3), the acid dissociation constant (pKa) of conjugated acid of pyridine ring part is preferably from 3 to 8 in the mixed solution of tetrahydrofuran/water (3/2) at 25° C., and particularly preferably, from 4 to 7. Furthermore, the compound represented by formula (4) is also preferable.

Formula (4)

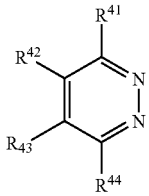

In formula (4), $R^{41}$ to $R^{44}$ each independently represent a hydrogen atom or a substituent. $R^{41}$ to $R^{44}$ may bind each other to form a saturated or an unsaturated ring. As the substituent represented by $R^{41}$ to $R^{44}$, the substituent of a 5 to 7-membered nitrogen containing heterocyclic type silver iodide complex-forming agent mentioned above can be described. As preferred group, an alkyl group, an alkenyl group, an alkynyl group, an aryl group, a hydroxy group, an alkoxy group, an aryloxy group a heterocyclic oxy group, and a group which forms a phthalazine ring by benzocondensation are described. In the case where a hydroxy group exists at the carbon atom adjacent to nitrogen atom of the compound represented by formula (4), there exists equilibrium between pyridazinone. The compound represented by formula (4) more preferably forms a phthalazine ring represented by the following formula (5), and furthermore, this phthalazine ring particularly preferably has at least one subsutituent. As examples of $R^{51}$ to $R^{56}$ in formula (5), the substituent of a 5 to 7-membered nitrogen containing heterocyclic type silver iodide complex-forming agent mentioned above can be described. And as more preferable examples of the substituent, an alkyl group, an alkenyl group, an alkynyl group, an aryl group, a hydroxy group, an alkoxy group, an aryloxy group, and the like are described. An alkyl group, an alkenyl group, an aryl group, an alkoxy group, and an aryloxy group are preferable and an alkyl group, an alkoxy group, and an aryloxy group are more preferable.

Formula (5)

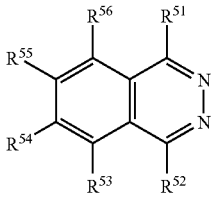

Further, the compound represented by formula (6) described below is also a preferable embodiment.

Formula (6)

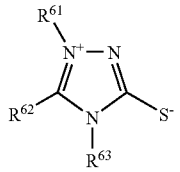

In formula (6), $R^{61}$ to $R^{63}$ each independently represent a hydrogen atom or a substituent. As examples of the substituent represented by $R^{62}$, the substituent of a 5 to 7-membered nitrogen containing heterocyclic type silver iodide complex-forming agent mentioned above can be described.

As the compound preferably used, the compound represented by the following formula (7) is described.

$$R^{71}—S-(L)_n-S—R^{72}$$ Formula (7)

In formula (7), $R^{71}$ and $R^{72}$ each independently represent a hydrogen atom or a substituent. L represents a divalent linking group. n represents 0 or 1. As the substituent represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imide group, and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably used is a compound represented by formula (8).

Formula (8)

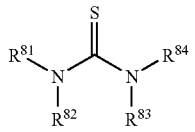

In formula (8), $R^{81}$ to $R^{84}$ each independently represent a hydrogen atom or a substituent. As the substituent represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imide group, and the like are described as examples. Among the silver iodide complex-forming agents described above, the compounds represented by formulae (3), (4), (5), (6), or (7) are more preferable and, the compounds represented by formulae (3) or (5) are particularly preferable.

Preferable examples of silver iodide complex-forming agent are described below, however the present invention is not limited in these.

(1)

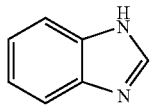

-continued (2)

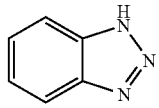

(3)

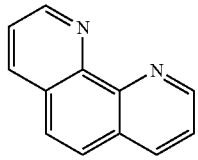

(4)

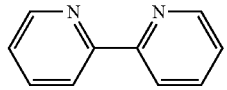

(5)

$C_5H_{11}SC_5H_{11}$ (6)

$C_4H_9SCH_2CH_2SC_4H_9$ (7)

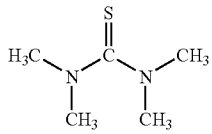

(8)

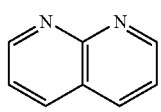

(9)

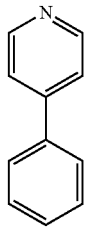

(10)

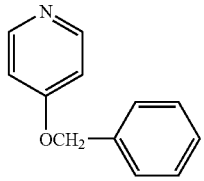

(11)

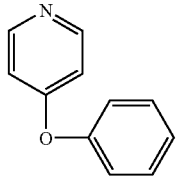

(12)

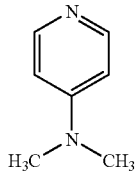

-continued
(13)
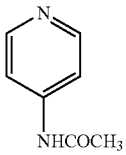
(14)
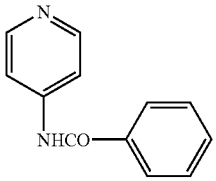
(15)
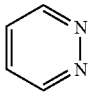
(16)
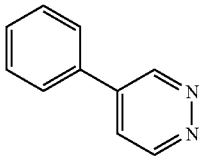
(17)
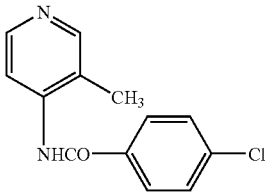
(18)
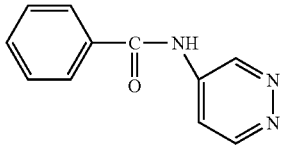
(19)
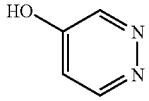
(20)
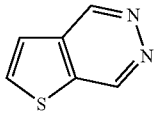
(21)
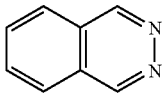
(22)
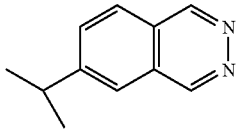
(23)
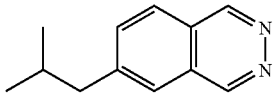
-continued
(24)
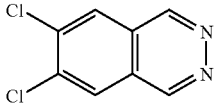
(25)
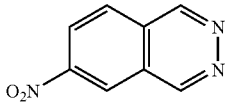
(26)
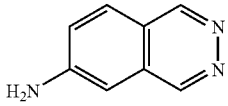
(27)
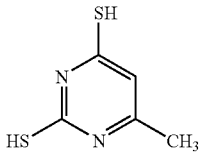
(28)
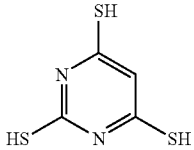
(29)
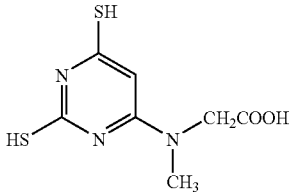
(30)
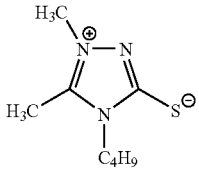
(31)
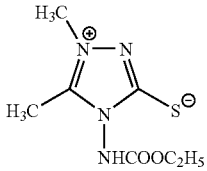
(32)
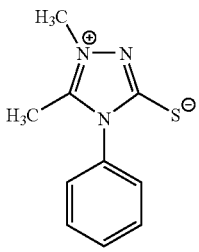

-continued (33)

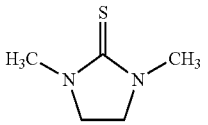

(34)

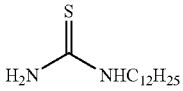

(35)

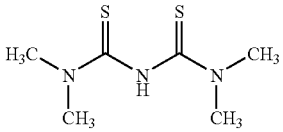

(36)

$HO(CH_2)_3S(CH_2)_2S(CH_2)_3OH$ (37)

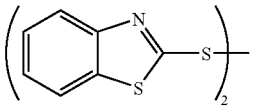

(38)

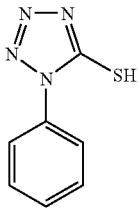

(39)

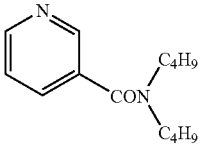

(40)

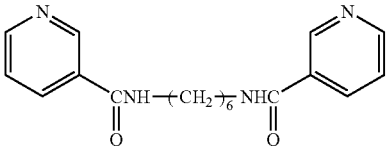

(41)

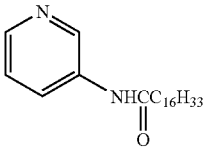

(42)

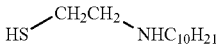

The silver iodide complex-forming agent according to the present invention can also be a compound common to a toner, in the case where the agent achieves the function of conventionally known toner. The silver iodide complex-forming agent according to the present invention can be used in combination with a toner. And, two or more kinds of the silver iodide complex-forming agents may be used in combination.

The silver iodide complex-forming agent according to the present invention preferably exists in a film under the state separated from a photosensitive silver halide, such as a solid state or the like. It is also preferably added to the layer adjacent to the image forming layer. Concerning the silver iodide complex-forming agent according to the present invention, a melting point of the compound is preferably adjusted to a suitable range so that it can be dissolved when heated at thermal developing temperature.

The silver iodide complex-forming agent according to the invention may be incorporated into a photothermographic material by being added into the coating solution, such as in the form of a solution, an emulsion dispersion, a solid fine particle dispersion, or the like.

Well known emulsion dispersing methods include a method comprising dissolving the silver iodide complex-forming agent in an oil such as dibutylphthalate, tricresylphosphate, glyceryl triacetate, diethylphthalate, or the like, using an auxiliary solvent such as ethyl acetate, cyclohexanone, or the like, followed by mechanically forming an emulsified dispersion.

Solid fine particle dispersing methods include a method comprising dispersing the powder of the silver iodide complex-forming agent according to the invention in a proper solvent such as water or the like, by means of ball mill, colloid mill, vibrating ball mill, sand mill, jet mill, roller mill, or ultrasonics, thereby obtaining a solid dispersion.

In this case, there can also be used a protective colloid (such as polyvinyl alcohol), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia and the like, and Zr and the like eluting from the beads may be incorporated in the dispersion. Depending on the dispersing conditions, the amount of Zr and the like generally incorporated in the dispersion is in a range of from 1 ppm to 1000 ppm. It is practically acceptable so long as Zr is incorporated in the photothermographic material in an amount of 0.5 mg or less per 1 g of silver.

Preferably, an antiseptic (for instance, benzisothiazolinone sodium salt) is added in the water dispersion.

The silver iodide complex-forming agent according to the invention is preferably used in the form of a solid dispersion.

The silver iodide complex-forming agent according to the invention is preferably used in a range of from 1 mol % to 5000 mol %, more preferably, from 10 mol % to 1000 mol % and, even more preferably, from 50 mol % to 300 mol %, with respect to the photosensitive silver halide in each case.

(Organic Silver Salt)

The organic silver salt used in the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such a non-photosensitive organic silver salt is disclosed, for example, in JP-A No. 10-62899 (paragraph Nos. 0048 to 0049), EP No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of long chained fatty acid carboxylic acid (having 10 to 30 carbon atoms, preferably, having 15 to 28 carbon atoms) is preferable. Preferred examples of the organic silver salt can include, for example, silver behenate, silver arachidinate, silver stearate, silver oleate, silver laurate, silver capronate, silver myristate, silver palmitate and mixtures thereof. In the present invention, among the organic silver salts, it is preferred to use an organic silver salt with a silver behenate content of 50 mol % or higher, and particularly preferably, fom 75 mol % to 98 mol %.

There is no particular restriction on the shape of the organic silver salt usable in the invention and it may be needle-like, bar-like, tabular, or flake shaped.

In the invention, a flake shaped organic silver salt is preferred. In the present specification, the flake shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flake shape. The relation is preferably: 30≧x(average)≧1.5 and, more preferably, 15≧x(average)≧1.5. By the way, needle-like is expressed as 1≦x(average)<1.5.

In the flake shaped particle, a can be regarded as a thickness of a tabular particle having a main plate with b and c being as the sides. a in average is preferably from 0.01 μm to 0.3 μm and, more preferably, from 0.1 μm to 0.23 μm. c/b in average is preferably from 1 to 6, more preferably from 1 to 4, further preferably from 1 to 3 and, particularly preferably from 1 to 2.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The monodispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

Methods known in the art may be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163827, 2001-163889, 2001-163890, 11-203413, 2001-188313, 2001-83652, 2002-6442, 2002-31870, 2000-214155, 2002-6442, and the like.

In the invention, the photothermographic material can be prepared by mixing an aqueous dispersion of an organic silver salt and an aqueous dispersion of a photosensitive silver salt. A method of mixing two or more kinds of aqueous dispersions of organic silver salts and two or more kinds of aqueous dispersions of photosensitive silver salts upon mixing are used preferably for controlling the photographic properties.

While an organic silver salt in the invention can be used in a desired amount, an amount of an organic silver salt is preferably in a range of from 0.1 g/m$^2$ to 5 g/m$^2$, more preferably from 1 g/m$^2$ to 3 g/m$^2$, and particularly preferably from 1.2 g/m$^2$ to 2.5 g/m$^2$, with respect to the amount of silver.

(Nucleator)

The photothermographic material of the present invention preferably contains a nucleator. The nucleator according to the present invention is a compound, which can form a compound that can newly induce a development by the reaction with a developing product in consequence of an initial development. It was conventionally known to use a nucleator for the ultra-high gradation photosensitive materials suitable for the use in graphic arts. The ultra-high gradation photosensitive materials had an average gradient of 10 or more and were unsuitable for conventional photographic materials, and especially unsuitable for the medical use where high diagnostic ability was required. And because the ultra-high gradation photosensitive material had rough granularity and did not have enough sharpness, there was no potential for medical diagnostic use. The nucleator in the present invention completely differs from the nucleator in the conventional ultra-high gradation photosensitive material as regards the effect. The nucleator in the present invention does not make a hard gradation. The nucleator in the present invention is the compound that can cause development sufficiently, even if the number of photosensitive silver halide grains with respect to non-photosensitive silver salt of an organic acid is extremely low. Although that mechanism is not clear, when thermal development is performed using the nucleator according to the present invention, it becomes clear that a large number of developed silver grains exists than the number of photosensitive silver halide grains in the maximum density part, and it is presumed that the nucleator according to the present invention forms the new development points (development nuclei) in those portions where silver halide grains do not exist.

As the nucleator, hydrazine derivative compounds represented by the following formula (V), vinyl compounds represented by the following formula (VI), and quaternary onium compounds represented by the following formula (P) are preferable. In particular, among the vinyl compounds, cyclic olefine compounds represented by formulae (A), (B), or (C) are preferable.

Formula (V)

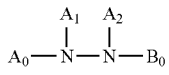

Formula (VI)

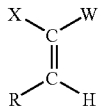

Formula (P)

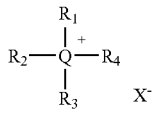

-continued

Formula (A)

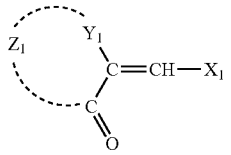

Formula (B)

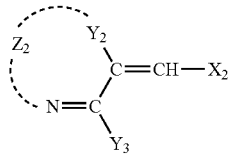

Formula (C)

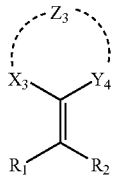

In formula (V), $A_0$ represents one selected from an aliphatic group, an aromatic group, a heterocyclic group, or a —$G_0$—$D_0$ group, each of which may have a substituent. $B_0$ represents a blocking group. $A_1$ and $A_2$ both represent a hydrogen atom, or one represents a hydrogen atom and the other represents one of an acyl group, a sulfonyl group, and an oxalyl group. Wherein, $G_0$ represents one selected from a —CO— group, a —COCO— group, a —CS— group, a —C(=$NG_1D_1$) group, an —SO— group, an —$SO_2$— group, or a —P(O)($G_1D_1$)— group. $G_1$ represents one selected from a mere bonding hand, an —O— group, an —S— group, or an —N($D_1$)— group, and $D_1$ represents one selected from an aliphatic group, an aromatic group, a heterocyclic group, or a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, or an arylthio group. As preferable $D_0$, a hydrogen atom, an alkyl group, an alkoxy group, an amino group, and the like can be described.

In formula (V), the aliphatic group represented by $A_0$ preferably has 1 to 30 carbon atoms, and particularly preferably is a normal, blanched or cyclic alkyl group having 1 to 20 carbon atoms. For example, a methyl group, an ethyl group, a t-butyl group, an octyl group, a cyclohexyl group, and a benzyl group are described. These may be further substituted by a suitable substituent (e.g., an aryl group, an alkoxy group, an aryloxy group, an alkylthio group, an arylthio group, a sulfoxy group, a sulfonamide group, a sulfamoyl group, an acylamino group, a ureido group, or the like).

In formula (V), the aromatic group represented by $A_0$ is preferably an aryl group of a single or condensed ring. For example, a benzene ring or a naphthalene ring is described. As a heterocycle represented by $A_0$, the heterocycle of a single or condensed ring containing at least one heteroatom selected from a nitrogen atom, a sulfur atom, or an oxygen atom is preferable. For example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring and a furan ring are described. The arotamic group, heterocyclic group or —$G_0$—$D_0$ group, as $A_0$, may have a substituent. As $A_0$, an aryl group or a —$G_0$—$D_0$ group is particularly preferable.

And, in formula (V), $A_0$ preferably contains at least one of a diffusion-resistant group or an adsorptive group to silver halide. As a diffusion-resistance group, a ballast group usually used as non-moving photographic additive is preferable. As a ballast group, a photochemically inactive alkyl group, alkenyl group, alkynyl group, alkoxy group, phenyl group, phenoxy group, alkylphenoxy group and the like are described and it is preferred that the substituent part has 8 or more carbon atoms in total.

In formula (V), as an adsorption promoting group to silver halide, thiourea, a thiourethane group, a mercapto group, a thioether group, a thione group, a heterocyclic group, a thioamido heterocyclic group, a mercapto heterocyclic group, and an adsorptive group described in JP-A No. 64-90439 are described.

In formula (V), $B_0$ represents a blocking group and preferably a —$G_0$—$D_0$ group. $G_0$ represents one selected from a —CO— group, a —COCO— group, a —CS— group, a —C(=$NG_1D_1$) group, an —SO— group, an —$SO_2$— group, or a —P(O)($G_1D_1$)— group. As preferable $G_0$, a —CO— group and a —COCO— group are described. $G_1$ represents one selected from a mere bonding hand, an —O— group, an —S— group, or an —N($D_1$)- group, and $D_1$ represents one selected from an aliphatic group, an aromatic group, a heterocyclic group, or a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, or an arylthio group. As preferable $D_0$, a hydrogen atom, an alkyl group, an alkoxy group, an amino group and the like are described. $A_1$ and $A_2$ both represent a hydrogen atom, or one of $A_1$ and $A_2$ represents a hydrogen atom and the other represents one selected from an acyl group (an acetyl group, a trifluoroacetyl group, a benzoyl group or the like), a sulfonyl group (a methanesulfonyl group, a toluenesulfonyl group or the like), or an oxalyl group (an ethoxalyl group or the like).

As specific examples of the compound represented by formula (V), the compound H-1 to H-35 of chemical formula Nos. 12 to 18 and the compound H-1-1 to H-4-5 of chemical formula Nos. 20 to 26 in JP-A No. 2002-131864 are described, however specific examples are not limited in these.

The compounds represented by formula (V) can be easily synthesized by known methods. For example, these can be synthesized by referring to U.S. Pat. Nos. 5,464,738 and 5,496,695.

In addition, hydrazine derivatives preferably used are the compound H-1 to H-29 described in U.S. Pat. No. 5,545,505, columns 11 to 20 and the compounds 1 to 12 described in U.S. Pat. No. 5,464,738, columns 9 to 11. These hydrazine derivatives can be synthesized by known methods.

Next, formula (VI) is explained. In formula (VI), although X and R are displayed in a cis form, a trans form for X and R is also included in formula (Vi). This is also similar to the structure display of specific compounds.

In formula (VI), X represents an electron-attracting group, and W represents one selected from a hydrogen atom, an alkyl group, an alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, a nitro group, an imino group, a N-carbonylimino group, a N-sulfonylimino group, a dicyanoethylene group, an ammonium group, a sulfonium group, a phosphonium group, a pyrylium group, or an immonium group.

R represents one selected from a halogen atom, a hydroxy group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, an organic or inorganic salt of hydroxy group or mercapto group (e.g., a sodium salt, a potassium salt, a silver salt, or the like), an amino group, an alkylamino group, a cyclic amino group (e.g., a pyrrolidino group), an acylamino group, an oxycarbonylamino group, a heterocyclic group (a 5 or 6-membered nitrogen-containing heterocycle, e.g., a benztriazolyl group, an imidazolyl group, a triazolyl group, a tetrazolyl group, or the like), a ureido group, or a sulfonamide group. X and W, and X and R may bind to each other to form a cyclic structure. As the ring formed by X and W, for example, pyrazolone, pyrazolidinone, cyclopentanedione, β-ketolactone, β-ketolactam, and the like are described.

Explaining formula (VI) further, the electron-attracting group represented by X is a substituent which can have a positive value of substituent constant σp. Specifically, a substituted alkyl group (halogen substituted alkyl and the like), a substituted alkenyl group (cyanovinyl and the like), a substituted or unsubstituted alkynyl group (trifluoromethylacetylenyl, cyanoacetylenyl and the like), a substituted aryl group (cyanophenyl and the like), a substituted or unsubstituted heterocyclic group (pyridyl, triazinyl, benzooxazolyl and the like), a halogen atom, a cyano group, an acyl group (acetyl, trifluoroacetyl, formyl and the like), a thioacetyl group (thioacetyl, thioformyl and the like), an oxalyl group (methyloxalyl and the like), an oxyoxalyl group (ethoxalyl and the like), a thiooxalyl group (ethylthiooxalyl and the like), an oxamoyl group (methyloxamoyl and the like), an oxycarbonyl group (ethoxycarbonyl and the like), a carboxyl group, a thiocarbonyl group (ethylthiocarbonyl and the like), a carbamoyl group, a thiocarbamoyl group, a sulfonyl group, a sulfinyl group, an oxysulfonyl group (ethoxysulfonyl and the like), a thiosulfonyl group (ethylthiosulfonyl and the like), a sulfamoyl group, an oxysulfinyl group (methoxysulfinyl and the like), a thiosulfinyl group (methylthiosulfinyl and the like), a sulfinamoyl group, a phosphoryl group, a nitro group, an imino group, a N-carbonylimino group (N-acetylimino and the like), a N-sulfonylimino group (N-methanesulfonylimino and the like), a dicyanoethylene group, an ammonium group, a sulfonium group, a phosphonium group, a pyrylium group, an immonium group and the like are described, and a heterocyclic one formed by an ammonium group, a sulfonium group, a phosphonium group, an immonium group or the like is also included. The substituent having σp value of 0.30 or more is particularly preferable.

As an alkyl group represented by W, methyl, ethyl, trifluoromethyl and the like are described. As an alkenyl group as W, vinyl, halogen-substituted vinyl, cyanovinyl and the like are described. As an alkynyl group as W, acetylenyl, cyanoacetylenyl and the like are described. As an aryl group as W, nitrophenyl, cyanophenyl, pentafluorophenyl and the like are described, and as a heterocyclic group as W, pyridyl, pyrimidyl, triazinyl, succinimide, tetrazolyl, triazolyl, imidazolyl, benzooxazolyl and the like are described. As W, the electron-attracting group having a positive σp value is preferable, and that value is more preferably 0.30 or more.

Among the substituents of R described above, a hydroxy group, a mercapto group, an alkoxy group, an alkylthio group, a halogen atom, an organic or inorganic salt of hydroxy group or mercapto group, and a heterocyclic group are preferably described. More preferably, a hydroxy group, an alkoxy group, an organic or inorganic salt of hydroxy group or mercapto group and a heterocyclic group are described, and particularly preferably, a hydroxy group and an organic or inorganic salt of hydroxy group or mercapto group are described.

And among the substituents of X and W described above, the group having a thioether bond in the substituent is preferable.

As specific examples of the compound represented by formula (VI), compound 1-1 to 92-7 of chemical formula Nos. 27 to 50 described in JP-A No. 2002-131864 are described, however specific examples are not limited in these.

In formula (P), Q represents a nitrogen atom or a phosphorus atom. $R_1$, $R_2$, $R_3$, and $R_4$ each independently represent a hydrogen atom or a substituent, and $X^-$ represents an anion. In addition, $R_1$ to $R_4$ may bind to each other to form a cyclic structure.

As the substituent represented by $R_1$ to $R_4$, an alkyl group (a methyl group, an ethyl group, a propyl group, a butyl group, a hexyl group, a cyclohexyl group and the like), an alkenyl group (an allyl group, a butenyl group and the like), an alkynyl group (a propargyl group, a butynyl group and the like), an aryl group (a phenyl group, a naphthyl group and the like), a heterocyclic group (a piperidinyl group, a piperazinyl group, a morpholinyl group, a pyridyl group, a furyl group, a thienyl group, a tetrahydrofuryl group, a tetrahydrothienyl group, a sulforanyl group and the like), an amino group, and the like are described.

As the ring formed by linking $R_1$ to $R_4$ each other, a piperidine ring, a morpholine ring, a piperazine ring, a quinuclidine ring, a pyridine ring, a pyrrole ring, an imidazole ring, a triazole ring, a tetrazole ring, and the like are described.

The group represented by $R_1$ to $R_4$ may have a substituent such as a hydroxy group, an alkoxy group, an aryloxy group, a carboxyl group, a sulfo group, an alkyl group, an aryl group, and the like. As $R_1$, $R_2$, $R_3$, and $R_4$, a hydrogen atom and an alkyl group are preferable.

As the anion represented by $X^-$, an organic or inorganic anion such as a halogen ion, a sulfate ion, a nitrate ion, an acetate ion, a p-toluenesulfonate ion, and the like are described.

As a structure of formula (P), the structure described in paragraph Nos. 0153 to 0163 in JP-A No. 2002-131864 is still more preferable.

As the specific compounds of formula (P), P-1 to P-52 and T-1 to T-18 of chemical formula Nos. 53 to 62 in JP-A No. 2002-131864 can be described, however the specific compound is not limited in these.

The quaternary onium compound described above can be synthesized by referring to known methods. For example, the tetrazolium compound described above can be synthesized by referring to the method described in Chemical Reviews, vol. 55, pages 335 to 483.

Next, the compounds represented by formulae (A) or (B) are explained in detail. In formula (A), $Z_1$ represents a nonmetallic atomic group capable to form a 5 to 7-membered cyclic structure with —Y—C(═CH—X)—C (═O)—. $Z_1$ is preferably an atomic group selected from a carbon atom, an oxygen atom, a sulfur atom, a nitrogen atom, or a hydrogen atom, and several atoms selected from these are bound each other by single bond or double bond to form a 5 to 7-membered cyclic structure with —Y, —C(═CH—$X_1$)—C(═O)—. $Z_1$ may have a substituent, and $Z_1$ itself may be an aromatic or a non-aromatic carbon ring, or $Z_1$ may be a part of an aromatic or a non-aromatic heterocycle, and in this case, a 5 to 7-membered cyclic structure formed by $Z_1$ with —$Y_1$—C(═CH—$X_1$)—C(═O)— forms a condensed cyclic structure.

In formula (B), $Z_2$ represents a nonmetallic atomic group capable to form a 5 to 7-membered cyclic structure with —$Y_2$—C(═CH—$X_2$)—C($Y_3$)═N—. $Z_2$ is preferably an atomic group selected from a carbon atom, an oxygen atom, a sulfur atom, a nitrogen atom, or a hydrogen atom, and several atoms selected from these are linked each other by single bond or double bond to form a 5 to 7-membered cyclic structure with —$Y_2$—C(═CH—$X_2$)—C($Y_3$)═N—. $Z_2$ may have a substituent, and $Z_2$ itself may be an aromatic or a non-aromatic carbon ring, or $Z_2$ may be a part of an aromatic or a non-aromatic heterocycle and in this case, a 5 to 7-membered cyclic structure formed by $Z_2$ with —$Y_2$—C(═CH—$X_2$)—C($Y_3$)═N— forms a condensed cyclic structure.

In the case where $Z_1$ and $Z_2$ have a substituent, examples of substituent are selected from the compounds listed below. Namely, as typical substituent, for example, a halogen atom (fluorine atom, chlorine atom, bromine atom or iodine atom), an alkyl group (includes an aralkyl group, a cycloalkyl group and an active methine group), an alkenyl group, an alkynyl group, an aryl group, a heterocyclic group, a heterocyclic group containing a quaternary nitrogen (e.g., a pyridinio group), an acyl group, an alkoxycarbonyl group, an aryloxycarbonyl group, a carbamoyl group, a carboxyl group or a salt thereof, a sulfonylcarbamoyl group, an acylcarbamoyl groyp, a sulfamoylcarbamoyl group, a carbazoyl group, an oxalyl group, an oxamoyl group, a cyano group, a thiocarbamoyl group, a hydroxy group, an alkoxy group (including the group in which ethylene oxy group units or propylene oxy group units are repeated), an aryloxy group, a heterocyclic oxy group, an acyloxy group, an alkoxy carbonyloxy group, an aryloxy carbonyloxy group, a carbamoyloxy group, a sulfonyloxy group, an amino group, an alkylamino group, an arylamino group, a heterocyclic amino group, a N-substituted nitrogen-containing heterocyclic group, an acylamino group, a sulfonamide group, a ureido group, a thioureido group, an imide group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, a sulfo group or a salt thereof, a sulfamoyl group, an acylsulfamoyl group, a sulfonylsulfamoyl group or a salt thereof, a group containing phosphoric amide or phosphoric ester structure, a silyl group, a stannyl group, and the like are described. These substituents may be further substituted by these substituents.

Next, $Y_3$ is explained. In formula (B), $Y_3$ represents a hydrogen atom or a substituent, and when $Y_3$ represents a substituent, following group is specifically described as that substituent. Namely, an alkyl group, an aryl group, a heterocyclic group, a cyano group, an acyl group, an alkoxycarbonyl group, an aryloxycarbonyl group, a carbamoyl group, an amino group, an alkylamino group, an arylamino group, a heterocyclic amino group, an acylamino group, a sulfonamide group, a ureido group, a thioureido group, an imide group, an alkoxy group, an aryloxy group, an alkylthio group, an arylthio group, a heterocyclic thio group, and the like are described. These substituents may be substituted by any substituents, and specifically, examples of the substituents which $Z_1$ or $Z_2$ may have, are described.

In formulae (A) and (B), $X_1$ and $X_2$ each independently represent one selected from a hydroxy group (or a salt thereof), an alkoxy group (e.g., a methoxy group, an ethoxy group, a propoxy group, an isopropoxy group, an octyloxy group, a dodecyloxy group, a cetyloxy group, a t-butoxy group, or the like), an aryloxy group (e.g., a phenoxy group, a p-t-pentylphenoxy group, a p-t-octylphenoxy group, or the like), a heterocyclic oxy group (e.g., a benzotriazolyl-5-oxy group, a pyridinyl-3-oxy group, or the like), a mercapto group (or a salt thereof), an alkylthio group (e.g., methylthio group, an ethlythio group, a butylthio group, a dodecylthio group, or the like), an arylthio group (e.g., a phenylthio group, a p-dodecylphenylthio group, or the like), a heterocyclic thio group (e.g., a 1-phenyltetrazoyl-5-thio group, a 2-methyl-1-phenyltriazolyl-5-thio group, a mercaptothiadiazolylthio group, or the like), an amino group, an alkylamino group (e.g., a methylamino group, a propylamino group, an octylamino group, a dimethylamino group, or the like), an arylamino group (e.g., an anilino group, a naphthylamino group, an o-methoxyanilino group, or the like), a heterocyclic amino group (e.g., a pyridylamino group, a benzotriazole-5-ylamino group, or the like), an acylamino group (e.g., an acetamide group, an octanoylamino group, a benzoylamino group, or the like), a sulfonamide group (e.g., a methanesulfonamide group, a benzenesulfonamide group a dodecylsulfonamide group, or the like), or a heterocyclic group.

Herein, a heterocyclic group is an aromatic or non-aromatic, a saturated or unsaturated, a single ring or condensed ring, or a substituted or unsubstituted heterocyclic group. For example, a N-methylhydantoyl group, a N-phenylhydantoyl group, a succinimide group, a phthalimide group, a N,N'-dimethylurazolyl group, an imidazolyl group, a benzotriazolyl group, an indazolyl group, a morpholino group, a 4,4-dimethyl-2,5-dioxo-oxazolyl group, and the like are described.

And herein, a salt represents a salt of an alkali metal (sodium, potassium, or lithium), a salt of an alkali earth metal (magnesium or calcium), a silver salt, a quaternary ammonium salt (a tetraethylammonium salt, a dimethylcetylbenzylammonium salt, or the like), a quaternary phosphonium salt, or the like. In formulae (A) and (B), $Y_1$ and $Y_2$ represent —C(═O)— or —$SO_2$—.

The preferable range of the compounds represented by formulae (A) or (B) is described in JP-A No. 11-231459, paragraph Nos. 0027 to 0043. As specific examples of the compound represented by formulae (A) or (B), compound 1 to 110 of Table 1 to Table 8 in JP-A No. 11-231459 are described, however the invention is not limited in these.

Next, the compound represented by formula (C) is explained in detail. In formula (C), $X_3$ represents one selected from an oxygen atom, a sulfur atom, or a nitrogen atom. In the case where $X_3$ is a nitrogen atom, the bond of $X_3$ and $Z_3$ may be either a single bond or a double bond, and in the case of a single bond, a nitrogen atom may have a hydrogen atom or any substituent. As this substituent, for example, an alkyl group (includes an aralkyl group, a cycloalkyl group, an active methine group, and the like), an alkenyl group, an alkynyl group, an aryl group, a heterocyclic group, an acyl group, an alkoxycarbonyl group, an aryloxycarbonyl group, a carbamoyl group, an alkylsulfonyl group, an arylsulfonyl group, a heterocyclic sulfonyl group, and the like are described.

$Y_4$ represents the group represented by one selected from —C(=O)—, —C(=S)—, —SO—, —$SO_2$—, —C(=$NR_3$)—, or —($R_4$)C=N—. $Z_3$ represents a nonmetallic atomic group capable to form a 5 to 7-membered ring containing $X_3$ and $Y_4$. The atomic group to form that ring is an atomic group which consists of 2 to 4 atoms that are other than metal atoms, and these atoms may be combined by single bond or double bond, and these may have a hydrogen atom or any subsituent (e.g., an alkyl group, an aryl group, a heterocyclic group, an alkoxy group, an alkylthio group, an acyl group, an amino group, or an alkenyl group). When $Z_3$ forms a 5 to 7-membered ring containing $X_3$ and $Y_4$, the ring is a saturated or unsaturated heterocycle, and may be a single ring or may have a condensed ring. When $Y_4$ is the group represented by C(=$NR_3$), ($R_4$)C=N, the condensed ring of this case may be formed by binding $R_3$ or $R_4$ with the substituent of $Z_3$.

In formula (C), $R_1$, $R_2$, $R_3$, and $R_4$ each independently represent a hydrogen atom or a substituent. However, $R_1$ and $R_2$ never bind to each other to form a cyclic structure.

When $R_1$ and $R_2$ represent a monovalent substituent, the following groups are described as a monovalent substituent.

For example, a halogen atom (fluorine atom, chlorine atom, bromine atom, or iodine atom), an alkyl group (including an aralkyl group, a cycloalkyl group, an active methine group, and the like), an alkenyl group, an alkynyl group, an aryl group, a heterocyclic group, a heterocyclic group containing a quaternary nitrogen atom (e.g., a pyridinio group), an acyl group, an alkoxycarbonyl group, an aryloxycarbonyl group, a carbamoyl group, a carboxyl group and a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group and a salt thereof, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, an heterocyclic amino group, a N-substituted nitrogen-containing heterocyclic group, an acylamino group, a sulfonamide group, a ureido group, a thioureido group, an imide group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group and a salt thereof, an alkylthio group, an arylthio group, an heterocyclic thio group, an alkylsulfonyl group, an arylsulfonyl group, an alkylsulfinyl group, an arylsulfinyl group, a sulfo group and a salt thereof, a sulfamoyl group, an acylsulfamoyl group, a sulfonylsulfamoyl group and a salt thereof, a phosphoryl group, a group containing phosphoric amide or phosphoric ester structure, a silyl group, a stannyl group, and the like are described. These substituents may be further substituted by these monovalent substituents.

When $R_3$ and $R_4$ represent a substituent, the same substituent as what $R_1$ and $R_2$ may have except the halogen atom can be described as the substituent. Furthermore, $R_3$ and $R_4$ may further link to $Z_3$ to form a condensed ring.

Next, among the compounds represented by formula (C), preferable compounds are described. In formula (C), $Z_3$ is preferably an atomic group which forms a 5 to 7-membered ring with $X_3$ and $Y_4$, and consists of the atoms selected from 2 to 4 carbon atoms, a nitrogen atom, a sulfur atom, or an oxygen atom. A heterocycle, which is formed by $Z_3$ with $X_3$ and $Y_4$, preferably contains 3 to 40 carbon atoms in total, more preferably 3 to 25 carbon atoms in total, and most preferably 3 to 20 carbon atoms in total. $Z_3$ preferably comprises at least one carbon atom.

In formula (C), $Y_4$ is preferably —C(=O)—, —C(=S)—, —$SO_2$—, or —($R_4$)C=N—, particularly preferably, —C(=O)—, —C(=S)—, or —$SO_2$—, and most preferably, —C(=O)—.

In formula (C), in the case where $R_1$ and $R_2$ represent a monovalent substituent, the monovalent substituent represented by $R_1$ and $R_2$ is preferably one of the following groups having 0 to 25 carbon atoms in total, namely, those are an alkyl group, an aryl group, a heterocyclic group, an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an imide group, an acylamino group, a hydroxy group and a salt thereof, a mercapto group and a salt thereof, and an electron-attracting group. Herein, an electron-attracting group means the substituent capable to have a positive value of Hammett substituent constant σp, and specifically a cyano group, a sulfamoyl group, an alkylsulfonyl group, an arylsulfonyl group, a sulfonamide group, an imino group, a nitro group, a halogen atom, an acyl group, a formyl group, a phosphoryl group, a carboxyl group (or a salt thereof), a sulfo group (or a salt thereof), a saturated or unsaturated heterocyclic group, an alkenyl group, an alkynyl group, an acyloxy group, an acylthio group, a sulfonyloxy group, and an aryl group substituted by these electron-attracting group are described. These substituents may have any substituents.

In formula (C), when $R_1$ and $R_2$ represent a monovalent substituent, more preferable are an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an imide group, an acylamino group, a sulfonamide group, a heterocyclic group, a hydroxy group or a salt thereof, a mercapto group or a salt thereof, and the like. In formula (C), $R_1$ and $R_2$ particularly preferably are a hydrogen atom, an alkoxy group, an aryloxy group, an alkylthio group, an arylthio group, a heterocyclic group, a hydroxy group or a salt thereof, a mercapto group or a salt thereof, or the like. In formula (C), most preferably, one of $R_1$ and $R_2$ is a hydrogen atom and another is an alkoxy group, an aryloxy group, an alkylthio group, an arylthio group, a heterocyclic group, a hydroxy group or a salt thereof, or a mercapto group or a salt thereof.

In formula (C), when $R_3$ represents a substituent, $R_3$ is preferably an alkyl group having 1 to 25 carbon atoms in total (including an aralkyl group, a cycloalkyl group, an active methine group and the like), an alkenyl group, aryl group, a heterocyclic group, a heterocyclic group containing a quaternary nitrogen (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, an amino group, or the like. An alkyl group and an aryl group are particularly preferable.

In formula (C), when $R_4$ represents a substituent, $R_4$ is preferably an alkyl group (including an aralkyl group, a cycloalkyl group, an active methine group, and the like) having 1 to 25 carbon atoms in total, an aryl group, a heterocyclic group, a heterocyclic group containing a quaternary nitrogen atom (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, or the like. Particularly preferably, an alkyl group, an aryl group, an alkoxy group, an aryloxy group, a heterocyclic oxy group, an alkylthio group, an arylthio group, a heterocyclic thio group, and the like are described.

Specific compounds represented by formula (C) are represented by A-1 to A-230 of chemical formula Nos. 6 to 18 described in JP-A No. 11-133546, however the invention is not limited in these.

The addition amount of the above nucleator is in a range of from $10^{-5}$ mol to 1 mol per 1 mol of organic silver salt, and preferably, in a range of from $10^{-4}$ mol to $5\times10^{-1}$ mol.

The nucleator described above may be incorporated into a photothermographic material by being added into the coating solution, such as in the form of a solution, an emulsion dispersion, a solid fine particle dispersion, or the like.

As well known emulsion dispersing method, there can be mentioned a method comprising dissolving the nucleator in an oil such as dibutylphthalate, tricresylphosphate, dioctylsebacate, tri(2-ethylhexyl)phosphate, or the like, using an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsion dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there can be mentioned a method comprising dispersing the powder of the nucleator in a proper solvent such as water or the like, by means of ball mill, colloid mill, vibrating ball mill, sand mill, jet mill, roller mill, or ultrasonics, thereby obtaining solid dispersion. In this case, there can also be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in the water dispersion.

The nucleator is particularly preferably used as solid particle dispersion, and is added in the form of fine particles having average particle size of from 0.01 μm to 10 μm, preferably from 0.05 μm to 5 μm and, more preferably from 0.1 μm to 2 μm. In the invention, other solid dispersions are preferably used with this particle size range.

In the photothermographic material which is subjected to a rapid development where time period for development is 20 seconds or less, the compound represented by formulae (V) or (P) is used preferably, and the compound represented by formula (V) is used particularly preferably, among the nucleators described above.

In the photothermographic material where low fog is required, the compound represented by formula (VI) is used preferably, the compound represented by formulae (A), (B), or (C) is used more preferably, and the compound represented by formulae (A) or (B) is particularly preferably used. Moreover, in the photothermographic materials having a few change of photographic property against environmental conditions when used on various environmental conditions (temperature and humidity), the compound represented by formula (C) is preferably used.

Although preferred specific compounds among the above-mentioned nucleators are shown below, the invention is not limited in these.

SH-1

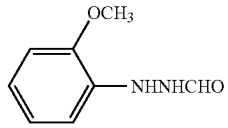

SH-2

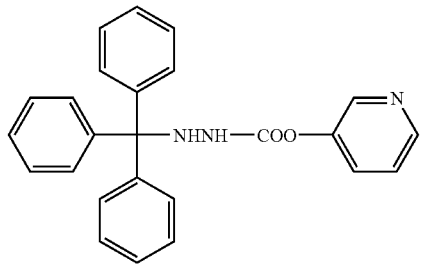

SH-3

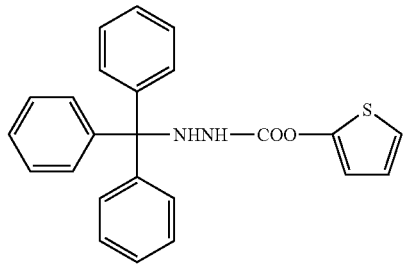

SH-4

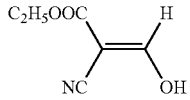

SH-5

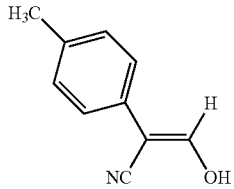

SH-6

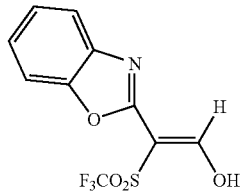

-continued

SH-7

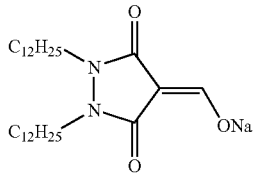

SH-8

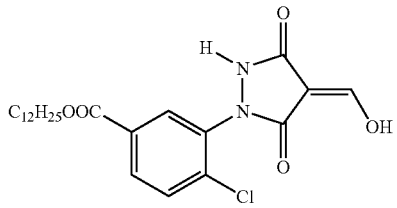

SH-9

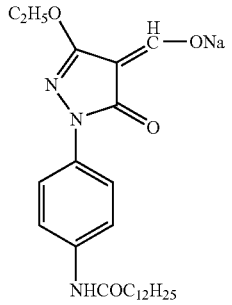

SH-10

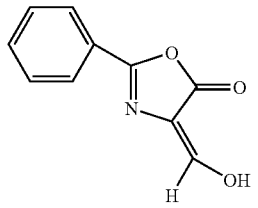

SH-11

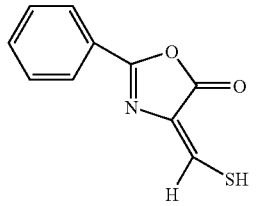

SH-12

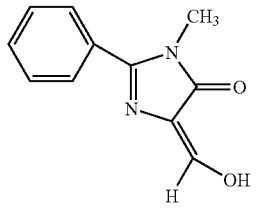

The nucleator of the present invention can be added to the image forming layer or the layer adjacent to the image forming layer, however, it is preferably added to the image forming layer. The addition amount of nucleator is in a range of from $10^{-5}$ mol to 1 mol per 1 mol of organic silver salt, and preferably, from $10^{-4}$ mol to $5\times10^{-1}$ mol. The nucleator may be added either only one kind or, two or more kinds in combination.

(Reducing Agent)

1) Infectious Development Reducing Agent

The photothermographic material according to the invention preferably contains an infectious development reducing agent. As the infectious development reducing agent used in the present invention, any reducing agent may be used as far as it has the ability of infectious development.

Preferable infectious development reducing agent which can be used in the present invention is the compound represented by the following formula (R1).

Formula (R1)

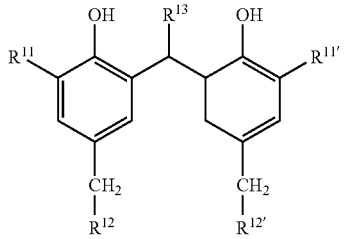

In formula (R1) described above, $R^{11}$ and $R^{11'}$ each independently represent a secondary or tertiary alkyl group having 3 to 20 carbon atoms. $R^{12}$ and $R^{12'}$ each independently represent a hydrogen atom or a group which links through a nitrogen, an oxygen, a phosphor, or a sulfur atom. $R^{13}$ represents a hydrogen atom or an alkyl group having 1 to 20 carbon atoms.

Formula (R1) described above is explained in detail. As $R^{11}$ and $R^{11'}$ described above, a secondary or tertiary alkyl group having 3 to 12 carbon atoms is preferable. Specifically, an isopropyl group, a tert-butyl group, a tert-amyl group, a 1,1-dimethylpropyl group, a 1,1-dimethylbutyl group, a 1,1-dimethylhexyl group, a 1,1-3,3-tetramethylbutyl group, a 1,1-dimethyldecyl group, a 1-methylcyclohexyl group, a tert-octyl group, a 1-methylcyclopropyl group and the like are preferable, and a tert-butyl group, a tert-amyl group, a tert-octyl group and a 1-methylcyclohexyl group are more preferable, and a tert-butyl group is most preferable.

In the case where $R^{12}$ and $R^{12'}$ are an aryloxy group, an arylthio grpoup, an anilino group, a heterocyclic group, or a heterocyclic thio group, each of which may have a substituent. As the said substituent, although any group may be possible as far as it is capable of substituting for a hydrogen atom on a benzene ring and a heterocycle, and, an alkyl group, an aryl group, a heterocyclic group, a halogen atom, an alkoxy group, a hydroxy group, an aryloxy group, an alkylthio group, an arylthio group, an amino group, an acyl group, an acyloxy group, an acylamino group, an alkoxycarbonyl group, a carbamoyl group, a sulfonyl group, a sulfonamide group, a sulfonyloxy group, a sulfamoyl group, a sulfoxido group, an ureido group or an urethane group or the like are described. In the case where $R^{12}$ and $R^{12'}$ are an alkoxy group, a carbonyloxy group, an acyloxy group, an alkylthio group, an amino group, an acylamino group, an ureido group or an urethane group, these groups may further have a substituent and as examples of the said substituent, an alkoxy group, an alkoxycarbonyl group, an acyloxy group, an sulfonyl group, a carbonyl group, an alkylthio group, an aryloxy group, an arylthio group, a sulfonamide group, an acylamino group, and the like are described. As $R^{12}$ and $R^{12'}$ described above, a hydrogen atom, a hydroxy group, an amino group, and an anilino group are more preferable, and further, a hydrogen atom, a methoxy group, and a benzyloxy group are most preferable.

As $R^{13}$ described above, a hydrogen atom and an alkyl group having 1 to 15 carbon atoms are preferable, and an alkyl group having 1 to 8 carbon atoms is more preferable. As the said alkyl group, a methyl group, an ethyl group, a propyl group, an isopropyl group, and a 2,4,4-trimethylpenthyl group are preferable. As $R^{13}$ described above, a hydrogen atom, a methyl group, an ethyl group, a propyl group, and an isopropyl group are particularly preferable.

Typical examples of the reducing agent represented by formula (R1) of the present invention are shown below, however the present invention is not limited in these.

R1-1

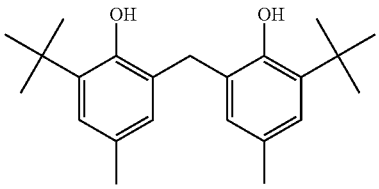

R1-2

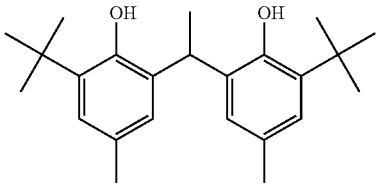

R1-3

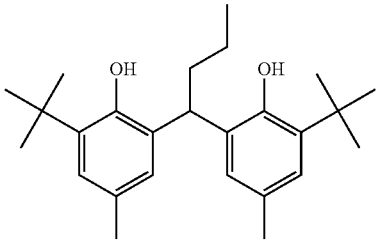

R1-4

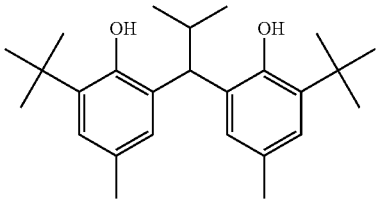

R1-5

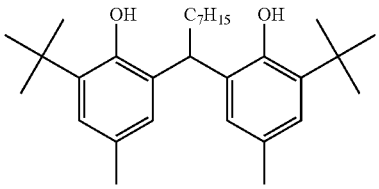

-continued

R1-6

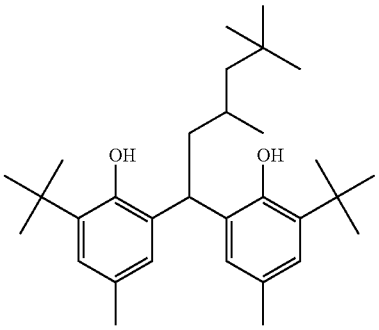

R1-7

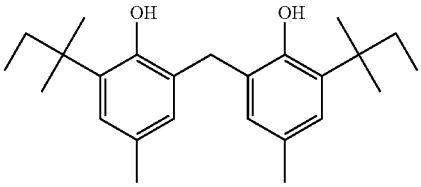

R1-8

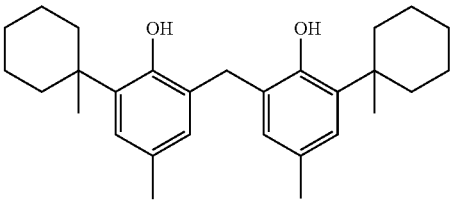

R1-9

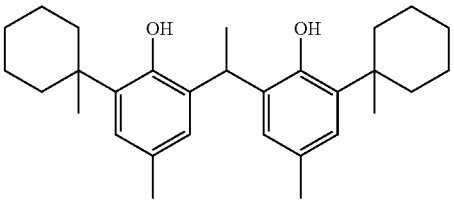

R1-10

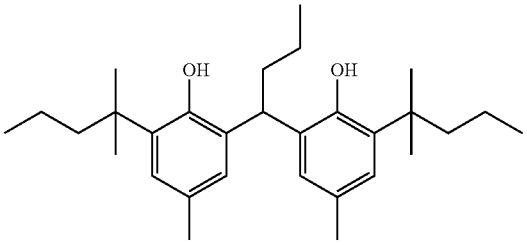

R1-11

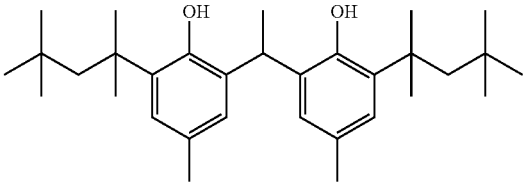

R1-12

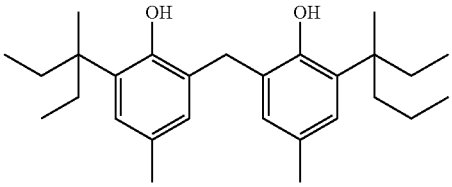

-continued
R1-13
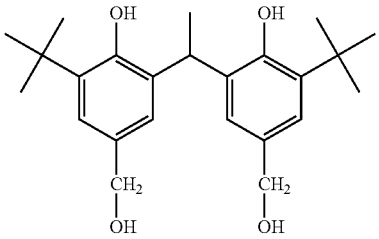
R1-14
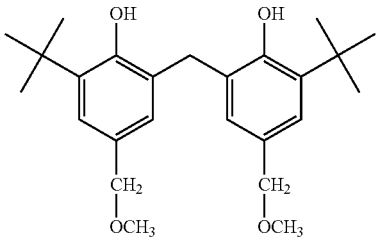
R1-15
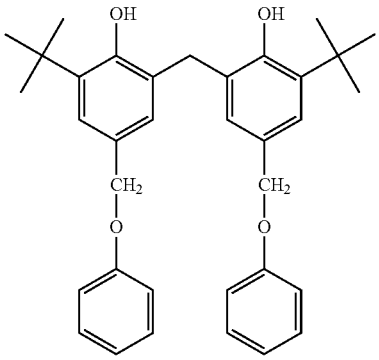
R1-16
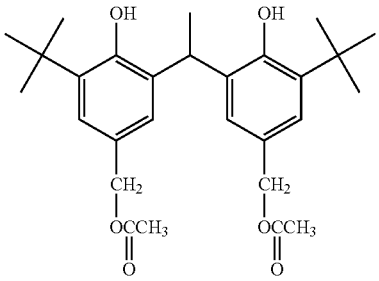
R1-17
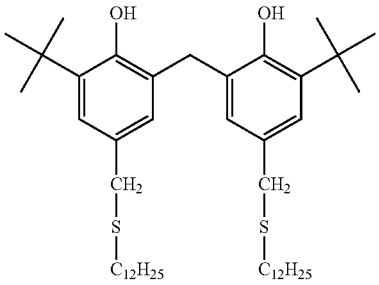
-continued
R1-18
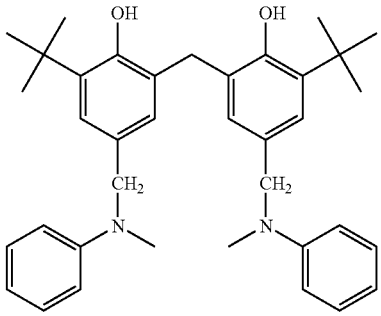
R1-19
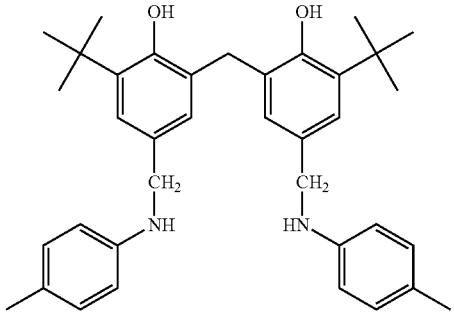
R1-20
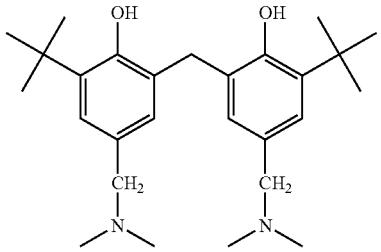
R1-21
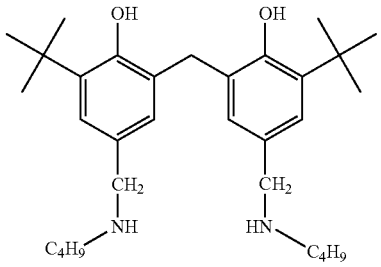
R1-22
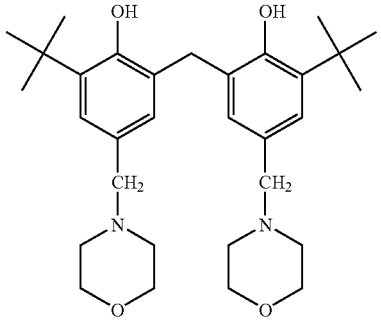

-continued
R1-23
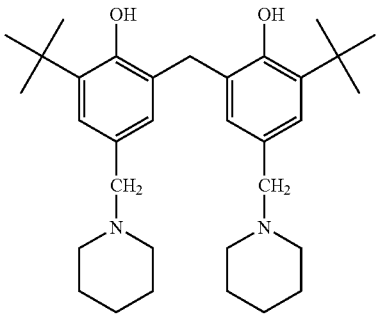
R1-24
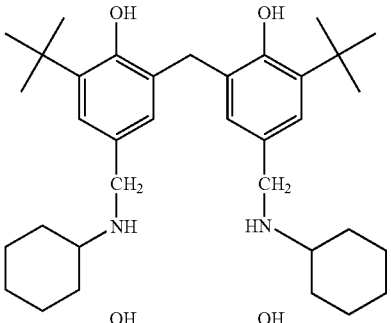
R1-25
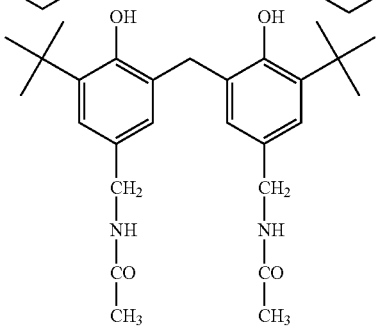
R1-26
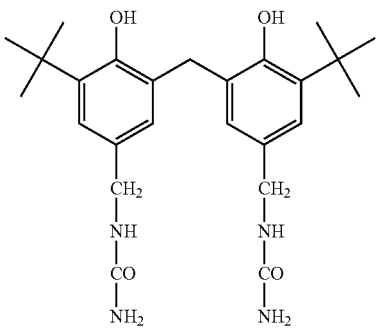
R1-27
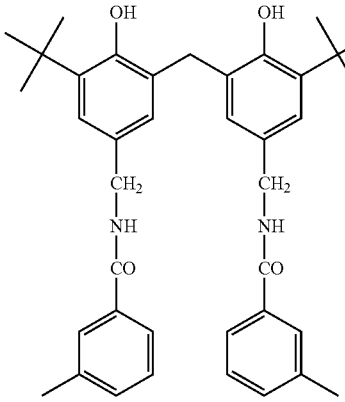
-continued
R1-28
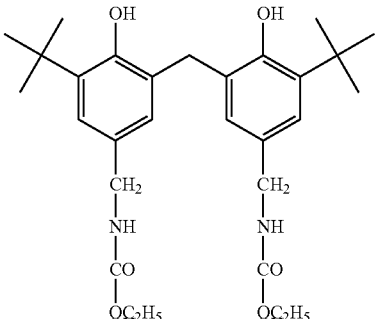
R1-29
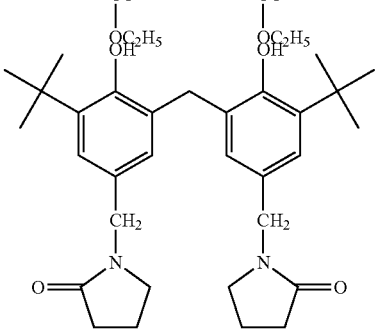
R1-30
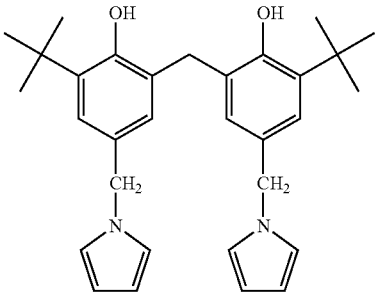
R1-31
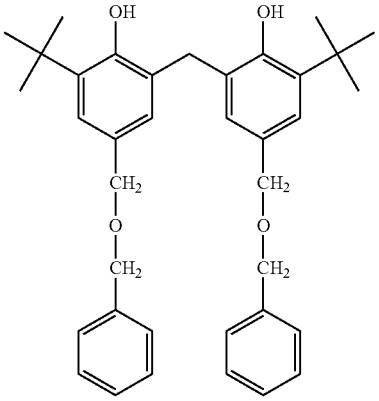
R1-32
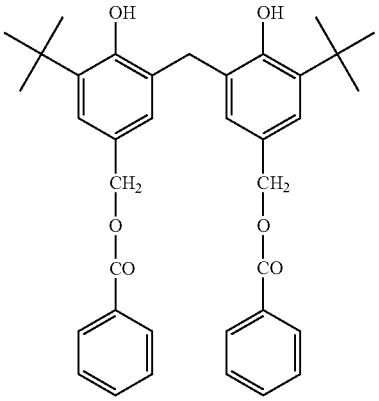

-continued

R1-33

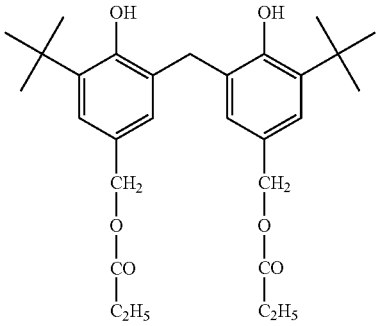

R1-34

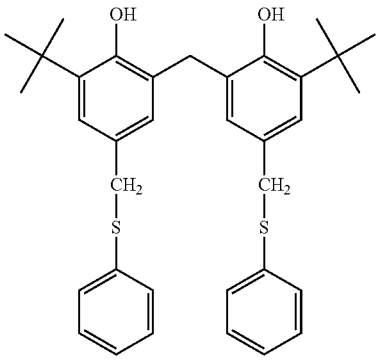

R1-35

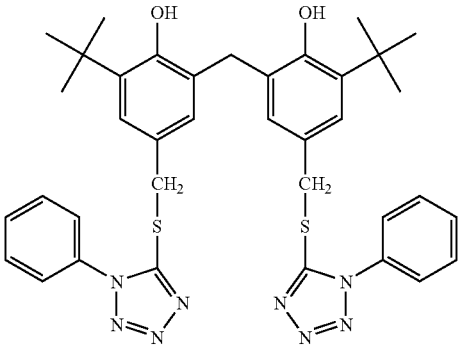

R1-36

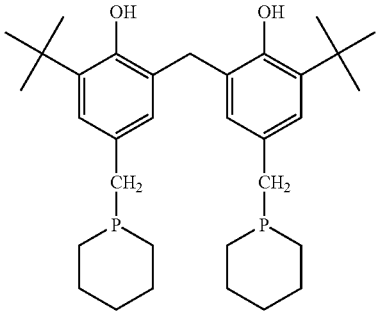

The addition amount of the reducing agent represented by the above-described formula (R1) is preferably from 0.01 g/m$^2$ to 5.0 g/m$^2$, and more preferably from 0.1 g/m$^2$ to 3.0 g/m$^2$. It is preferably contained in a range from 5 mol % to 50 mol % and, more preferably, 10 mol % to 40 mol %, per 1 mol of silver in the image forming layer.

The reducing agent represented by the above-described formula (R1) is preferably contained in the image forming layer. In particular, the reducing agent represented by the above-described formula (R1) is preferably contained in the image forming layer comprising a silver halide emulsion with low sensitivity.

2) Reducing Agent

In the invention, other reducing agents may be used in combination with the reducing agent represented by formula (R1). The reducing agent which can be used in combination may be any substance (preferably, organic substance) capable of reducing silver ions into metallic silver. Examples of the reducing agent are described in JP-A No. 11-65021 (column Nos. 0043 to 0045) and EP No. 0803764 (p. 7, line 34 to p. 18, line 12).

In the invention, the reducing agent, which can be used in combination, is preferably a so-called hindered phenolic reducing agent or a bisphenol agent having a substituent at the ortho-position to the phenolic hydroxy group.

It is more preferably a reducing agent represented by the following formula (R).

Formula (R)

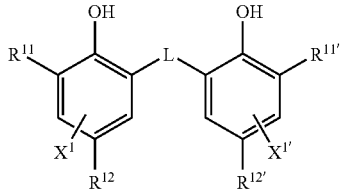

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be described in detail.

In the following description, when referred to as an alkyl group, it means that the alkyl group contains a cycloalkyl group, as far as it is not mentioned specifically.

(1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

(2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring. $X^1$ and $X^{1'}$ each independently represent a hydrogen atom or a group capable of substituting for a hydrogen atom on a benzene ring. As each of the groups capable of substituting for a hydrogen atom on the benzene ring, an alkyl group, an aryl group, a halogen atom, an alkoxy group, and an acylamino group are described preferably.

(3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group can include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

(4) Preferred Substituents $R^{11}$ and $R^{11'}$ are preferably a primary, secondary or tertiary alkyl group having 1 to 15 carbon atoms and can include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are further preferred and, a methyl group and a t-butyl group being most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group. And, a group which has a C═C bond in these alkyl group is also preferably used. Preferable examples of the alkyl group can include a methyl group, an ethyl group, a propyl group, an isopropyl group, a 2,4,4-trimethylpentyl group, a cyclohexyl group, a 2,4-dimethyl-3-cyclohexenyl group, a 3,5-dimetyl-3-cyclohexenyl group and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ is preferably a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are tertiary alkyl group and $R^{12}$ and $R^{12'}$ are an alkyl group other than a methyl group, $R^{13}$ is preferably a hydrogen atom.

In the case where $R^{11}$ and $R^{11'}$ are not a tertiary alkyl group, $R^{13}$ is preferably a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal development performances, color tones of developed silver images, or the like depending on the combination of $R^{11}$, $R^{11'}$, $R^{12}$, $R^{12'}$, and $R^{13}$. Since these performances can be controlled by using two or more kinds of reducing agents at various mixing ratios, it is preferred to use two or more kinds of reducing agents in combination depending on the purpose.

Specific examples of the reducing agents of the invention including the compounds represented by formula (R) according to the invention are shown below, but the invention is not restricted to these.

R-1

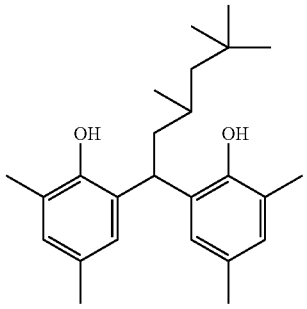

R-2

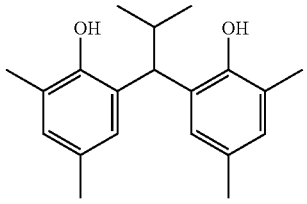

R-3

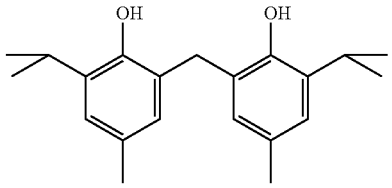

R-4

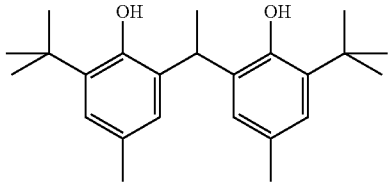

R-5

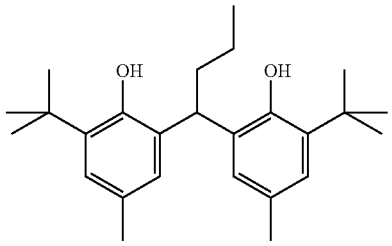

R-6

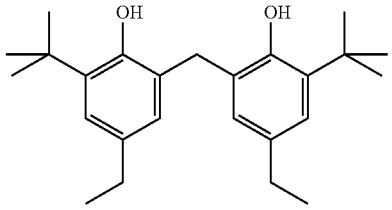

-continued

R-7

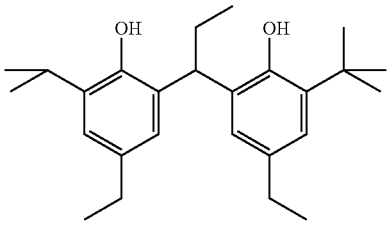

R-8

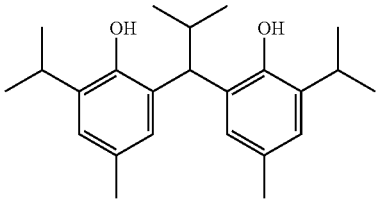

R-9

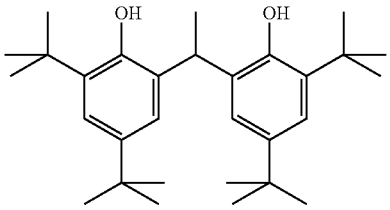

R-10

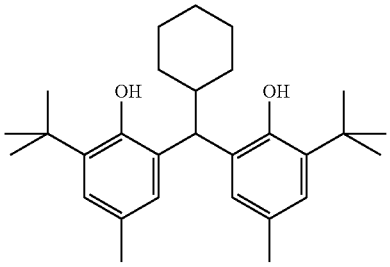

R-11

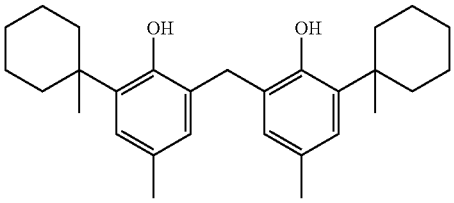

R-12

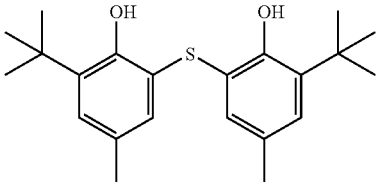

R-13

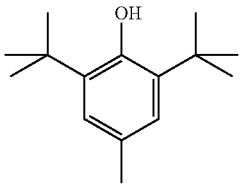

-continued

R-14

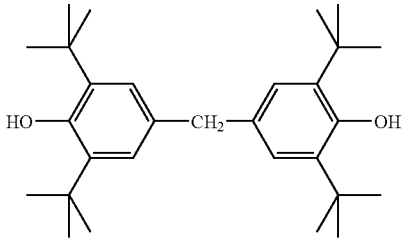

R-15

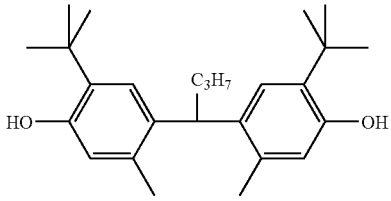

R-16

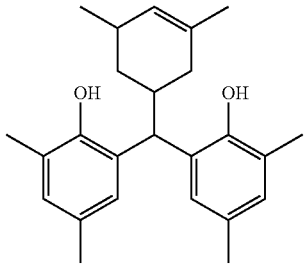

R-17

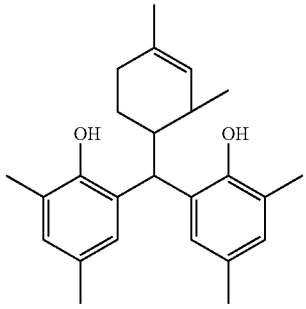

R-18

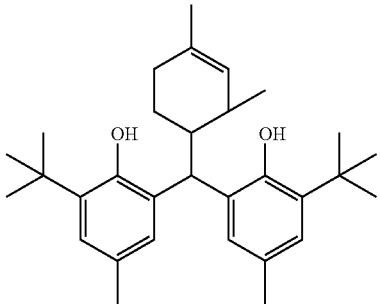

As preferred reducing agents of the invention other than those above, there can be mentioned compounds disclosed in JP-A Nos. 2001-188314, 2001-209145, 2001-350235, and 2002-156727, and EP No. 1278101A2.

The reducing agent is preferably contained in the image forming layer comprising a silver halide emulsion with high sensitivity.

In the case where plural reducing agents are used, the ratio of combination by mole is from 1/99 to 99/1, and preferably from 5/95 to 95/5.

3) Adding Method of Reducing Agent

In the invention, the reducing agent may be incorporated into a photothermographic material by being added into the coating solution, such as in the form of a solution, an emulsion dispersion, a solid fine particle dispersion, or the like. As well known emulsion dispersing method, there can be mentioned a method comprising dissolving the reducing agent in an oil such as dibutylphthalate, tricresylphosphate, dioctylsebacate, tri(2-ethylhexyl)phosphate, or the like, using an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsion dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there can be mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining solid dispersion. In this case, there can also be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in the water dispersion.

The reducing agent is particularly preferably used as solid particle dispersion, and is added in the form of fine particles having average particle size of from 0.01 μm to 10 μm, preferably from 0.05 μm to 5 μm and, more preferably from 0.1 μm to 2 μm. In the invention, other solid dispersions are preferably used with this particle size range.

(Phthalic Acid and Derivatives Thereof)

In the present invention, the photothermographic material preferably comprises the compound selected from phthalic acid or derivatives thereof, in combination with the silver iodide complex-forming agent. As phthalic acid and derivatives thereof used in the present invention, the compound represented by the following formula (PH) is preferable.

Formula (PH)

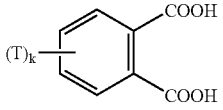

wherein T represents one selected from a halogen atom (fluorine, bromine, or iodine atom), an alkyl group, an aryl group, an alkoxy group, or a nitro group; k represents an integar of 0 to 4, and when k is 2 or more, plural ks may be the same or different from each other. k is preferably 0 to 2, and more preferably, 0 or 1.

The compound represented by formula (PH) may be used just as an acid or may be used as suitable salt from the viewpoint of easy addition to a coating solution and from the viewpoint of pH adjustment. As a salt, an alkaline metal salt, an ammonium salt, an alkaline earth metals salt, an amine salt, or the like can be used. An alkaline metal salt (Li, Na, K, or the like) and an ammonium salt are preferred.

Phthalic acid and the derivatives thereof used in the present invention are described below, however the present invention is not limited in these compounds.

(1)

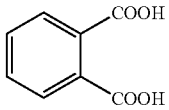

(2)

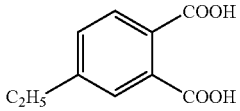

(3)

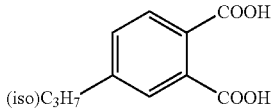

(4)

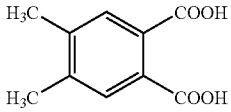

(5)

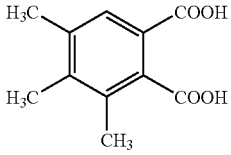

(6)

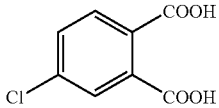

(7)

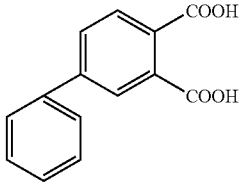

(8)

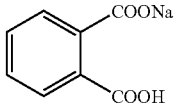

(9)

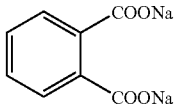

(10)

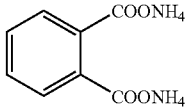

-continued (11)

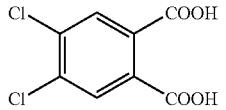

(12)

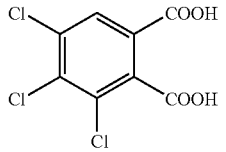

(13)

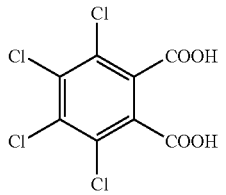

In the invention, the addition amount of phthalic acid or a derivative thereof is from $1.0\times10^{-4}$ mol to 1 mol, preferably from $1.0\times10^{-3}$ mol to 0.5 mol and, even more preferably from $2.0\times10^{-3}$ mol to 0.2 mol, per 1 mol of coated silver.

(Development Accelerator)

In the photothermographic material of the invention, sulfonamidophenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in a range from 0.1 mol % to 20 mol %, preferably, in a range from 0.5 mol % to 10 mol % and, more preferably, in a range from 1 mol % to 5 mol % with respect to the reducing agent. The introducing methods to the photothermographic material can include similar methods as those for the reducing agent and, it is particularly preferred to add as a solid dispersion or an emulsion dispersion. In the case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, among the development accelerators described above, it is particularly preferred to use hydrazine compounds represented by formula (1) described in JP-A No. 2002-278017, and phenolic or naphtholic compounds represented by formula (2) described in JP-A No. 2001-264929.

Preferred specific examples for the development accelerator of the invention are to be described below. The invention is not restricted to them.

A-1

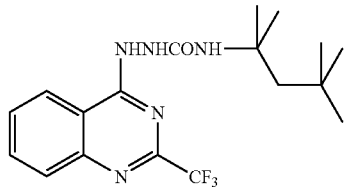

A-2

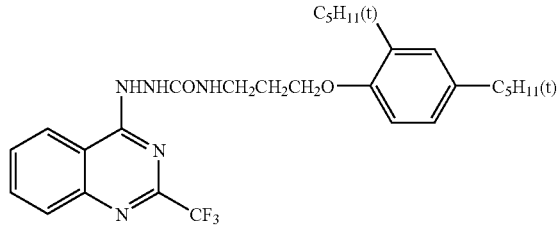

A-3

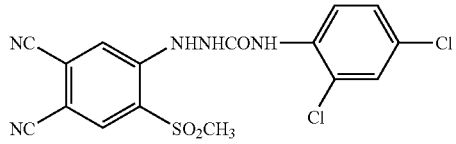

A-4

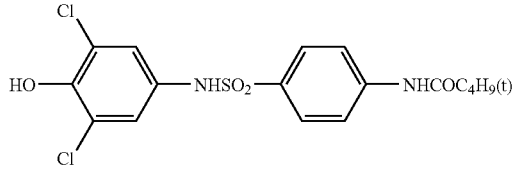

A-5

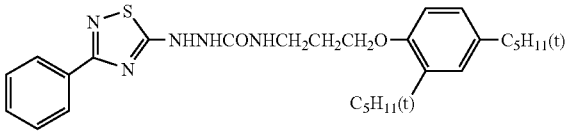

A-6

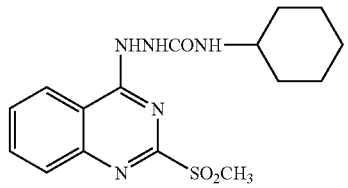

A-7

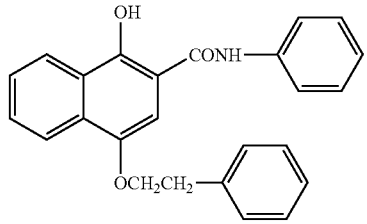

A-8

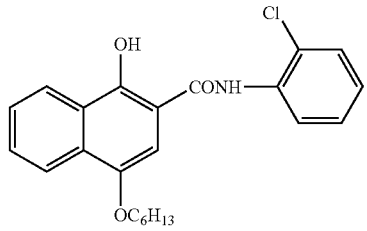

-continued

A-9

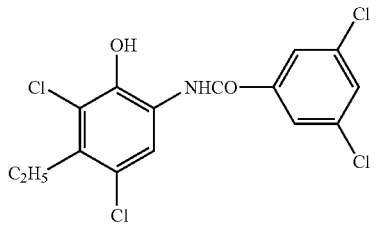

A-10

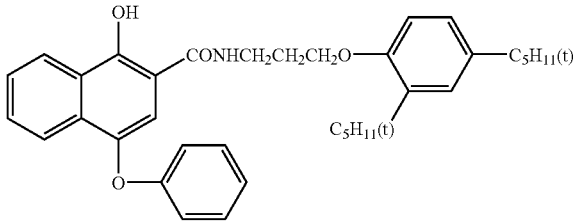

(Hydrogen Bonding Compound)

In the invention, in the case where the reducing agent has an aromatic hydroxy group (—OH) or an amino group, it is preferred to use in combination, a non-reducing compound having a group capable of reacting with these groups of the reducing agent, and that is also capable of forming a hydrogen bond therewith.

As a group capable of forming a hydrogen bond, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Preferred among them are a phosphoryl group, a sulfoxide group, an amide group (not having >N—H moiety but being blocked in the form of >N—Ra (where, Ra represents a substituent other than H)), a urethane group (not having >N—H moiety but being blocked in the form of >N—Ra (where, Ra represents a substituent other than H)), and a ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

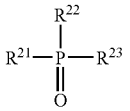

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ have a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

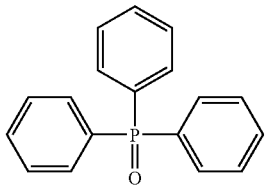

D-2

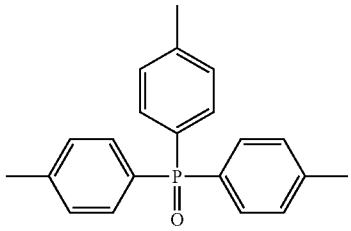

-continued
D-3
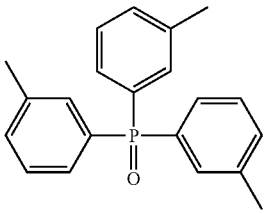
D-4
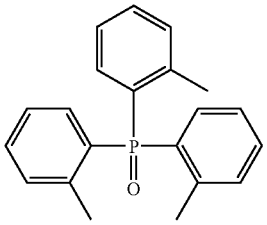
D-5
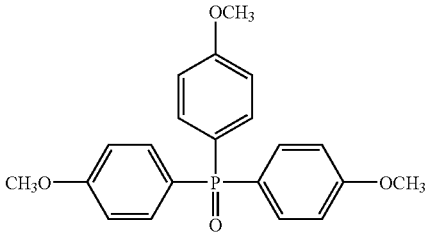
D-6
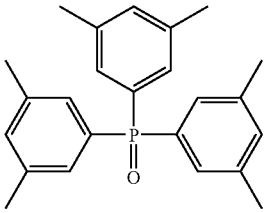
D-7
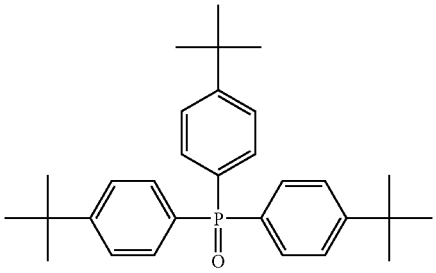
D-8
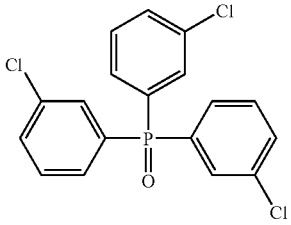
D-9
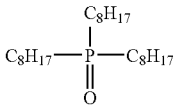
-continued
D-10
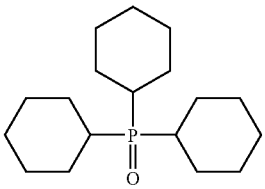
D-11
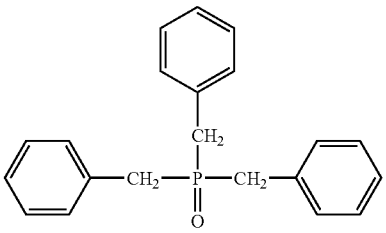
D-12
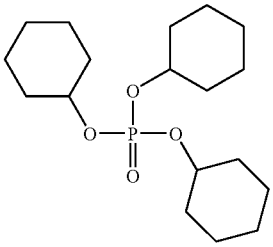
D-13
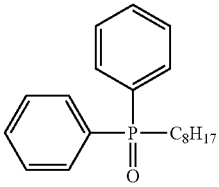
D-14
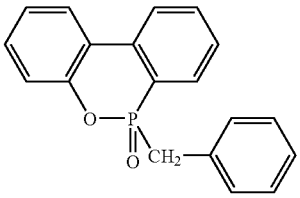
D-15
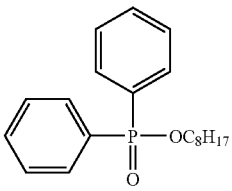
D-16
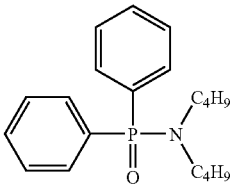

-continued

D-17

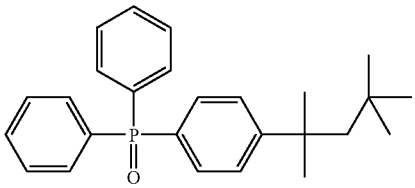

D-18

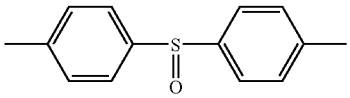

D-19

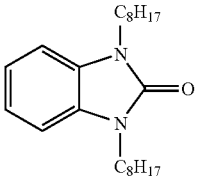

D-20

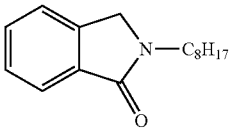

D-21

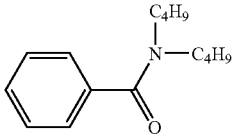

Specific examples of hydrogen bonding compounds other than those enumerated above can be found in those described in JP-A Nos. 2001-281793 and 2002-14438.

The hydrogen bonding compound of the invention can be used in the photothermographic material by being incorporated into a coating solution in the form of solution, emulsion dispersion, or solid fine particle dispersion, similar to the case of the reducing agent. In the solution, the hydrogen bonding compound of the invention forms a hydrogen-bonded complex with a compound having a phenolic hydroxy group, and can be isolated as a complex in crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the hydrogen bonding compound of the invention in the form of powders and dispersing them with a proper dispersing agent using a sand grinder mill or the like.

The hydrogen bonding compound of the invention is preferably used in a range of from 1 mol % to 200 mol %, more preferably from 10 mol % to 150 mol %, and further preferably, from 30 mol % to 100 mol %, with respect to the reducing agent.

(Binder)

Any kind of polymer may be used as the binder for the image forming layer of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly (vinyl acetal) (e.g., poly(vinyl formal) or poly(vinyl butyral)), polyester, polyurethane, phenoxy resin, poly(vinylidene chloride), polyepoxide, polycarbonate, poly(vinyl acetate), polyolefin, cellulose esters, and polyamide. A binder may be used with water, an organic solvent or emulsion to form a coating solution.

In the present invention, the glass transition temperature (Tg) of the binder of the image forming layer is preferably in a range of from 10° C. to 80° C., more preferably from 20° C. to 70° C. and, even more preferably from 23° C. to 65° C.

In the specification, Tg is calculated according to the following equation.

$$1/Tg=\Sigma(Xi/Tgi)$$

where the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n.

Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of one kind or two or more kinds of polymers, when necessary. And, the polymer having Tg of 20° C. or more and the polymer having Tg of less than 20° C. can be used in combination. In the case where two or more kinds of polymers differing in Tg may be blended for use, it is preferred that the weight-average Tg is in the range mentioned above.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be enhanced.

Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent.

As water-admixing organic solvents, there can be used, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term "equilibrium water content under 25° C. and 60% RH" as referred herein can be expressed as follows:

$$\text{Equilibrium water content under 25° C. and 60\% RH}=[(W1-W0)/W0]\times 100(\text{\% by weight})$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, from 0.01% by weight to 1.5% by weight, and is most preferably, from 0.02% by weight to 1% by weight.

The binders used in the invention are, particularly preferably, polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in the range of from 1 nm to 50,000 nm, and preferably from 5 nm to 1,000 nm. There is no particular limitation concerning particle size distribution of the dispersed particles, and they may be widely distributed or may exhibit a monodisperse particle size distribution.

In the invention, preferred embodiment of the polymers capable of being dispersed in aqueous solvent includes hydrophobic polymers such as acrylic polymers, poly(ester), rubber (e.g., SBR resin), polyurethane, poly(vinyl chloride), poly(vinyl acetate), poly(vinylidene chloride), polyolefin, and the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer.

The molecular weight of these polymers is, in number average molecular weight, in the range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor.

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

P-17; Latex of -St(61.3)-Isoprene(35.5)-AA(3)-(crosslinking, Tg 17° C.)

P-18; Latex of -St(67)-Isoprene(28)-Bu(2)-AA(3)-(crosslinking, Tg 27° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more kinds depending on needs.

Particularly preferable as the polymer latex for use in the invention are that of styrene-butadiene copolymer and that of styrene-isoprene copolymer. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer.

Further, the polymer latex of the invention preferably contains acrylic acid or methacrylic acid in a range of from 1% by weight to 6% by weight with respect to the sum of styrene and butadiene, and more preferably from 2% by weight to 5% by weight. The polymer latex of the invention preferably contains acrylic acid. Preferable range of monomer content is similar to that described above. Further, the ratio of copolymerization and the like in the styrene-isoprene copolymer are similar to those in the styrene-butadiene copolymer.

As the latex of styrene-butadiene copolymer preferably used in the invention, there can be mentioned P-3 to P-9 and P-15 described above, and commercially available LACSTAR-3307B, 7132C, Nipol Lx416, and the like. And as examples of the latex of styrene-isoprene copolymer, there can be mentioned P-17 and P-18 described above.

In the image forming layer of the photothermographic material according to the invention, if necessary, there can be added hydrophilic polymers such as gelatin, poly(vinyl alcohol), methyl cellulose, hydroxypropyl cellulose, carboxymethyl cellulose, or the like.

These hydrophilic polymers are added at an amount of 30% by weight or less, and preferably 20% by weight or less, with respect to the total weight of the binder incorporated in the image forming layer.

According to the invention, the layer containing organic silver salt (image forming layer) is preferably formed by using polymer latex for the binder. According to the amount of the binder for the image forming layer, the weight ratio for total binder to organic silver salt (total binder/organic silver salt) is preferably in a range of from 1/10 to 10/1, and more preferably from 1/5 to 4/1.

The layer containing organic silver salt is, in general, a photosensitive layer (image forming layer) containing a photosensitive silver halide, i.e., the photosensitive silver salt; in such a case, the weight ratio for total binder to silver halide (total binder/silver halide) is in a range of from 400 to 5, and more preferably, from 200 to 10.

The total amount of binder in the image forming layer of the invention is preferably in a range of from 0.2 $g/m^2$ to 30 $g/m^2$, and more preferably from 1 $g/m^2$ to 15 $g/m^2$. As for the image forming layer of the invention, there may be added a crosslinking agent for crosslinking, or a surfactant and the like to improve coating properties.

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide, ethyl acetate, and the like. A water content in a solvent is more preferably 50% by weight or more and still more preferably 70% by weight or more.

Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

1) Organic Polyhalogen Compound

It is preferred that the photothermographic material of the invention contains a compound expressed by formula (H) below as an antifoggant.

$$Q\text{-}(Y)n\text{-}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

Q is preferably a phenyl group substituted by an electron-attracting group whose Hammett substituent constant σp yields a positive value. For the details of Hammett substituent constant, reference can be made to Journal of Medicinal Chemistry, vol. 16, No. 11 (1973), pages 1207 to 1216, and the like.

As such electron-attracting groups, examples include a halogen atom (fluorine atom (σp value: 0.06), chlorine atom (σp value: 0.23), bromine atom (σp value: 0.23), iodine atom (σp value: 0.18)), a trihalomethyl group (tribromomethyl (up value: 0.29), trichloromethyl (σp value: 0.33), trifluoromethyl (σp value: 0.54)), a cyano group (σp value: 0.66), a nitro group (σp value: 0.78), an aliphatic aryl sulfonyl group or a heterocyclic sulfonyl group (for example, methanesulfonyl (σp value: 0.72)), an aliphatic aryl acyl group or a heterocyclic acyl group (for example, acetyl (σp value: 0.50) and benzoyl (σp value: 0.43)), an alkynyl group (e.g., C≡CH (σp value: 0.23)), an aliphatic aryl oxycarbonyl group or a heterocyclic oxycarbonyl group (e.g., methoxycarbonyl (σp value: 0.45) and phenoxycarbonyl (σp value: 0.44)), a carbamoyl group (σp value: 0.36), a sulfamoyl group (σp value: 0.57), a sulfoxido group, a heterocyclic group, a phosphoryl group, and the like.

Preferred range of the up value is from 0.2 to 2.0, and more preferably, from 0.4 to 1.0. Preferred as the electron-attracting group are a carbamoyl group, an alkoxycarbonyl group, an alkylsulfonyl group, an alkylphosphoryl group, a carboxyl group, an alkylcarbonyl group, an arylcarbonyl group, and an arylsulfonyl group. Particularly preferred among them are a carbamoyl group, an alkoxycarbonyl group, an alkylsulfonyl group, and an alkylphosphoryl group, and most preferred is a carbamoyl group.

X is preferably an electron-attracting group; more preferably, a halogen atom, an aliphatic aryl sulfonyl group, a heterocyclic sulfonyl group, an aliphatic aryl acyl group, a heterocyclic acyl group, an aliphatic aryl oxycarbonyl group, a heterocyclic oxycarbonyl group, a carbamoyl group, or a sulfamoyl group; particularly preferred among them is a halogen atom.

Among halogen atoms, preferred are a chlorine atom, bromine atom, and iodine atom; more preferred are a chlorine atom and bromine atom; and particularly preferred is a bromine atom.

Y preferably represents —C(═O)—, —SO—, or —$SO_2$—; more preferably, —C(═O)— or —$SO_2$—; and particularly preferred is —$SO_2$—. n represents 0 or 1, and preferably represents 1.

Specific examples of the compounds expressed by formula (H) of the invention are shown below, but the present invention is not limited in these.

H-1

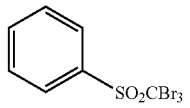

-continued
H-2
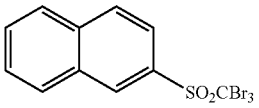
H-3
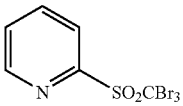
H-4
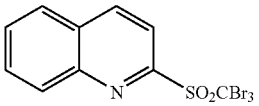
H-5
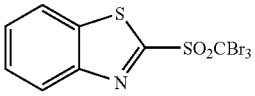
H-6
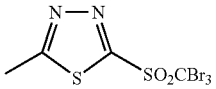
H-7
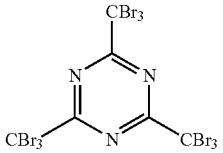
H-8
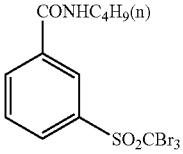
H-9
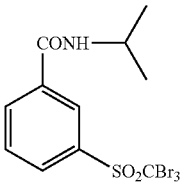
H-10
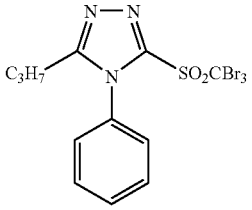
H-11
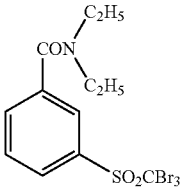
-continued
H-12
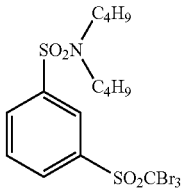
H-13
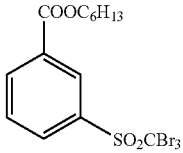
H-14
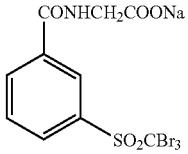
H-15
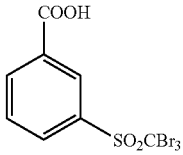
H-16
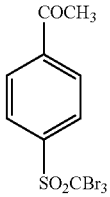
H-17
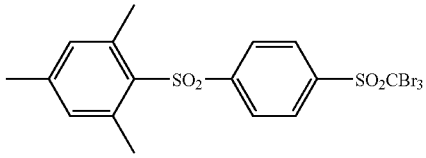
H-18
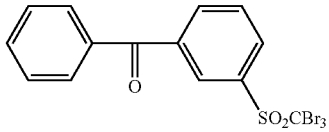
H-19
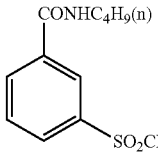
H-20
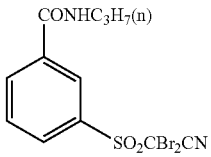

-continued

H-21

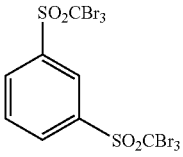

H-22

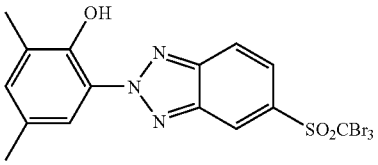

H-23

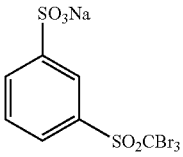

H-24

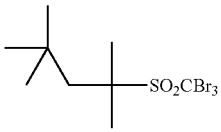

H-25

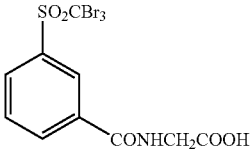

H-26

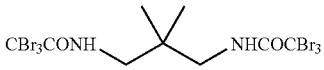

H-27

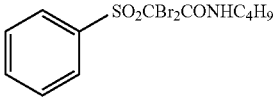

H-28

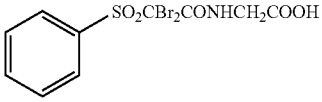

The compound expressed by formula (H) of the invention is preferably used in an amount of from $10^{-4}$ mol to 0.8 mol, more preferably, from $10^{-3}$ mol to 0.1 mol, and further preferably, from $5\times10^{-3}$ mol to 0.05 mol, per 1 mol of non-photosensitive silver salt incorporated in the image forming layer in each case.

Particularly, in the case where a silver halide having a composition of a high silver iodide content according to the invention is used, an addition amount of the compound expressed by formula (H) is important in order to obtain a sufficient anti-fogging effect and the compound is most preferably used in a range of from $5\times10^{-3}$ mol to 0.03 mol.

In the invention, methods of incorporating a compound expressed by formula (H) into a photothermographic material are described in the methods of incorporating a reducing agent described above.

A melting point of a compound expressed by formula (H) is preferably 200° C. or lower, and more preferably 170° C. or lower.

Examples of other organic polyhalogen compound used in the invention are disclosed in paragraph Nos. 0111 to 0112 of JP-A No. 11-65021. Preferable examples thereof are an organic halogen compound expressed by formula (P) described in JP-A No. 11-87297, an organic polyhalogen compound expressed by formula (II) described in JP-A No. 10-339934 and an organic polyhalogen compound described in JP-A No. 2001-033911.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene, and the like, described in JP-A No. 6-11791.

As an antifoggant, stabilizer and stabilizer precursor usable in the invention, there can be mentioned those disclosed in paragraph number 0070 of JP-A No. 10-62899 and in line 57 of page 20 to line 7 of page 21 of EP No. 0803764A1, the compounds described in JP-A Nos. 9-281637 and 9-329864.

The photothermographic material of the invention may further contain an azolium salt in order to prevent fogging. Azolium salts useful in the present invention include a compound expressed by formula (XI) described in JP-A No. 59-193447, a compound described in JP-B No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself.

The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used. Furthermore, it may be added as a solution having mixed therein other additives such as sensitizing agents, reducing agents, toners, and the like.

In the invention, the azolium salt may be added at any amount, but preferably, it is added in a range of from $1\times10^{-6}$ mol to 2 mol, and more preferably, from $1\times10^{-3}$ mol to 0.5 mol per 1 mol of silver.

(Other Additives)

1) Mercapto Compounds, Disulfides and Thiones

In the invention, mercapto compounds, disulfide compounds, and thione compounds can be added in order to control the development by suppressing or enhancing development, to improve spectral sensitization efficiency, and to improve storage properties before and after development. Descriptions can be found in paragraph Nos. 0067 to 0069 of JP-A No. 10-62899, a compound expressed by formula (I) of JP-A No. 10-186572 and specific examples thereof shown in paragraph Nos. 0033 to 0052, in lines 36 to 56 in page 20 of EP No. 0803764A1, in JP-A No. 2001-100358 and the like. Among them, mercapto-substituted heterocyclic aromatic compound is preferred.

2) Toner

In the photothermographic material of the present invention, the addition of a toner is preferred. The description of the toner can be found in JP-A No. 10-62899 (paragraph Nos. 0054 to 0055), EP No. 0803764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly with regard to a combination with silver halide having a high silver iodide content, preferred is a combination of phthalazines and phthalic acids. The addition amount of phthalazines is preferably from 0.01 mol to 0.3 mol per 1 mol of organic silver salt, more preferably from 0.02 mol to 0.2 mol, and particularly preferably from 0.02 mol to 0.1 mol. The addition amount of the compound is a very important factor for accelerating the development of the silver halide emulsion having high silver iodide content used for the present invention. The adequate selection of the addition amount may be capable of providing sufficient development performance while depressing fog.

3) Plasticizer and Lubricant

Plasticizers and lubricants usable in the image forming layer of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving color tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

5) Nucleation Accelerator

A nucleation accelerator can be used with the nucleator of the invention. Concerning the nucleation accelerator, description can be found in paragraph No. 0102 of JP-A No. 11-65021, and in paragraph Nos. 0194 to 0195 of JP-A No. 11-223898.

As the nucleation accelerator, it is preferred to use an acid resulting from hydration of diphosphorus pentaoxide, or a salt thereof. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

2. X-Ray Image Forming Method

The photothermographic material of the present invention may be either "single-sided type" having an image forming layer on one side of the support, or "double-sided type" having image forming layers on both sides of the support.

(Double-Sided Type Photothermographic Material)

The photothermographic material of the present invention is preferably applied for an image forming method to record X-ray images using a fluorescent intensifying screen. For the image forming method, the photothermographic material as described below can be preferably employed: where the photothermographic material is exposed with a monochromatic light having the same wavelength as the main emission peak wavelength of the fluorescent intensifying screen and having a half band width of 15 nm±5 nm, and after a thermal developing process, an exposure value required for obtaining an image density of fog+0.5 after removing the image forming layer that is disposed on the opposite side from an exposure face is from $1\times10^{-6}$ watt-sec·$m^{-2}$ to $1\times10^{-3}$ watt·sec·$m^{-2}$, and preferably from $6\times10^{-6}$ watt·sec·$m^{-2}$ to $6\times10^{-4}$ watt·sec·$m^{-2}$.

The image forming method using the photothermographic materials described above comprises:

(a) providing an assembly for forming an image by placing the photothermographic material between a pair of the X-ray intensifying screens, (b) putting an analyte between the assembly and the X-ray source, (c) applying X-rays having an energy level in a range of 25 kVp to 125 kVp to the analyte;

(d) taking the photothermographic material out of the assembly; and (e) heating the removed photothermographic material in a temperature range of 90° C. to 180° C.

The photothermographic material used for the assembly in the present invention is subjected to X-ray exposure through a step wedge tablet and thermal development. On the photographic characteristic curve having an optical density (D) and an exposure value (log E) along the rectangular coordinates having the equal axis-of-coordinate unit, it is preferred to adjust so that the thermal developed image may have the photographic characteristic curve where the average gamma (γ) made at the points of a density of fog+0.1 and a density of fog+0.5 is from 0.5 to 0.9, and the average gamma (γ) made at the points of a density of fog+1.2 and a density of fog+1.6 is from 3.2 to 4.0. For the X-ray radiography employed in the practice of the present invention, the use of photothermographic material having the aforesaid photographic characteristic curve would give the radiation images with excellent photographic properties that exhibit an extended bottom portion and high gamma value at a middle density area. According to this photographic property, the photographic properties mentioned have the advantage of that the depiction in a low density portion on the mediastinal region and the heart shadow region having little X-ray transmittance becomes excellent, and that the density becomes easy to view, and that gradation in the images on the lung field region having much X-ray transmittance becomes excellent.

The photothermographic material having a preferred photographic characteristic curve mentioned above can be easily prepared, for example, by the method where each of the image forming layer of both sides may be constituted of two or more image forming layers containing silver halide and having a sensitivity different from each other. Especially, the aforesaid image forming layer preferably comprises an emulsion of high sensitivity for the upper layer and an emulsion with photographic properties of low sensitivity and high gradation for the lower layer. In the case of preparing the image forming layer comprising two layers, the sensitivity difference between the silver halide emulsion in each layer is preferably from 1.5 times to 20 times, and more preferably from 2 times to 15 times. The ratio of the amount of emulsion used for forming each layer may depend on the sensitivity difference between emulsions used and the covering power. Generally, as the sensitivity difference is large, the ratio of the using amount of high sensitivity emulsion is reduced. For example, if the sensitivity difference is two times, and the covering power is equal, the ratio of the amount of high sensitivity emulsion to low sensitivity emulsion would be preferably adjusted to be in a range of from 1:20 to 1:50 based on silver amount.

The techniques such as an emulsion sensitizing method, kinds of additives and constituents employed in the production of the photothermographic material of the present invention are not particularly limited. For example, various kinds of techniques described in JP-A Nos. 2-68539, 2-103037 and 2-115837 can be applied.

As the techniques for crossover cut (in the case of double-sided photosensitive material) and anti-halation (in the case of single-sided photosensitive material), dyes or combined use of dye and mordant described in JP-A. No. 2-68539, (from page 13, left lower column, line 1 to page 14, left lower column, line 9) can be employed.

Next, the fluorescent intensifying screen of the present invention is explained below. The fluorescent intensifying screen essentially comprises a support and a fluorescent substance layer coated on one side of the support as the fundamental structure. The fluorescent substance layer is a layer where the fluorescent substance is dispersed in binders. On the surface of a fluorescent substance layer opposite to the support side (the surface of the side that does not face on the support), a transparent protective layer is generally disposed to protect the fluorescent substance layer from chemical degradation and physical shock.

Preferred fluorescent substances according to the present invention are described below. Tungstate fluorescent substances ($CaWO_4$, $MgWO_4$, $CaWO_4$:Pb, and the like), terbium activated rare earth sulfoxide fluorescent substances ($Y_2O_2S$:Tb, $Gd_2O_2S$:Tb, $La_2O_2S$:Tb, $(Y,Gd)_2O_2S$:Tb, $(Y,Gd)O_2S$:Tb, Tm, and the like), terbium activated rare earth phosphate fluorescent substances ($YPO_4$:Tb, $GdPO_4$:Tb, $LaPO_4$:Tb, and the like), terbium activated rare earth oxyhalogen fluorescent substances (LaOBr:Tb, LaOBr:Tb, Tm, LaOCl:Tb, LaOCl:Tb, Tm, LaOBr:Tb, GdOBr:Tb, GdOCl:Tb, and the like), thulium activated rare earth oxyhalogen fluorescent substances (LaOBr:Tm, LaOCl:Tm, and the like), barium sulfate fluorescent substances ($BaSO_4$:Pb, $BaSO_4$:$Eu^{2+}$, $(Ba,Sr)SO_4$:$Eu^{2+}$, and the like), divalent europium activated alkali earth metal phosphate fluorescent substances ($(Ba_2PO_4)_2$:$Eu^{2+}$, $(Ba_2PO_4)_2$:$Eu^{2+}$, and the like), divalent europium activated alkali earth metal fluorinated halogenide fluorescent substances (BaFCl:$Eu^{2+}$, BaFBr:$Eu^{2+}$, BaFCl:$Eu^{2+}$, Tb, BaFBr:$Eu^{2+}$, Tb, $BaF_2$.BaCl.KCl:$Eu^{2+}$, $(Ba,Mg)F_2$.BaCl.KCl:$Eu^{2+}$, and the like), iodide fluorescent substances (CsI:Na, CsI:Tl, NaI, KI:Tl, and the like), sulfide fluorescent substances (ZnS:Ag(Zn,Cd)S:Ag, (Zn,Cd)S:Cu, (Zn,Cd)S:Cu, Al, and the like), hafnium phosphate fluorescent substances ($HfP_2O_7$:Cu and the like), $YTaO_4$ and a substance in which various activator is added as an emission center to $YTaO_4$. However, the fluorescent substance used in the present invention is not particularly limited to these specific examples, so long as to emit light in visible or near ultraviolet region by exposure to a radioactive ray.

In the fluorescent intensifying screen used in the present invention, the fluorescent substances are preferably packed in the grain size graded structure. Especially, fluorescent substance particles having a large particle size is preferably coated on the side of the surface protective layer and fluorescent substance particles having a small particle size is preferably coated on the side of the support. Hereto, the small particle size of fluorescent substance is preferably in a range of from 0.5 μm to 2.0 μm and the large size is preferably in a range of from 10 μm to 30 μm.

(Single-Sided Type Photothermographic Material)

The single-sided type photothermographic material of the present invention is preferably applied for an X-ray photosensitive material used for mammography. To use the single-sided type photothermographic material for that purpose, it is very important to design the gradation of the obtained image in a suitable range.

The method to draw a photographic characteristic curve of the photothermographic material of the present invention is explained below. As for mammography, molybdenum target tube, which emits a low pressure X-ray, is usually employed as a beam source. However, as far as the intensifying screen comprising substantially a fluorescent substance comprising $Gd_2O_2S$:Tb is used, the photographic characteristic curve obtained by changing the X-ray exposure value by a distance method and using the X-ray beam emitted by tungsten target tube as a beam source, may give substantially the same result obtained above.

Specifically, for the measurement employed in the present invention, X-ray emitted from tungsten target tube operated by three-phase electric power supply at 50 KVp and penetrated through an aluminum plate having a thickness of 3 mm is used. The commercially availabe UM-Fine screen and the photosensitive material to be measured are made contact and installed in ECMA cassette produced by Fuji Photo Film Co., Ltd. After arranging so that the top plate of cassette, the photothermographic material and the screen may be set, from X-ray tube, in turn, X-ray irradiation is performed. While changing the X-ray exposure value by a distance method, the assembly is subjected to exposure with a step wedge tablet having a width of 0.15 in terms of log E.

The exposed photothermographic material is thermally developed under the determined conditions. Thereafter, density is measured, and then a photographic characteristic curve is obtained where the logarithm of a radiation exposure value is plotted on the abscissa axis, and the optical density is plotted on the ordinate axis. Gradation is determined from a gradient (tan θ, when the angle to the abscissa axis is θ) of a straight line connecting the points at a density of fog+0.25 and a density of fog+2.0. An average gradient of the photothermographic material used for mammography is preferably in a range of from 3.0 to 5.0.

Next, the measuring method of sensitivity of the photothermographic material is explained. As for the light source, a monochromatic light having the same wavelength as a main emission peak wavelength of the fluorescent intensifying screen is employed. As a means of obtaining such a required monochromic light, a method using the filter system where interference filters are combined can be used. According to the aforesaid method, usually the monochromic light having a required exposure value and a half band width of 15 nm±5 nm can be obtained easily, although it depends also on the combination of interference filters used.

The monochromic light whose intensity is correctly measured by an illuminometer in advance is employed as the light source. Thereby the photothermographic material is subjected to exposure with a step wedge tablet through a neutral filter for one second, where the photothermographic material and the light source are one meter apart. The density is measured after a thermal developing process, sensitivity of the photothermographic material can be obtained by determining the exposure value required to give a density of fog+0.5.

Preferred sensitivity of the photothermographic material used for mammography according to the invention is from $1\times10^{-6}$ watt·sec $m^{-2}$ to $1\times10^{-3}$ watt·sec·$m^{-2}$, and more preferably, from $6\times10^{-6}$ watt·sec·$m^{-2}$ to $6\times10^{-4}$ watt·sec·$m^{-2}$.

The fluorescent intensifying screen for mammography used in the invention is explained in detail below. The fluorescent intensifying screen used for photographic assembly of mammography used in the present invention is required to have high image sharpness in comparison with the conventional chest diagnosis. Generally, the image sharpness of commercially available fluorescent intensifying screen used for mammography is usually enhanced by coloring the fluorescent substance layer. However, the light emitted by X-ray beam absorbed in the inner side of the fluorescent substance to the X-ray irradiation plane cannot effectively be taken out from the colored screen. For the fluorescent intensifying screen according to the present invention, it is required to provide a screen coated with the amount of fluorescent substances enough to absorb X-ray and having high image sharpness without coloring the fluorescent substance layer substantially.

In order to attain the object of the aforesaid screen, the particle size of fluorescent substances preferably may be below a fixed size. The measurement of the particle size is performed by Coulter counter or observation through electron microscope. As for the preferred particle size of the fluorescent substance, a mean equivalent spherical diameter of the fluorescent substance particles is preferably in a range of from 1 μm to 5 μm, and more preferably from 1 μm to 4 μm. Although the above condition is not important to the conventional intensifying screen for mammography whose fluorescent substance layer is colored, it is very important to the present invention.

Moreover, in order to raise sharpness of the screen mentioned above, the use of fewer binders is preferred in regard to the weight ratio of binder to fluorescent substance in the fluorescent substance layer. The weight ratio of binder/fluorescent substance is preferably from 1/50 to 1/20, and more preferably from 1/50 to 1/25.

As for the binder, known substances described in JP-A No. 6-75097, from line 45 on right column at page 4 to line 10 on left column at page 5, can be employed. The thermoplastic elastomer having a softening temperature or a melting temperature of 30° C. to 150° C. can be preferably used alone or in combination with the other binder polymer. Especially for the screen of the present invention, which contains very small amount of binder to enhance the image sharpness, the proper selection of the binder used is very important to resist to the defect, because of the poor durability of the screen. It is desirable to choose entirely flexible binders as the solution for the defect. And also plasticizers and the like are preferably added in the fluorescent substance layer. As specific examples as the thermoplastic elastomer, polystyrenes, polyolefines, polyurethanes, polyesters, polyamides, polybutadienes, ethylene vinyl acetates, natural rubbers, fluorinated rubbers, polyisoprenes, ethylene chlorides, styrene-butadiene rubbers, silicone rubbers, and the like can be described. Among them, polyurethanes are particularly preferred. Moreover, the selection of the binder for the undercoat of the fluorescent substance layer is very important. Acrylate binders are preferably employed.

To the allowable limit with respect to the anti-scratch and anti-stain properties of the screen, the thickness of the surface protective layer is preferably thin. The preferred thickness of the surface protective layer is in a range of from 2 μm to 7 μm.

As the materials for the surface protective layer of the screen, films such as PET (especially, stretched type), PEN, nylon, and the like can be preferably stuck thereon. The surface protective layer of the screen is preferably formed by coating the fluorinated resins dissolved in a suitable solvent from the standpoint of preventing stain. The preferred embodiments of the fluorinated resins are described in detail in JP-A No. 6-75097, line 4 on left column at page 6 to line 43 on right column at the same page. As for specific examples of the resin suited for solvent coating type to form the surface protective layer, polyurethane resins, polyacrylate resins, cellulose derivatives, polymethyl methacrylates, polyester resins, epoxy resins, and the like can be mentioned other than fluorinated resins.

Moreover, it is important that filling factor of the fluorescent substances is sufficiently high to obtain a screen with high image sharpness and high sensitivity. Specifically, the volume filling factor of the fluorescent substance is preferably from 60% to 80%, and more preferably from 65% to 80%. In order to keep the volume filling factor of fine particles of the fluorescent substances high as in the present invention, the compression processes of fluorescent substance layer described in JP-A No. 6-75097, line 29 on right column at page 4 to line 1 on left column at page 6, are preferably applied.

The fluorescent substance used in the present invention preferably comprises substantially $Gd_2O_2S$:Tb. The term "substantially" described here means that main component of the fluorescent substance is $Gd_2O_2S$:Tb, and several % of any other additives to improve the property of the screen, and silica and the like to decorate the surface can preferably be included. And also, in place of Gd, Y, La, or Lu can be possibly mixed inside the ratio of several ten %.

Generally, fluorescent substance having a heavy density is preferred to absorb X-ray effectively. As such fluorescent substance that shows a desirable X-ray absorption ability in beam source used for mammography, $YTaO_4$ and the one adding various kinds of activator as the emission center thereto, $CaWO_4$, BaFBr:Eu, and the like can be mentioned besides $Gd_2O_2S$:Tb.

(Combined Use with Ultraviolet Fluorescent Intensifying Screen)

Concerning the image forming method using photothermographic material according to the present invention, it is preferred that the image forming method is perfomed in combination with a fluorescent substance having a main emission peak at 400 nm or lower. And more preferably, the image forming method is performed in combination with a fluorescent substance having a main emission peak at 380 nm or lower. Either single-sided photosensitive material or double-sided photosensitive material can be applied for the assembly. As the screen having a main emission peak at 400 nm or lower, the screens described in JP-A No. 6-11804 and WO No. 93/01521 and the like are used, but the present invention is not limited to these. As the techniques of crossover cut (for double-sided photosensitive material) and anti-halation (for single-sided photosensitive material) of ultraviolet light, the technique described in JP-A No. 8-76307 can be applied. As ultraviolet absorbing dyes, the dye described in JP-A No. 2001-144030 is particularly preferred.

3. Layer Constitution and Other Constituting Components

The photothermographic material according to the invention can have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer provided to the side opposite to the image forming layer.

Furthermore, a layer that functions as an optical filter may be provided as (a) or (b) above. An antihalation layer may be provided as (c) or (d) to the photothermographic material.

1) Surface Protective Layer

The photothermographic material of the invention can comprise a surface protective layer with an object to prevent adhesion of the image forming layer. The surface protective layer may be a single layer, or plural layers. Description of the surface protective layer may be found in paragraph Nos. 0119 to 0120 of JP-A No. 11-65021 and in JP-A No. 2001-348546.

Preferred as the binder of the surface protective layer of the invention is gelatin, but poly(vinyl alcohol) (PVA) may be used preferably instead, or in combination. As gelatin, there can be used an inert gelatin (e.g., Nitta gelatin 750), a phthalated gelatin (e.g., Nitta gelatin 801), and the like.

Usable as PVA are those described in paragraph Nos. 0009 to 0020 of JP-A No. 2000-171936, and preferred are the completely saponified product PVA-105 and the partially saponified PVA-205 and PVA-335, as well as modified poly(vinyl alcohol) MP-203 (trade name of products from Kuraray Ltd.).

The coating amount of poly(vinyl alcohol) (per 1 $m^2$ of support) in the protective layer (per one layer) is preferably in a range of from 0.3 $g/m^2$ to 4.0 $g/m^2$, and more preferably, from 0.3 $g/m^2$ to 2.0 $g/m^2$.

The coating amount of total binder (including water-soluble polymer and latex polymer) (per 1 $m^2$ of support) in the surface protective layer (per one layer) is preferably in a range of from 0.3 $g/m^2$ to 5.0 $g/m^2$, and more preferably, from 0.3 $g/m^2$ to 2.0 $g/m^2$.

2) Antihalation Layer

The photothermographic material of the present invention can comprise an antihalation layer provided to the side farther from the light source with respect to the image forming layer. Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially remain after image formation, and is preferred to employ a means for decoloring by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the bleaching dye is determined depending on the usage of the dye. In general, it is used at an amount as such that the optical density (absorbance) exceeds 0.1 when measured at the desired wavelength. The optical density is preferably in a range of from 0.2 to 2. The addition amount of dyes to obtain optical density in the above range is generally from about 0.001 $g/m^2$ to 1 $g/m^2$.

By decoloring the dye in such a manner, the optical density after thermal development can be lowered to 0.1 or lower. Two or more kinds of bleaching dyes may be used in combination in a photothermographic material. Similarly, two or more kinds of base precursors may be used in combination.

In the case of thermal decolorization by the combined use of a bleaching dye and a base precursor, it is advantageous from the viewpoint of thermal decolorization efficiency to further use a substance capable of lowering the melting point by at least 3° C. (deg) when mixed with the base precursor (e.g., diphenylsulfone or 4 -chloropbenyl(phenyl)sulfone) as disclosed in JP-A No. 11-352626.

3) Back Layer

Back layers usable in the invention are described in paragraph Nos. 0128 to 0130 of JP-A No. 11-65021.

In the invention, coloring matters having maximum absorption in a wavelength range from 300 nm to 450 nm can be added in order to improve color tone of developed silver images and a deterioration of the images during aging. Such coloring matters are described in JP-A Nos. 62-210458, 63-104046, 63-103235, 63-208846, 63-306436, 63-314535, 01-61745, 2001-100363, and the like. Such coloring matters are generally added in a range from 0.1 $mg/m^2$ to 1 $g/m^2$, preferably to the back layer which is provided to the side opposite to the image forming layer.

4) Matting Agent

In the invention, a matting agent is preferably added to the surface protective layer and the back layer in order to improve transportability. Description of the matting agent can be found in paragraphs Nos. 0126 to 0127 of JP-A No. 11-65021.

The addition amount of the matting agent is preferably in a range of from 1 $mg/m^2$ to 400 $mg/m^2$, and more preferably, from 5 $mg/m^2$ to 300 $mg/m^2$, with respect to the coating amount per 1 $m^2$ of the photothermographic material.

The level of matting on the image forming layer surface is not restricted as far as star-dust trouble occurs, but the level of matting of 30 seconds to 2000 seconds is preferred, particularly preferred, 40 seconds to 1500 seconds as Beck's smoothness. Beck's smoothness can be calculated easily, by using Japan Industrial Standared (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and further preferably, 500 seconds or less and 40 seconds or more, when expressed by Beck smoothness.

In the present invention, a matting agent is preferably contained in an outermost layer, in a layer which can function as an outermost layer, or in a layer nearer to outer surface of the photothermographic material, and is also preferably contained in a layer which can function as a so-called protective layer.

5) Polymer Latex

A polymer latex can be incorporated in the surface protective layer or the back layer of the photothermographic material according to the present invention. Concerning such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

The polymer latex in the surface protective layer or the back layer is preferably contained in an amount of from 10% by weight to 90% by weight, particularly preferably, from 20% by weight to 80% by weight of the total weight of binder.

6) Surface pH

The surface pH of the photothermographic material according to the invention preferably yields a pH of 7.0 or lower, and more preferably, 6.6 or lower, before thermal developing process. Although there is no particular restriction concerning the lower limit, the lower limit of pH value is about 3. Most preferred surface pH range is from 4 to 6.2.

From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener may be used in each of the image forming layer, protective layer, back layer, and the like.

As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone compounds of JP-A No. 62-89048.

The hardener is added as a solution, and the solution is added to the coating solution for protective layer 180 minutes before coating to just before coating, preferably 60 minutes before to 10 seconds before coating. However, so long as the effect of the invention is sufficiently exhibited, there is no particular restriction concerning the mixing method and the conditions of mixing.

As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "EKITAI KONGO GIJUTSU (Liquid Mixing Technology)" (Nikkan Kogyo Shinbunsha, 1989), and the like.

8) Surfactant

Concerning the surfactant applicable in the invention, description can be found in paragraph No. 0132 of JP-A No. 11-65021.

In the invention, preferably used are fluorocarbon surfactants. Specific examples of fluorocarbon surfactants can be found in those described in JP-A Nos. 10-197985, 2000-19680, and 2000-214554. Polymer fluorocarbon surfactants described in JP-A 9-281636 can be also used preferably. For the photothermographic material of the invention, fluorocarbon surfactants described in JP-A No. 2000-206560 are particularly preferably used.

9) Antistatic Agent

The photothermographic material of the invention preferably contains an electrically conductive layer including metal oxides or electrically conductive polymers. The antistatic layer may serve as an undercoat layer, a back surface protective layer, or the like, but can also be placed specially. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

10) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development.

As the support of the photothermographic material used in combination with the ultraviolet light emission screen, PEN is preferably used, but the present invention is not limited thereto. As PEN, polyethylene-2,6-naphthalate is preferred. The term "polyethylene-2,6-naphthalate" as used herein means that the structure repeating units essentially may consist of ethylene-2,6-naphthalene dicarboxylate units and also may include un-copolymerized polyethylene-2,6-naphthalene dicarboxylate, and the copolymer comprising 10% or less, and preferably 5% or less, of the structure repeating units modified with the other components and mixtures or constituents of other polymers. Polyethylene-2,6-naphthalate can be synthesized by reacting a naphthalene-2,6-dicarboxylic acid or functional derivatives thereof, and an ethylene glycol or functional derivatives thereof in the presence of a suitable catalyst at a proper reaction condition. The polyethylene-2,6-naphthalate of the present invention may be copolymerized or blended polysters, where one or more kinds of suitable third component (denaturing agent) is added before the completion of polymerization of the polyethylene-2,6-aphthalate. As the suitable third component, compounds containing a divalent ester forming functional group, for example, dicarboxylic acids such as oxalic acid, adipic acid, phthalic acid, isophthalic acid, terephthalic acid, naphthalene-2,7-dicarboxylic acid, succinic acid, diphenylether dicarboxylic acid, and the like, or lower alkylesters thereof, oxycarboxylic acids such as p-oxybenzoic acid, p-oxyethoxybenzoic acid, or lower alkylesters thereof, and divalent alcohols such as propylene glycol, trimethylene glycol, and the like are described. Polyethylene-2,6-naphthalate and the modified polymers thereof may include, for example, the polymer where the terminal hydroxy group and/or the carboxyl group is blocked by mono-functional compounds such as benzoic acid, benzoyl benzoic acid, benzyloxy benzoic acid, methoxy polyalkylene glycol, or the like, or the polymer modified with a very small amount of compounds having tri-functional or tetra-functional ester forming group such as glycerine and penta-erthritol in the extent to form linear chain copolymers substantially.

In the case of a photothermographic material for medical use, the transparent support may be colored with a blue dye (for instance, dye-1 described in the Example of JP-A No. 8-240877), or may be uncolored.

Specific examples of the support can be found in paragraph No. 0134 of JP-A No. 11-65021.

As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like.

11) Other Additives

Furthermore, antioxidant, stabilizing agent, plasticizer, UV absorbent, or a film-forming promoting agent may be added to the photothermographic material. Each of the additives is added to either of the image forming layer or the non-photosensitive layer. Reference can be made to WO No. 98/36322, EP No. 803764A1, JP-A Nos. 10-186567 and 10-18568, and the like.

12) Coating Method

The photothermographic material of the invention may be coated by any method. More specifically, various types of coating operations inclusive of extrusion coating, slide coating, curtain coating, immersion coating, knife coating, flow coating, or an extrusion coating using the kind of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating.

Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095.

The coating solution for the image forming layer in the invention is preferably a so-called thixotropic fluid. Concerning this technology, reference can be made to JP-A No. 11-52509.

Viscosity of the coating solution for the image forming layer of the invention at a shear velocity of 0.1 $S^{-1}$ is preferably from 400 mPa·s to 100,000 mPa·s, and more preferably, from 500 mPa·s to 20,000 mPa·s.

At a shear velocity of 1000 $S^{-1}$, the viscosity is preferably from 1 mPa·s to 200 mPa·s, and more preferably, from 5 mPa·s to 80 mPa·s.

13) Wrapping Material

In order to suppress fluctuation from occurring on the photographic property during a preservation of the photothermographic material of the invention before use, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}\ day^{-1}$ or lower at 25° C., more preferably, 10 $mL\text{-}atm^{-1}m^{-2}day^{-1}$ or lower, and further preferably, 1.0 $mL \cdot atm^{-1}m^{-2}\ day^{-1}$ or lower. Preferably, vapor transmittance is 10 $g \cdot atm^{-1}m^{-2}\ day^{-1}$ or lower, more preferably, 5 $g \cdot atm^{-1}m^{-2}day^{-1}$ or lower, and further preferably, 1 $g \cdot atm^{-1}m^{-2}\ day^{-1}$ or lower. As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the photothermographic material of the invention also include those in EP No. 803764A1, EP No. 883022A1, WO No. 98/36322, JP-A Nos. 56-62648, and 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, and 11-343420, JP-A Nos. 2000-187298, 2001-200414, 2001-234635, 2002-20699, 2001-275471, 2001-275461, 2000-313204, 2001-292844, 2000-324888, 2001-293864, and 2001-348546.

4. Thermal Developing Method

The image forming method of the present invention is an image forming method where an image is formed by subjecting the photothermographic material to imagewise exposure and thermally development with a thermal developing apparatus having a heating means, and characterized by heating the material at from 40° C. to 105° C. for 0.1 seconds to 90 seconds just before thermal development (herein called preheating). It is preferred that the temperature for preheating is from 60° C. to 100° C. and time period for preheating is from 1 second to 40 seconds.

4-1. Thermal Development

Although any method may be used for the development of the photothermographic material of the invention, the thermal developing process is usually performed by elevating the temperature of the photothermographic material exposed imagewise. The temperature for the development is preferably more than 105° C., and more preferably, in a range of from 110° C. to 130° C.

Time period for development is preferably in a range from 1 second to 60 seconds, more preferably from 3 seconds to 40 seconds, and particularly preferably from 5 seconds to 30 seconds.

In the process for thermal development, either a drum type heater or a plate type heater can be used, but a plate type heater process is preferred. A preferable process for thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by about 1° C. to 10° C. For example, 4 sets of plate heaters which can be independently subjected to the temperature control are used, and are controlled so that they respectively become 112° C., 119° C., 121° C., and 120° C. Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferred that the heater is more stably controlled. Preferable imagers which enable a rapid process according to the invention are described in, for example, JP-A Nos. 2002-289804 and 2002-287668. Using such imagers, thermal development within 14 seconds is possible with a plate type heater having three heating plates which are controlled, for example, at 107° C., 121° C. and 121° C., respectively. Thus, the output time period for the first sheet can be reduced to about 60 seconds. For such a rapid developing process, there exist various problems described above, so it is particularly preferred to use the photothermographic materials of the invention in combination with the process.

4-2. Thermal Developing Apparatus

Preferred embodiments of a thermal developing method and a thermal developing apparatus used for the present invention are explained hereinafter in detail with reference to the attached drawings.

Symbols used in Figures are explained below.

Figure 2:
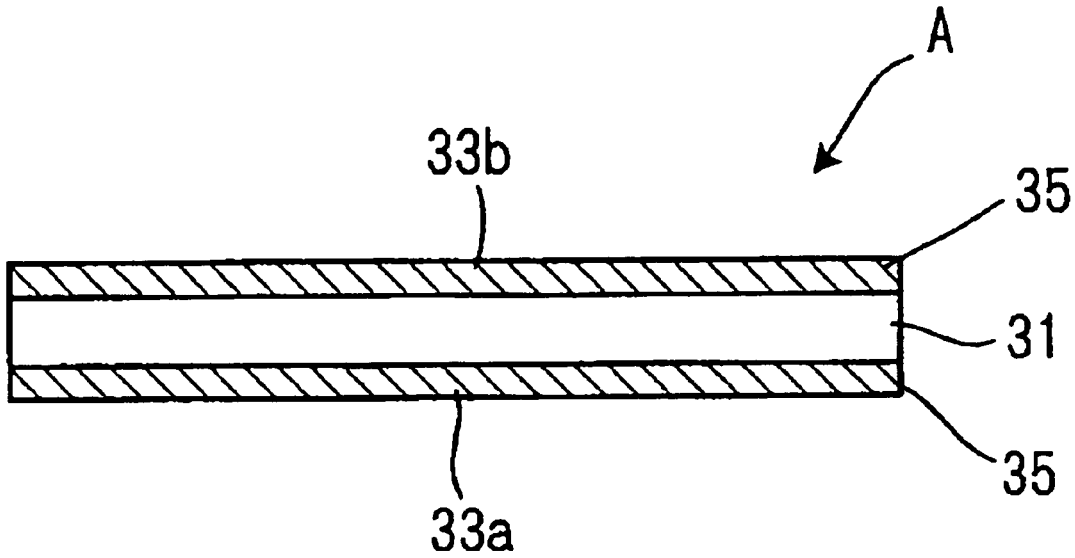
FIG. 2 is a sectional view showing a photothermographic material.
Figure 3:
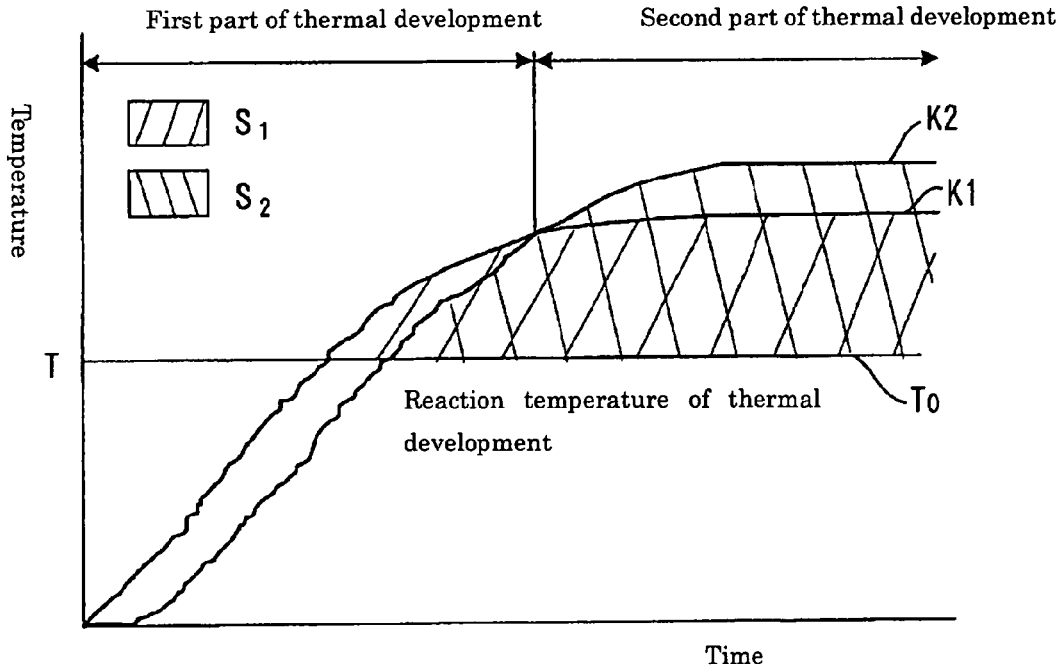
FIG. 3 is an explanatory diagram indicating a correlation between temperatures of the front and back surfaces of a photothermographic material respectively heated by first and second heating means and time.
Figure 4:
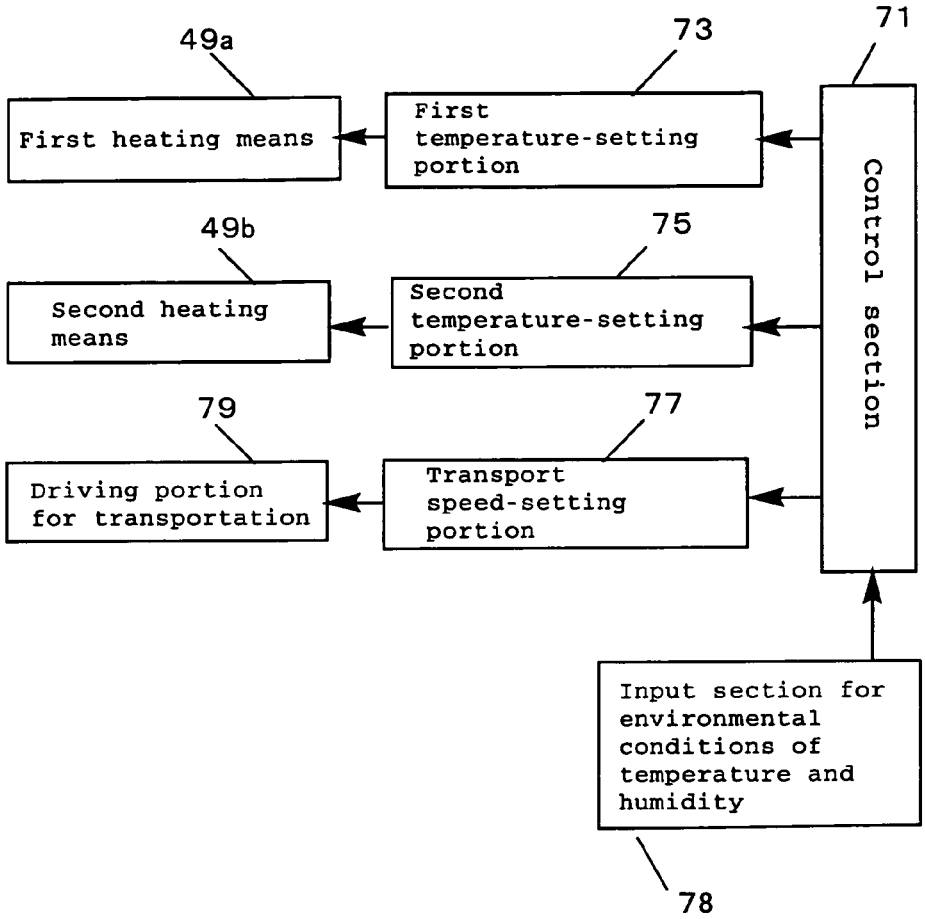
FIG. 4 is a block diagram showing a control means.

31: Support
33*a*: First surface
33*b*: Second surface
35: Image forming layer
44: Preheating means
49*a*, 81*a*, 91*a*, 101*a*: First heating means
49*b*, 81*b*, 91*b*, 10*b*: Second heating means
51: Plate
53: Pressing roller
83: Drum
85: Pressing roller
95: Endless belt
97: Pressing roller
100, 200, 300, 400: Thermal developing apparatus
A: Recording material (photothermographic material)
C: Conveying route
H: Heater
T: Development reaction temperature
δ: Clearance FIG. 1 is a structural diagram illustrating a first embodiment of a thermal developing apparatus for practicing the present invention. FIG. 2 is a sectional view showing the photothermographic material of the present invention. FIG. 3 is an explanatory diagram indicating a correlation between temperatures of the back and front surfaces of a recording material respectively heated by first and second heating means and time. FIG. 4 is a block diagram showing a control means.

The thermal developing apparatus 100 according to the embodiment of the present invention heats the photothermographic material A to make visible the latent image recorded in the image forming layer. The photothermographic material A used for the thermal developing apparatus 100 comprises image forming layers 35, 35 coated both on a first surface 33*a* as one side of the support 31 and the other face, a second surface 33*b* as shown in FIG. 2.

In the thermal developing apparatus 100, for example, when a fluorescent intensifying screen (not shown) is placed on both sides of the first surface 33*a* and the second surface 33*b* of the photothermographic material A, the photothermographic material A can be used for the direct radiography. The fluorescent intensifying screen can emit a fluorescent light by exposure to X-ray beam. The image forming layers 35, 35 coated on the first surface 33*a* and the second surface 33*b* respectively have a sensitivity to the fluorescent light emitted by the fluorescent intensifying screen and then can be sensitized by a small amount of X-ray beam thereby.

The photothermographic material A having a latent image in the image forming layer 35 is usually stocked in a cassette 37 one by one, and the cassette 37 including the materials is loaded to the thermal developing apparatus 100. An opening and closing cover 39 of the cassette 37 loaded in the thermal developing apparatus 100 is opened and the photothermographic material A included is taken out from the cassette by means of a suction cup 41.

Further, the thermal developing apparatus 100 may have a structure of a magazine (not shown) where a plurality of the photothermographic materials A are accommodated together. In this case, each of the photothermographic material A having a latent image is taken out from the cassette 37 in a darkroom and then stacked in the magazine. The photothermographic material A stacked and accommodated in the magazine is taken out one by one by means of the suction cup 41. In place of the suction cup 41, a pick-up roller can be applied.

The thermal developing apparatus 100 may have a structure where the photothermographic material A having a latent image is taken out from the cassette 37 manually in a darkroom and then directly inserting it into a conveying roller pair 43.

The photothermographic material A taken out thereby is conveyed to a thermal developing section 47 located downstream to a travelling direction via a conveying roller pair 43 and a transporting guide 45. A width aligning portion which aligns the photothermographic material A taken out in the direction normal to that of the travelling direction and the position of the photothermographic material A in the thermal developing section 47 located downstream may be installed between the conveying roller pair 43 and the thermal developing section 47.

In the thermal developing section 47, a first heating means 49*a* for heating the first surface 33*a* of the photothermographic material A and a second heating means 49*b* for heating the second surface 33*b* of the photothermographic material A are equipped alternatively crossing the conveying route C of the photothermographic material A. According to the embodiment, the first heating means 49*a* and the second heating means 49*b* are composed of a plate 51 and rotary pressing rollers 53 to push the photothermographic material A against the plate 51. Either the plate 51 or the pressing rollers 53 may include a heater as a heating source.

According to the embodiment, the heater as a heating source is included in the plate 51. Therefore, in the first heating means 49*a*, the plate 51 is placed facing the first surface 33*a* of the photothermographic material A, and in the second heating means 49*b*, the plate 51 is placed facing the second surface 33*b* of the photothermographic material A. The first surface 33*a* and the second surface 33*b* may be heated alternatively thereby. The term "heated alternatively" used herein includes a heating method where the first surface 33*a* is heated at first, thereafter the second surface 33*b* is heated, and finish heating, that is the case where the back and front sides of the material are heated only one time respectively.

The plate 51 has a circular-arc configuration and install a plurality of the pressing rollers 53 along the inner side. The photothermographic material A is inserted to the conveying route C formed in a clearance between the plate 51 and the pressing rollers 53, and conveyed tightly in contact with the plate 51 while pushing against the plate 51 by the pressing rollers 53. And then the material A is developed by the heat of the plate 51. The heating source for the plate 51 is not particularly restricted, but a heat generating body such as a nichrome wire, a light source such as a halogen lamp, hot air heating or other well-known heating means can be applied.

The pressing rollers 53 are selected from a metal roller, a heat-resistant resin roller, a heat-resistant rubber roller, and the like. Overall region in the plate 51, it is preferable to install a plurality of the rollers.

According to the thermal developing section 47, in the first heating means 49*a*, wherein the second surface 33*b* of the photothermographic material A is pushed by the pressing rollers 53, the first surface 33*a* is pushed against the plate 51. Thereafter the photothermographic material A is conveyed to the second heating means 49*b*, wherein the first surface 33*a* is pushed by the pressing rollers 53, the second surface 33*b* is pushed against the plate 51. As the result, the first surface 33*a* and the second surface 33*b* of the photothermographic material A are heated alternatively. Thereby, the rapid temperature raise of the photothermographic material A can be avoided and also uniform heating of both surfaces can be attained. In addition, the above-mentioned configuration has an advantage of decreasing the movable parts and miniaturizing the apparatus structure, because the pressing roller 53 rotates alone.

In the thermal developing section 47, with respect to the total heating amount which is more than the development reaction temperature for the image forming layer 35 heated by the first surface 33*a* and the second surface 33*b* of the photothermographic material A, if the total heating amount for the first surface 33*a* is taken as 100, the total heating amount for the second surface 33*b* is set to be in a range of 100±30.

The temperature of both the first heating means 49*a* and the second heating means 49*b* is set at the glass transition temperature of the photothermographic material A or higher. The temperature of the heating means (the first heating means 49*a*) located upstream to the travelling direction of the photothermographic material A is set a lower temperature than that of the heating means (the second heating means 49*b*) located downstream to the travelling direction.

The above-mentioned total heating amount can be derived from the integral value of the temperature of greater than the development reaction temperature and the time lapse from the time when the temperature is reached to the development reaction temperature. Namely, in the graph shown in FIG. 3, the total heating amount of the first surface 33*a* can be obtained from the area $S_1$ which is enclosed between the line segment To representing the development reaction temperature T and the curve K1 representing the temperature change of the first surface 33*a*. The total heating amount of the second surface 33*b* can be obtained from the area $S_2$ which is enclosed between the line segment To representing the development reaction temperature T and the curve K2 representing the temperature change of the second surface 33*b*. Thereby, the total heating amount can be controlled by the specific parameters of the temperature and the time lapse for the first heating means 49*a* and the second heating means 49*b*, because the total heating amount ($S_1$, $S_2$) on the first surface 33*a* and the second surface 33*b* can be determined from the integral value of the temperature and the time lapse respectively. As the result, uniformity of the total heating amount on both surfaces of the photothermographic material A can be easily attained.

Further, as for the total heating amount, if the heating temperature of the first heating means 49*a* and the second heating means 49*b* and a contact length L1, L2 of the photothermographic material A with the first heating means 49*a* and the second heating means 49*b* are used as a parameter, and the total heating amount on the first surface 33*a* is taken as 100, then the total heating amount on the second surface 33*b* may be set to a range of 100±30. Thereby, the total heating amount can be controlled by the specific parameter of the temperature and the contact length L1, L2, and then the uniformity of the total heating amount on both surfaces of the photothermographic material A can be easily attained.

According to the above configuration, the temperature of the photothermographic material A becomes the glass transition temperature or higher when the heating face is the first surface 33*a*, and also the temperature becomes the glass transition temperature or higher when the heating face is transferred from the first surface 33*a* to the second surface 33*b*. Therefore the photothermographic material A is maintained to be in a softening state during the heating process. Thereby, the generation of a wrinkle caused by pushing the photothermographic material A by the pressing rollers 53 can be prevented. Because the heating temperature of the first heating means 49*a* is set to be lower than the heating temperature of the second heating means 49*b*, the rapid temperature rise on the first surface 33*a* is avoided at the beginning stage of the heating. The generation of a wrinkle caused by a rapid thermal swelling of the photothermographic material A can be prevented thereby.

Furthermore, in the thermal developing section 47, the clearance σ between the first heating means 49*a* and the second heating means 49*b* is set to 100 mm or less. Therefore, when the photothermographic material A whose first surface 33*a* is heated by the heating means 49*a* is conveyed to the second heating means 49*b* to heat the second surface 33*b*, the temperature drop of the photothermographic material A heated by the first heating means 49*a* is prevented because of the narrow clearance on the order of 100 mm or less. Thereby, the photothermographic material A is kept at more than the predetermined temperature shown in FIG. 3, even if the heating face is changed between the back and front sides, and the development reaction can proceed successively without any delay.

The photothermographic material A developed in the thermal developing section 47 is then conveyed to a gradual cooling section 61 located downstream to the travelling direction as shown in FIG. 1. The gradual cooling section 61 installs a plurality of cooling roller pairs 63 and can gradually cool the thermally developed photothermographic material A. The photothermographic material A cooled in the gradual cooling section 61 is then conveyed to the downstream direction by a discharging roller pairs 65, and 67 and then discharged to a tray 69.

The thermal developing apparatus 100 also includes a control section 71 which can control the first heating means 49*a*, the second heating means 49*b* and the transporting speed of the photothermographic material A. As shown in FIG. 4, the control section 71 can control the first heating means 49*a* via the first temperature-setting portion 73, the second heating means 49*b* via the second temperature-setting portion 75, and also control a driving portion for transportation 79 such as a driving motor via a transporting speed-setting portion 77. The control section 71 can control the total heating amount for heating the first surface 33*a* and the second surface 33*b* to be in the above described range using the temperature and the transporting speed as the parameter. Moreover, the setting values for the first temperature-setting portion 73, the second temperature-setting portion 75, and the transporting speed-setting portion 77 can be determined based on the information from the input section 78 for environmental conditions of temperature and humidity.

According to the thermal developing apparatus 100, the first surface 33*a* of the photothermographic material A may be heated first, and then the second surface 33*b* is heated. Therefore, the both surfaces of the photothermographic material A can be thermally developed, while suppressing a rapid temperature raise. Also, because the total heating amount of the second surface 33*b* is set to be in the prescribed range of the total heating amount of the first surface 33*a*, the total heating amount of both surfaces of the photothermographic material A result in an approximately equal amount. Thereby, the photothermographic material A can be thermally developed evenly without any wrinkle generation, color tone difference and density fluctuation.

According to the thermal developing method using the thermal developing apparatus 100, the first surface 33*a* and the second surface 33*b* of the photothermographic material A are heated alternatively, and with respect to each of the total heating amount which is more than the development reaction temperature to the image forming layer 35 heated by the first surface 33*a* and the second surface 33*b*, if the total heating amount of the first surface 33*a* is taken as 100, the total heating amount of the second surface 33*b* is set to be in the range of 100±30. Thereby, both sides of the photothermographic material A are heated evenly and then can be thermally developed uniformly. In addition, even if the first surface 33*a* and the second surface 33*b* are heated alternatively, both surfaces can be heated evenly while suppressing a rapid temperature raise. Thereby, for the case of the photothermographic material A which has an image forming layer on both sides, uniformly heat development of both surfaces can be attained without the generation of wrinkles, and also without color tone difference and density fluctuation. The loading of the photothermographic material A to the thermal developing apparatus and the development thereof can be carried out without any consideration about the back and front sides.

The other embodiments of the thermal developing apparatus used for the present invention are explained hereinafter.

In the following embodiments, only the main portions of the thermal developing apparatus (thermal developing section) are shown. Every thermal developing section has a construction where the first surface 33*a* and the second surface 33*b* of the photothermographic material A are heated alternatively by the first heating means and the second heating means respectively, and the total heating amount of the second surface 33*b* is set to be in a range of 100±30 when the total heating amount of the first surface 33*a* is taken as 100.

Figure 5:
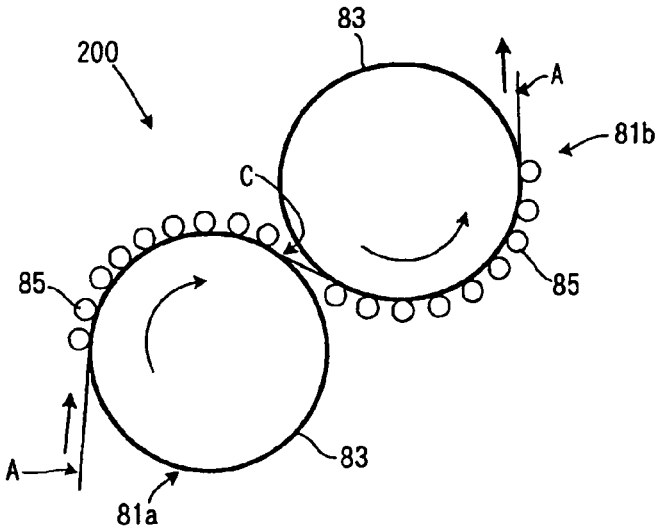
FIG. 5 is a structural view showing an essential part of a thermal developing apparatus having a drum and pressing rollers.

FIG. 5 show a schematic diagram of a main portion of a thermal developing apparatus installed with a drum and a plurality of pressing rollers according to the second embodiment.

The thermal developing apparatus 200 has a construction in which both of a first heating means 81*a* and a second heating means 81*b* use a rotary driven cylindrical drum 83 and a plurality of rotary pressing rollers 85 pushing the photothermographic material A against the circumferential surface of the drum 83. A heater as a heating source may be equipped in either the drum 83 or the pressing rollers 85. In this embodiment, the drum 83 cantains the heater as the heating source.

The first heating means 81*a* and the second heating means 81*b* are disposed close together, and the drum 83 of the first heating means 81*a* rotates reversely to the drum 83 of the second heating means 81*b*. Therefore, the first heating means 81*a* and the second heating means 81*b* form an S-shaped conveying route C. Even in the thermal developing apparatus 200 according to the embodiment, the first surface 33*a* of the photothermographic material A is heated by the first heating means 81*a* and then the second surface 33*b* is heated by the second heating means 81*b*.

The photothermographic material A transported by the first heating means 81*a* is conveyed with nipping by the drum 83 and the pressing rollers 85 while the first surface 33*a* is conveyed in close contact with the drum 83. As a result, the material is heated by the heat of the drum 83 to make visible the latent image formed by the exposure. Next to the above, the photothermographic material A in which the first surface 33*a* is heated is conveyed to the second heating means 81*b*, and then conveyed with nipping by the drum 83 and the pressing rollers 85 while the second surface 33*b* is conveyed in close contact with the drum 83 in a similar way as the above. Thereby the material is thermally developed by the heat of the drum 83.

According to the thermal developing apparatus 200, the first surface 33*a* of the photothermographic material A is pushed against the drum 83 in the heating means 81*a*, and then the second surface 33*b* is pushed against the drum 83 in the second heating means 81*b*. As a result, the first surface 33*a* and the second surface 33*b* of the photothermographic material A are heated alternatively. Therefore, the rapid temperature raise of the photothermographic material A can be avoided and then the uniform heating of both faces is attained. Also, a configuration where the drum 83 and the pressing rollers 85 are rotated synchronously with the transporting speed of the photothermographic material A advantageously results in no rubbing between the heating means and the photothermographic material A.

The thermal developing apparatus of the third embodiment of the present invention is explained hereinafter.

Figure 6:
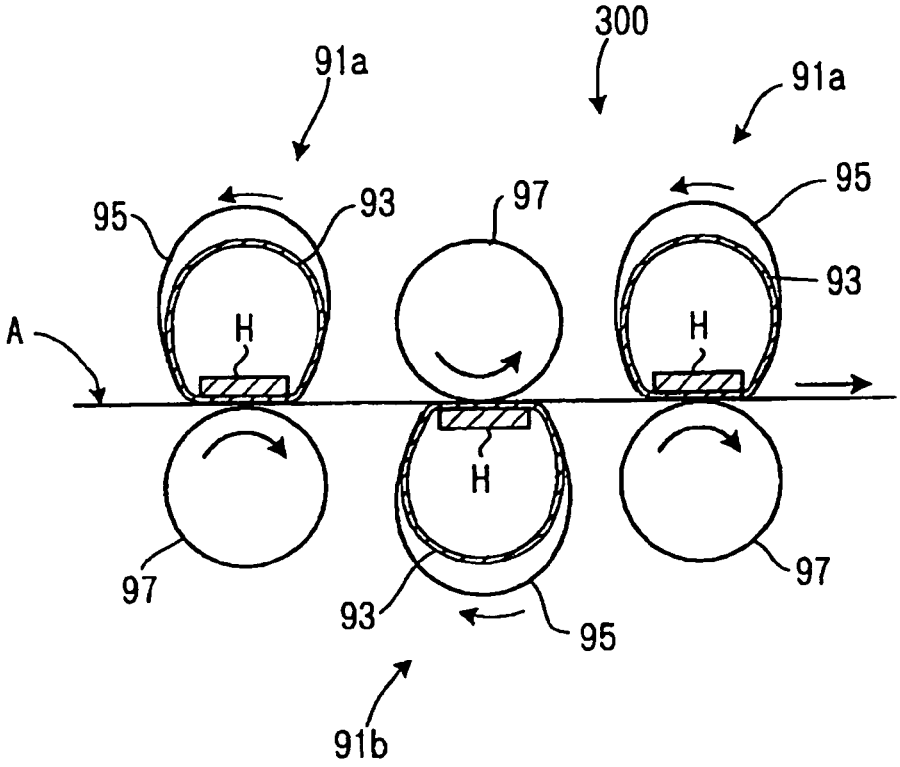
FIG. 6 is a structural view showing an essential part of a thermal developing apparatus having a carrier, an endless belt, and pressing rollers.

FIG. 6 shows a schematic diagram of the main portion of a thermal developing apparatus having a carrier, an endless belt and a pressing roller.

The thermal developing apparatus 300 has a construction in which each of the first heating means 91*a* and the second heating means 91*b* consist of a pipe type carrier 93 installed with a heater H as a heat source, the endless belt 95 surrounding the carrier 93, and the pressing roller 97 rotating the endless belt 95 at the same speed while pushing the endless belt 95 against the carrier 93. The endless belt 95 may be made of a material having enough heat conductivity such as aluminum, resin and the like, or a rubber heater. With respect to the heating amount of the first heating means 91*a* and the second heating means 91*b*, if each heating means is adjusted to heat the back and front surfaces of the photothermographic material A evenly, the number of the first heating means 91*a* and the heating means 91*b* disposed is not necessary the same.

According to the thermal developing apparatus 300, for example, in the heating means 91*a* shown in the left side of FIG. 6, while pushing the second surface 33*b* of the photothermographic material A by the pressing roller 97, the first surface 33*a* is pushed against the carrier 93 by means of the endless belt 95. Then the photothermographic material A is conveyed to the second heating means 91*b*, in succession, while pushing the first surface 33*a* by the pressing roller 97, the second surface 33*b* is pushed against the carrier 93 by means of the endless belt 95. Thereby, the first surface 33*a* and the second surface 33*b* of the photothermographic material A are heated alternatively. Both surfaces of the photothermographic material A can be heated uniformly, and the gradual heating with the plural heating means prevents the rapid temperature raise. And also, the configuration in which the endless belt 95 surrounding the carrier 93 is moved synchronized with the transporting speed of the photothermographic material A may result in no rubbing between the heating means and the photothermographic material A. Therefore no damage in the image forming layer is occurred.

The thermal developing apparatus of the fourth embodiment of the present invention will be explained in detail hereinafter.

Figure 7:
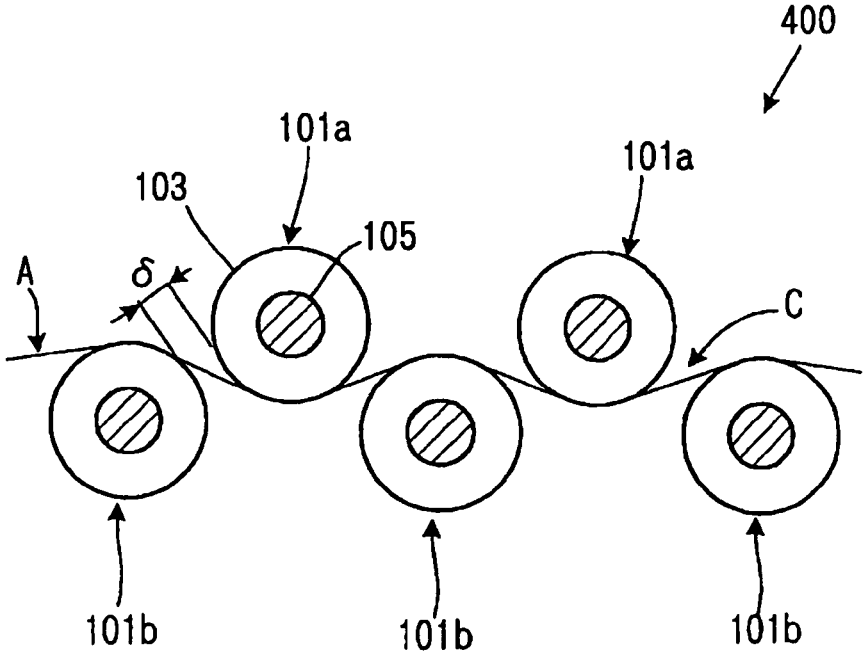
FIG. 7 is a structural view showing an essential part of a thermal developing apparatus having plural pairs of first and second heating means.

FIG. 7 shows a schematic diagram of a main portion of the thermal developing apparatus installed with plural sets of a first heating means and a second heating means.

The thermal developing apparatus 400 installs plural sets of a first heating means 101*a* composed of a heating roller 101 along the conveying route C of the photothermographic material A and a second heating means 101*b* composed of similar heating roller 101. The heating roller 101 consists of a cylindrical heating body 103 and a heating source 105 such as a halogen heater and the like to heat the inner side of the heating body 103. Especially, according to the embodiment, the first heating means 101*a* and the second heating means 101*b* are disposed in the staggered form along the conveying route C of the photothermographic material A.

Therefore, according to the thermal developing apparatus 400, after the first surface 33*a* and the second surface 33*b* of the photothermographic material A are heated alternatively by the first heating means 101*a* and the second heating means 101*b* of the first set respectively, the photothermographic material A is conveyed to the first heating means 101*a* and the second heating means 101*b* of the second set where the first surface 33*a* and the second surface 33*b* is again heated alternatively. This alternative heating is repeated in the plural sets of the heating means. Thereby, a rapid temperature raise in the photothermographic material A can be avoided and also both surfaces of the photothermographic material A can be heated uniformly with gradually heating.

The thermal developing apparatus 400 in which plural sets of the first heating means 101*a* and the heating means 101*b* are disposed in the staggered form along the conveying route C has the configuration where a plurality of the first heating means 101*a* disposed on the one side of the conveying route C and a plurality of the second heating means 101*b* disposed on the other side of the conveying route C are inserted alternatively in the gap between the neighboring heating means and disposed with some contact angle to each heating means. Therefore, the conveying route C is formed as a wavy shape. Thereby, the contact area between the photothermographic material A and the heating means is increased, the efficiency of the heat conductance to the photothermographic material A is enhanced.

In each embodiment described above, only main part of the thermal developing apparatus (i.e., thermal developing section) is shown. However, similar heating means can be selected for the preheating means 44 in the diagram showing the first embodiment of the thermal developing apparatus shown in FIG. 1 according to the present invention. As for a heating means for the preheating section, the known heating means, for example, such as a hot air method can be selected.

5. Application of the Invention

The photothermographic material and the image forming method of the invention are preferably employed as photothermographic materials for use in medical diagnosis through forming black and white images by silver imaging, and the image forming method using the same.

The present invention is specifically explained by way of Examples below, which should not be construed as limiting the invention thereto.

EXAMPLES

Example 1

1. Preparation of PET Support and Undercoating 1-1. Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, and colored blue with the blue dye (1,4-bis(2,6-diethylanilinoanthraquinone). Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 KV·A·minute·$m^{-2}$ was executed, judging from the readings of current and voltage on that occasion. The frequency upon this treatment was 9.6 kHz, and the gap clearance between the electrode and dielectric roll was 1.6 mm.

1-3. Undercoating

1) Preparations of Coating Solution for Undercoat Layer

| | |
|---|---|
| $SnO_2$/SbO (9/1 weight ratio, mean particle diameter of 0.5 μm, 17% by weight dispersion) | 84 g |
| Pesresin A-520 manufactured by Takamatsu Oil & Fat Co., Ltd. (30% by weight solution) | 46.8 g |
| BAIRONAARU WD-1200 manufactured by Toyo Boseki Co., Ltd. | 10.4 g |
| Polyethylene glycol monononylphenylether (average ethylene oxide number = 8.5) 1% by weight solution | 11.0 g |
| MP-1000 manufactured by Soken Chemical & Engineering Co., Ltd. (PMMA polymer fine particle, mean particle diameter of 0.4 μm) | 0.91 g |
| distilled water | 847 mL |

2) Undercoating

Both surfaces of the aforementioned biaxially tentered polyethylene terephthalate support having the thickness of 175 μm were subjected to the corona discharge treatment as described above. Thereafter, the coating solution for the undercoat was coated with a wire bar so that the amount of wet coating became 6.6 mL/$m^2$ (per one side), and dried at 180° C. for 5 minutes. Thus, an undercoated support was produced.

2. Image Forming Layer, Intermediate Layer, and Surface Protective Layer 2-1. Preparations of Coating Material 1) Preparation of Silver Halide Emulsion (Preparation of Silver Halide Emulsion A)

<Preparation of Silver Halide Emulsion 1A (Tabular AgI Host Grains of 0.68 μm)>

A solution was prepared by adding 8 mL of a 10% by weight potassium iodide solution, and then 4.6 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.7 g of silver nitrate by adding distilled water to give the volume of 223 mL; and solution B prepared through diluting 36.6 g of potassium iodide with distilled water to give the volume of 366 mL. A method of controlled double jet was executed through adding total amount of the solution A at a constant flow rate over 15 minutes and 22 seconds, accompanied by adding the solution B while maintaining the pAg at 9.96. Thereafter, 10 mL of a 3.5% by weight aqueous solution of hydrogen peroxide was added thereto, and 0.8 mL of a 10% by weight aqueous solution of benzimidazole was further added. Moreover, a solution C prepared through diluting 53.1 g of silver nitrate by adding distilled water to give the volume of 520.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 9.96. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The silver halide emulsion 1A was a pure silver iodide emulsion, and the obtained host grains had a mean projected area equivalent diameter of 1.36 μm, a variation coefficient of a projected area equivalent diameter distribution of 17.7%, a mean thickness of 0.113 μm, and a mean aspect ratio of 12.0. Tabular grains having an aspect ratio of 2 or more occupied 80% or more of the total projected area. A mean equivalent spherical diameter of the grains was 0.68 μm. 15% or more of the silver iodide existed in r phase from the result of powder X-ray diffraction analysis.

<Preparation of Silver Halide Emulsion 2A (Epitaxial Grains of 0.68 μm)>

1 mol of the silver iodide host grains prepared in the above silver halide emulsion 1A was added to the reaction vessel. The pAg measured at 40° C. was 9.1. A solution containing 0.088 mol of potassium bromide and 0.038 mol of sodium chloride per one liter, and 0.125 mol/L silver nitrate solution were added at an addition speed of 28.7 mL/min over 31 minutes by double jet addition to precipitate substantially a 10 mol % of silver chlorobromide based on total siver amount at six corner portions on the silver iodide host grains as epitaxial form. During the operation, the pAg was kept at 7.13.

Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The average halogen composition of epitaxial portion was determined by a field emission-type analytical electron microscope with an ultrathin slice of the epitaxial portion of silver halide grain. As a result of the measurement, it was revealed that bromine being 80 mol %, chlorine being 17 mol %, and iodine being 3 mol %.

The above-mentioned silver halide dispersion was kept at 38° C. with stirring, and thereto was added 5 mL of a 0.34% by weight methanol solution of 1,2-benzisothiazoline-3-one, and after 40 minutes the temperature was elevated to 60° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to produce silver halide emulsion 2A having an epitaxial junction.

(Preparations of Silver Halide Emulsion B and C)

<Preparations of Host Silver Halide Emulsion 1B and 1C>

Preparations of silver halide emulsion 1B and 1C were conducted in a similar manner to the process in the preparation of silver halide emulsion 1A, except that the potassium iodide in the halogen solutions B and D was changed to the mixture of potassium iodide and potassium bromide. The average silver iodide contents of the silver halide emulsion 1B and 1C were 90 mol % and 80 mol %, respectively. The grain forms in each emulsion were adjusted to be not so different from that in silver halide emulsion 1A, by controlling the reaction temperature and the addition speed of silver nitrate aqueous solution and potassium iodide aqueous solution. Forms of the obtained grains are shown in Table 1.

<Preparations of Grains Having an Epitaxial Junction>

Preparations of silver halide emulsion 2B and 2C were conducted in a similar manner to the process in the preparation of silver halide emulsion 2A except that using silver halide emulsion 1B and 1C as host grains, respectively. The silver halide emulsion 2B and 2C contained 10 mol % of silver chlorobromide epitaxial.

(Preparation of Silver Halide Emulsion D)

<Preparation of Host Silver Halide Emulsion 1D>

Preparation of silver halide emulsion 1D was conducted in a similar manner to the process in the preparation of silver halide emulsion 1A, except that adequately changing the addition amount of a 5% by weight methanol solution of 2,2'-(ethylene dithio)diethanol, the temperature at grain formation step, and the time for adding the solution A. The obtained silver halide grains had a mean projected area equivalent diameter of 0.93 μm, a variation coefficient of a projected area equivalent diameter distribution of 17.7%, a mean thickness of 0.057 μm, and a mean aspect ratio of 16.3. Tabular grains having an aspect ratio of 2 or more occupied 80% or more of the total projected area. A mean equivalent spherical diameter of the grains was 0.42 μm. 15% or more of the silver iodide existed in γ phase from the result of powder X-ray diffraction analysis.

<Preparation of Grains Having an Epitaxial Junction>

Preparation of silver halide emulsion 2D was conducted in a similar manner to the process in the preparation of silver halide emulsion 2A except that using silver halide emulsion 1D as host grains. The silver halide emulsion 2D contained 10 mol % of silver chlorobromide epitaxial.

(Preparation of Silver Halide Emulsion E)

<Preparation of Host Silver Halide Emulsion 1E>

Preparation of silver halide emulsion 1E was conducted in a similar manner to the process in the preparation of silver halide emulsion 1A, except that adequately changing the addition amount of a 5% by weight methanol solution of 2,2'-(ethylene dithio)diethanol, the temperature at grain formation step, and the time for adding the solution A. The obtained silver halide grains had a mean projected area equivalent diameter of 0.443 μm, a variation coefficient of a projected area equivalent diameter distribution of 19.1%, a mean thickness of 0.053 μm, and a mean aspect ratio of 8.37. Tabular grains having an aspect ratio of 2 or more occupied 80% or more of the total projected area. A mean equivalent spherical diameter of the grains was 0.25 μm. 15% or more of the silver iodide existed in γ phase from the result of powder X-ray diffraction analysis.

<Preparation of Grains Having an Epitaxial Junction>

Preparation of silver halide emulsion 2E was conducted in a similar manner to the process in the preparation of silver halide emulsion 2A except that using silver halide emulsion 1E as host grains. The silver halide emulsion 2E contained 10 mol % of silver chlorobromide epitaxial.

(Preparation of Silver Halide Emulsion F)

<Preparation of Host Silver Halide Emulsion 1F>

Preparation of silver halide emulsion 1F was conducted in a similar manner to the process in the preparation of silver halide emulsion 1A, except that adequately changing the addition amount of a 5% by weight methanol solution of 2,2'-(ethylene dithio)diethanol, the temperature at grain formation step, and the time for adding the solution A. The obtained silver halide grains had a mean projected area equivalent diameter of 0.246 μm, a variation coefficient of a projected area equivalent diameter distribution of 19.2%, a mean thickness of 0.045 μm, and a mean aspect ratio of 5.47. Tabular grains having an aspect ratio of 2 or more occupied 80% or more of the total projected area. A mean equivalent spherical diameter of the grains was 0.16 μm. 15% or more of the silver iodide existed in γ phase from the result of powder X-ray diffraction analysis.

<Preparation of Grains Having an Epitaxial Junction>

Preparation of silver halide emulsion 2F was conducted in a similar manner to the process in the preparation of silver halide emulsion 2A except that using silver halide emulsion 1F as host grains. The silver halide emulsion 2F contained 10 mol % of silver chlorobromide epitaxial.

(Preparation of Silver Halide Emulsion G)

<Preparation of Silver Halide Emulsion G (AgI Fine Grain of 0.04 μm)>

A solution was prepared by adding 4.3 mL of a 1% by weight potassium iodide solution, and then 3.5 mL of 0.5 mol/L sulfuric acid and 36.7 g of phthalated gelatin to 1420 mL of distilled water. The solution was kept at 42° C. while stirring in a stainless steel reaction vessel, and thereto were added total amount of: solution A prepared through diluting 22.22 g of silver nitrate by adding distilled water to give the volume of 195.6 mL; and solution B prepared through diluting 21.8 g of potassium iodide with distilled water to give the volume of 218 mL, over 9 minutes at a constant flow rate. Thereafter, 10 mL of a 3.5% by weight aqueous solution of hydrogen peroxide was added thereto, and 10.8 mL of a 10% by weight aqueous solution of benzimidazole was further added.

Moreover, a solution C prepared through diluting 51.86 g of silver nitrate by adding distilled water to give the volume of 317.5 mL and a solution D prepared through diluting 60 g of potassium iodide with distilled water to give the volume of 600 mL were added. A method of controlled double jet was executed through adding total amount of the solution C at a constant flow rate over 120 minutes, accompanied by adding the solution D while maintaining the pAg at 8.1. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-mentioned silver halide dispersion was kept at 38° C. with stirring, and thereto was added 5 mL of a 0.34% by weight methanol solution of 1,2-benzisothiazoline-3-one, and the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-4}$ mol per 1 mol of silver and subjected to ripening for 91 minutes.

And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, and 1-phenyl-2-heptyl-5-mercapto-1,3,4-triazole in a methanol solution at $5.4\times10^{-3}$ mol per 1 mol of silver were added to produce silver halide emulsion G.

Grains in thus prepared silver halide emulsion were pure silver iodide grains having had a mean equivalent spherical diameter of 0.040 μm, a variation coefficient of an equivalent spherical diameter distribution of 18%, and tetradecahedral shaped grains having faces of (001), {100}, and {101}. The ratio of γ phase was 30%, determined by powder X-ray diffraction analysis. Grain size and the like were determined from the average of 1000 grains using an electron microscope.

Grain forms of the prepared host grains are shown in Table 1.

Further, water was added thereto to give the content of silver halide of 15.6 g in terms of silver, per 1 liter of the emulsion for a coating solution.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, 120 L of t-butyl alcohol were admixed, and subjected to a reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone.

TABLE 1

| Emulsion No. | AgI Content (mol %) | Mean Equivalent Spherical Diameter (μm) | Mean Projected Area Equivalent Diameter (μm) | Mean Thickness (μm) | Mean Aspect Ratio | Note |
|---|---|---|---|---|---|---|
| 1A | 100 | 0.68 | 1.36 | 0.113 | 12.0 | Emulsion of the Invention |
| 1B | 90 | 0.67 | 1.52 | 0.087 | 17.6 | Emulsion of the Invention |
| 1C | 80 | 0.69 | 1.52 | 0.095 | 16.1 | Emulsion of the Invention |
| 1D | 100 | 0.42 | 0.82 | 0.074 | 11.1 | Emulsion of the Invention |
| 1E | 100 | 0.25 | 0.44 | 0.053 | 8.4 | Comparative Emulsion |
| 1F | 100 | 0.16 | 0.25 | 0.045 | 5.5 | Comparative Emulsion |
| G | 100 | 0.04 | — | — | 1.0 | Comparative Emulsion |

<<Preparations of Emulsion for Coating Solution>>

Each of the silver halide emulsion 2A to 2F, and G was dissolved respectively and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide. Thereafter, as "a compound having an adsorptive group and a reducing group", the compound Nos. 1 and 2 were added respectively in an amount of $8\times10^{-3}$ mol per 1 mol of silver halide.

The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparation of Reducing Agent Dispersion

<Preparation of Reducing Agent-1 Dispersion>

To 10 kg of reducing agent-1 (1,1-bis(2-hydroxy-3,5-dimethylphenyl)-3,5,5 -trimethylhexane) and 16 kg of a 10% by weight aqueous solution of modified polyvinyl alcohol (manufactured by Kuraray Co., Ltd., Poval MP203) is added 10 kg of water, and thoroughly mixed to give a slurry. This slurry is fed with a diaphragm pump, and is subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water are added thereto, thereby adjusting the concentration of the reducing agent to be 25% by weight. This dispersion is subjected to heat treatment at 60° C. for 5 hours to obtain reducing agent-1 dispersion. Particles of the reducing agent included in the resulting reducing agent dispersion have a median diameter of 0.40 μm, and a maximum particle diameter of 1.4 μm or less. The resultant reducing agent dispersion is subjected to filtration with a polypropylene filter having a pore size of 3.0 μm to remove foreign substances such as dust, and stored.

4) Preparation of Hydrogen Bonding Compound Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparations of Dispersions of Development Accelerator and Color-Tone-Adjusting Agent <Preparation of Development Accelerator-1 Dispersion>

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

<Preparations of Solid Dispersions of Development Accelerator-2 and Color-Tone-Adjusting Agent>

Also concerning solid dispersions of development accelerator-2 and color-tone-adjusting agent-1, dispersion was executed similar to the development accelerator-1, and thus dispersions of 20% by weight and 15% by weight were respectively obtained.

6) Preparations of Organic Polyhalogen Compound Dispersion

<Preparation of Organic Polyhalogen Compound-1 Dispersion>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<Preparation of Organic Polyhalogen Compound-2 Dispersion>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This fluid dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

7) Preparation of Silver Iodide Complex-forming Agent Solution 8 kg of modified poly(vinyl alcohol) MP203 was dissolved in 174.57 kg of water, and thereto were added 3.15 kg of a 20% by weight aqueous solution of sodium triisopropylnaphthalenesulfonate and 14.28 kg of a 70% by weight aqueous solution of 6-isopropylphthalazine. Accordingly, a 5% by weight solution of silver iodide complex-forming agent compound was prepared.

8) Preparations of Aqueous Solution of Mercapto Compound

<Preparation of Aqueous Solution of Mercapto Compound-1>

Mercapto compound-1 (1-(3-sulfophenyl)-5-mercaptotetrazole sodium salt) in an amount of 7 g was dissolved in 993 g of water to give a 0.7% by weight aqueous solution.

<Preparation of Aqueous Solution of Mercapto Compound-2>

Mercapto compound-2 (1-(3-methylureidophenyl)-5-mercaptotetrazole) in an amount of 20 g was dissolved in 980 g of water to give a 2.0% by weight aqueous solution.

9) Preparation of Polymer Latex Solution

<Preparation of SBR Latex (TP-1) Solution>

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature is elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and the pH of the mixture was adjusted to 8.4 using 1 mol/L lithium hydroxide. Thereafter, filtration with a polypropylene filter having the pore size of 1.0 μm was conducted to remove foreign substances such as dust followed by storage. Accordingly, SBR latex TP-1 was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by To a Electronics Ltd. for the latex stock solution (44% by weight) at 25° C.).

<Preparation of Isoprene Latex (TP-2) Dispersion>

Into the polymerization vessel of gas monomer reaction apparatus (type TAS-2J manufactured by Tiatsu Garasu Kogyo Ltd.), 1500 g of distilled water were poured, and heated for 3 hours at 90° C. to make passive film over the stainless vessel surface and stainless stirring device. Thereafter, 582.28 g of distilled water deaerated by nitrogen gas for one hour, 9.49 g of surfactant "PIONIN A-43-S" (trade name, available from Takemoto Oil & Fat Co., Ltd.), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercapatn were added into the pretreated reaction vessel. And then, the reaction vessel was sealed and the mixture was stirred at the stirring rate of 225 rpm, followed by elevating the inner temperature to 65° C. A solution obtained by dissolving 2.61 g of ammonium persulfate in 40 mL of water was added to the aforesaid mixture and kept for 6 hours with stirring. At the point the polymerization ratio was 90% according to the solid content measurement. Thereto a solution obtained by dissolving 5.22 g of acrylic acid in 46.98 g of water was added, and then 10 g of water and a solution obtained by dissolving 1.30 g of ammonium persulfate in 50.7 mL of water were added. After the addition, the mixture was heated to 90° C. and stirred for 3 hours. After the reaction was finished, the inner temperature of the vessel was cooled to room temperature. And then by the addition of 1 mol/L lithium hydroxide, the pH was adjusted to 8.4. Thereafter, the resulting mixture was filtered with a polypropylene filter having a pore size of 1.0 μm to remove foreign substances such as dust, and stored. 1248 g of isoprene latex (TP-2) was obtained. The measurement of halogen ion by an ion chromatography showed that the concentration of residual chloride ion was 3 p.p.m. The measurement by a high speed liquid chromatography showed that residual chelating agent concentration was 142 p.p.m.

The obtained latex has an average particle size of 113 nm, Tg=15° C., a solid content of 41.3% by weight, an equilibrium moisture content under the atmosphere of 25° C. and 60 RH % of 0.4% by weight, and an ionic conductivity of 5.23 mS/cm (the measurement of which was carried out at 25° C. using a conductometer CM-30S produced by DKK-TOA Corp.).

10) Preparation of Nucleator Dispersion 2.5 g of poly(vinyl alcohol) (manufactured by Kuraray Co., Ltd., PVA-217) and 87.5 g of water were added to 10 g of nucleator No. SH-7, and thoroughly admixed to give a slurry. This slurry was allowed to stand for 3 hours. Zirconia beads having a mean particle diameter of 0.5 mm were provided in an amount of 240 g, and charged in a vessel with the slurry. Dispersion was performed with a dispersing machine (1/4G sand grinder mill: manufactured by AIMEX Co., Ltd.) for 10 hours to obtain a solid fine particle dispersion of nucleator. Particles of the nucleator included in the resulting nucleator dispersion had a mean particle diameter of 0.5 μm, and 80% by weight of the particles had a particle diameter of from 0.1 μm to 1.0 μm.

2-2. Preparations of Coating Solution

1) Preparations of Coating Solution for Image Forming Layer

To the dispersion of silver salt of fatty acid in an amount of 1000 g and 276 mL of water were serially added the organic polyhalogen compound-1 dispersion, the organic polyhalogen compound-2 dispersion, the SBR latex (Tg: 17° C.) solution, the SBR latex (TP-1) solution, the isoprene latex (TP-2) solution, the reducing agent-1 dispersion, the nucleator dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent, the emulsion for coating solution was added thereto in an amount of 0.22 mol per 1 mol of silver salt of fatty acid, followed by thorough mixing just prior to the coating, which is fed directly to a coating die.

2) Preparation of Coating Solution for Intermediate Layer

To 1000 g of poly(vinyl alcohol) PVA-205 (manufactured by Kuraray Co., Ltd.) and 4200 mL of a 19% by weight solution of methyl methacrylate/styrene/butyl acrylate/hydroxyethyl methacrylate/acrylic acid copolymer (weight ratio of the copolymerization of 64/9/20/5/2) latex were added 27 mL of a 5% by weight aqueous solution of aerosol OT (manufactured by American Cyanamid Co.) and water to give total amount of 10000 g. The mixture was adjusted with sodium hydroxide to give the pH of 7.5. Accordingly, the coating solution for the intermediate layer was prepared, and was fed to a coating die to provide 9.1 mL/m$^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In water was dissolved 64 g of inert gelatin, and thereto were added 112 g of a 19.0% by weight solution of methyl methacrylate/styrene/butyl acrylate/hydroxyethyl methacrylate/acrylic acid copolymer (weight ratio of the copolymerization of 64/9/20/5/2) latex, 30 mL of a 15% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT, 0.5 g of phenoxyethyl alcohol, and 0.1 g of benzisothiazolinone. Water was added to give total amount of 750 g. Immediately before coating, 26 mL of a 4% by weight chrome alum which had been mixed with a static mixer was fed to a coating die so that the amount of the coating solution became 18.6 mL/m$^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In water was dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 5.4 mL of a 2% by weight solution of a fluorocarbon surfactant (F-1), 5.4 mL of a 2% by weight aqueous solution of another fluorocarbon surfactant (F-2), 23 mL of a 5% by weight aqueous solution of aerosol OT, 4 g of poly(methyl methacrylate) fine particles (mean particle diameter of 0.7 μm, distribution of volume weighted average being 30%), 21 g of poly(methyl methacrylate) fine particles (mean particle diameter of 3.6 μm, distribution of volume weighted average being 60%), 1.6 g of 4-methyl phthalic acid, 4.8 g of phthalic acid, 44 mL of 0.5 mol/L sulfuric acid, and 10 mg of benzisothiazolinone. Water was added to give total amount of 650 g. Immediately before coating, 445 mL of a aqueous solution containing 4% by weight chrome alum and 0.67% by weight phthalic acid were added and admixed with a static mixer to give a coating solution for the second layer of the surface protective layers, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

3. Preparations of Photothermographic Material

Simultaneous overlaying coating by a slide bead coating method was subjected, on both sides of the support, in order of the image forming layer, intermediate layer, first layer of the surface protective layers, and second layer of the surface protective layers, starting from the undercoated face. Thus sample Nos. 1 to 7 of photothermographic materials were produced. In this method, the temperature of the coating solution was adjusted to 31° C. for the image forming layer and intermediate layer, to 36° C. for the first layer of the surface protective layers, and to 37° C. for the second layer of the surface protective layers.

The amount of coated silver was 0.861 g/m$^2$ per one side, with respect to the sum of silver salt of fatty acid and silver halide. And, the total amount of coated silver in the image forming layers on both sides was 1.72 g/m$^2$.

The coating amount of each compound (g/m$^2$) for the image forming layer per one side is as follows.

| | |
|---|---|
| Silver salt of fatty acid (on the basis of Ag content) | 0.686 |
| Organic polyhalogen compound-1 | 0.028 |
| Organic polyhalogen compound-2 | 0.094 |
| Silver iodide complex-forming agent | (see Table 3) |

-continued

| | |
|---|---|
| SBR latex | 5.20 |
| SBR latex (TP-1) | 2.09 |
| Isoprene latex (TP-2) | 3.13 |
| Reducing agent-1 | 0.46 |
| Nucleator | 0.036 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.175 |

Further, coated sample Nos. 8 to 10 were prepared similar to the preparation of coated sample Nos. 1 to 3 except that the amount of silver iodide complex-forming agent was reduced to 0.092 g/m$^2$.

(Quantification of Ammonium Ion)

The quantification of ammonium ion was performed by the method described above. As a result, it was revealed that the content of ammonium ion was 0.1 mmol/m$^2$ per one side of the coated sample.

Conditions for coating and drying were as follows.

The support was decharged by ionic wind. Coating was performed at the speed of 160 m/min. Conditions for coating and drying were adjusted within the range described below, and conditions were set to obtain the most stable surface state. The clearance between the leading end of the coating die and the support was 0.10 mm to 0.30 mm. The pressure in the vacuum chamber was set to be lower than atmospheric pressure by 196 Pa to 882 Pa. In the subsequent cooling zone, the coating solution was cooled by wind having the dry-bulb temperature of 10° C. to 20° C. Transportation with no contact was carried out, and the coated support was dried with an air of the dry-bulb of 23° C. to 45° C. and the wet-bulb of 15° C. to 21° C. in a helical type contactless drying apparatus. After drying, moisture conditioning was performed at 25° C. in the humidity of 40% RH to 60% RH. Then, the film surface was heated to be 70° C. to 90° C., and after heating, the film surface was cooled to 25° C.

Thus prepared photothermographic material had a level of matting of 250 seconds as Beck's smoothness. In addition, measurement of the pH of the film surface gave the result of 6.0.

Chemical structures of the compounds used in Examples of the invention are shown below.

Tellurium Sensitizer C

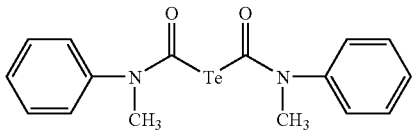

Compound 1 that can be one-electron-oxidized to provide a one-electron oxidation product which releases one or more electrons

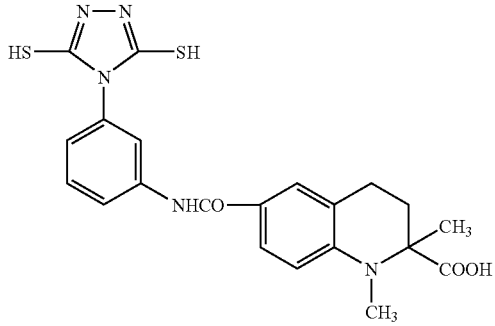

Compound 2 that can be one-electron-oxidized to provide a one-electron oxidation product which releases one or more electrons

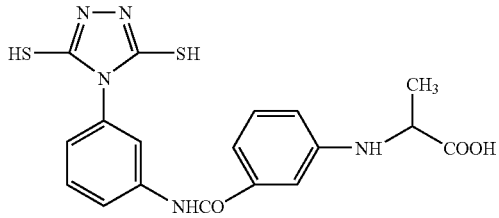

Compound 3 that can be one-electron-oxidized to provide a one-electron oxidation product which releases one or more electrons

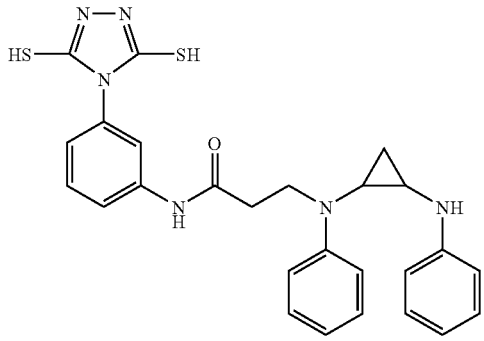

Compound 1 having adsorptive group and reducing group

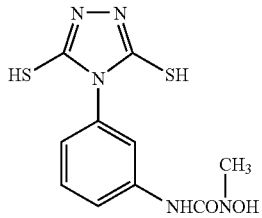

Compound 2 having adsorptive group and reducing group

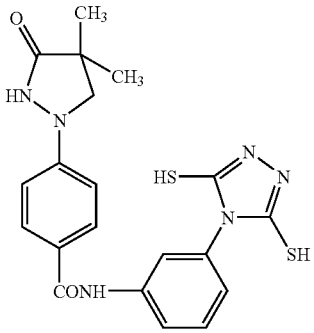

Reducing agent-1

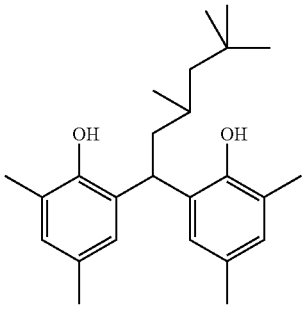

Hydrogen bonding compound-1

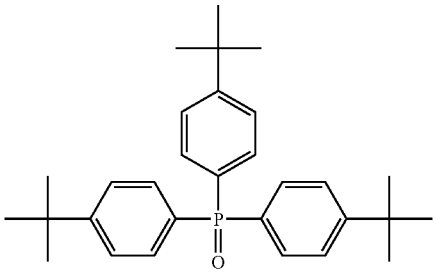

Organic polyhalogen compound-1

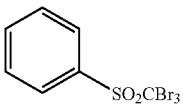

Organic polyhalogen compound-2

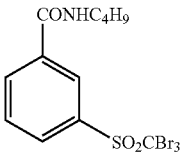

Mercapto compound-1

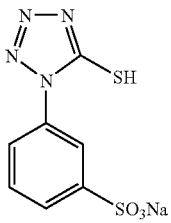

-continued

Mercapto compound-2

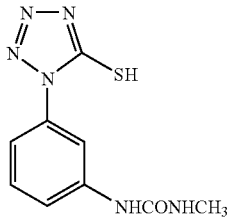

Silver iodide complex-forming agent

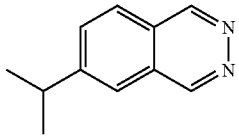

Development accelerator-1

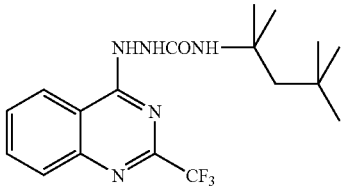

Development accelerator-2

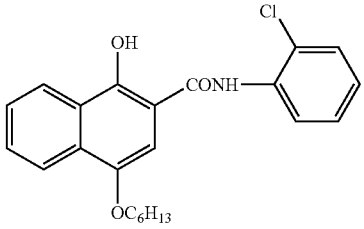

Color-tone-adjusting agent-1

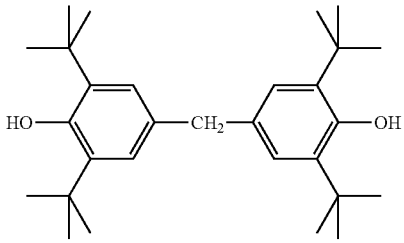

(F-1)

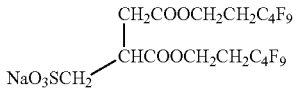

(F-2)

Mixture of

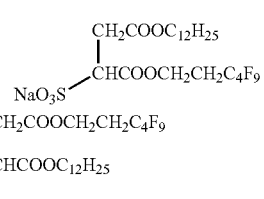

and

4. Evaluation of Photographic Properties 4-1. Preparation

The resulting sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}\ day^{-1}$.

4-2. Exposure

Two sheets of the fluorescent intensifying screen A described below were used. The assembly for image formation was provided by inserting the sample between them. This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter comprising 7 cm thickness of water having the absorption ability almost the same as human body was used as the light source. Whlie changing the exposure value of X-ray by a distance method, the sample was subjected to exposure with a step wedge tablet having a width of 0.15 in terms of log E.

<Preparation of Fluorescent Intensifying Screen A>

(1) Undercoating

A light reflecting layer comprising alumina powder was coated on a polyethylene terephthalate film (support) having a thickness of 250 μm in a similar manner to the Example 4 in JP-A. No. 2001-124898. The light reflecting layer which had a film thickness of 50 μm after drying, was prepared.

(2) Preparation of Fluorescent Substance Sheet 250 g of BaFBr:Eu fluorescent substance (mean particle size of 3.5 μm), 8 g of polyurethane type binder resin (manufactured by Dai Nippon Ink & Chemicals, Inc., trade name: PANDEX T5265M), 2 g of epoxy type binder resin (manufactured by Yuka Shell Epoxy Co., Ltd., trade name: EPIKOTE 101) and 0.5 g of isocyanate compounds (manufactured by Nippon Polyurethane Industry Co., Ltd., trade name: CORONATE HX) were added into methylethylketone, and the mixture was then dispersed by a propeller mixer to prepare the coating solution for the fluorescent substance layer having a viscosity of 25 PS (25° C.). This coating solution was coated on the surface of a temporary support (pretreated by coating a silicone agent on the surface of polyethylene terephthalate film), and dried to make the fluorescent substance layer. Thereafter, the fluorescent substance sheet was prepared by peeling the fluorescent substance layer from the temporary support.

(3) Overlaying the Fluorescent Substance Sheet on Light Reflective Layer.

The fluorescent substance sheet prepared above was overlaid on the surface of the light reflective layer of the support having a light reflective layer made in the above process (1), and then pressed by a calendar roller at the pressure of 400 $kgw/cm^2$ and the temperature of 80° C. to form the fluorescent substance layer on the light reflective layer. The thickness of the obtained fluorescent substance layer was 125 μm and the volume filling factor of fluorescent substance particles in the fluorescent substance layer was 68%.

(4) Preparation of Surface Protective Layer

Polyester type adhesive agents were coated on one side of a polyethylene terephthalate (PET) film having a thickness of 6 μm, and thereafter the surface protective layer was formed on the fluorescent substance layer by a laminating method. As described above, the fluorescent intensifying screen A comprising a support, a light reflective layer, a fluorescent substance layer and a surface protective layer was prepared.

(5) Emission Characteristics

Figure 8:
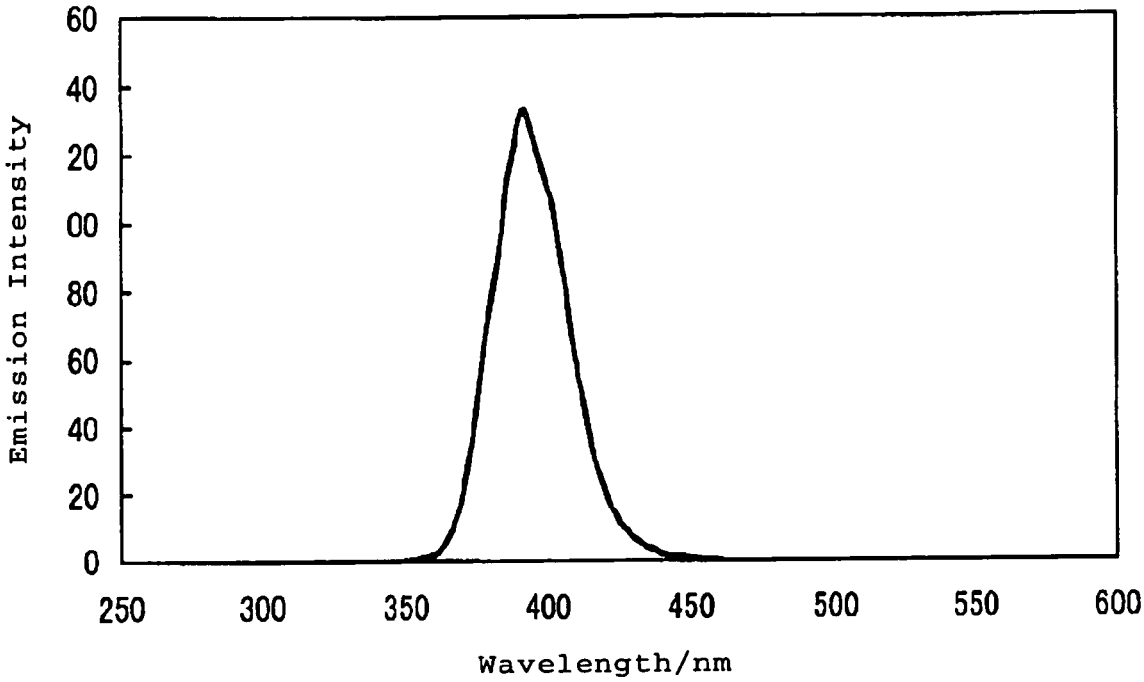
FIG. 8 shows an emission spectrum of a fluorescent intensifying screen A.

The emission spectrum of the intensifying screen A was measured by X-ray at 40 kVp and is shown in FIG. 8. The fluorescent intensifying screen A showed an emission having a peak at 390 nm and a narrow half band width.

4-3. Thermal Development

After exposure, the samples were thermally developed using the thermal developing apparatus shown in FIG. 1, under the following thermal developing process conditions.

TABLE 2

| | Temperature (° C.) | Time Period (sec) |
|---|---|---|
| Preheating | 100 | 12 |
| First Heating Means | 119 | 10 |
| Second Heating Means | 121 | 12 |

4-4. Condition for Evaluation

1) Measurement of Haze of Film

The term "haze" indicates the degree of diffusion of the light incident to a photosensitive material, and the ratio of the amount of diffused transmitted light to total amount of transmitted light is expressed in percentage. The haze measuring apparatus Model 1001DP produced by NIPPON DENSHOKU Co., Ltd. was used for the measurement of haze.

The haze of the film was measured before and after thermal development of each unexposed sample, and the ratio of haze after thermal development relative to haze before thermal development is calculated.

2) Measurement of Sensitivity

Sensitivity at 390 nm that is the main emission peak of the aforesaid fluorescent intensifying screen A was measured as follows.

Each sample was subjected to exposure for 1/10 seconds by a 2856K° color temperature tungsten light source filtered through a interference filter produced by Corning Inc., which has a half width of 10 nm and a central transparency wavelength at 390 nm, an infrared light cut filter, and a neutral step wedge. After exposure, the photothermographic material was subjected to thermal development in a similar manner to the manner described above. After peeling off the image forming layer which ws disposed on the opposite side to the exposed side, densities were measured to draw a photographic characteristic curve. From the photographic characteristic curve, the exposure value required to give a density of fog+0.5 was determined. On determination of the exposure value, the light emitted by the tungsten light source and passed through the filter was measured using the radiophotometer DR-2550 (a corrected one) produced by EG&G Inc.

3) Other Photographic Properties

Fog: The density of the unexposed portion is expressed as fog.

Average gradient: Average gradient is gradient of a straight line connecting the points at fog+(optical density of 0.25) and fog+(optical density of 2.0) on the photographic characteristic curve (i.e., the value equals tan when the angle between the line and the horizontal axis is).

Distinguishability of Images: The sample was subjected to X-ray exposure using a chest phantom image while adjusting the exposure value to give a proper density (D=1.8) for lung field portion. The imaging characteristics of mediastinum portion of the chest phantom image and the distinguishability of artificial blood vessels were evaluated by visual observation and classified into the following criteria as ◎, ○, Δ, and X. Concerning the color tone of a developed silver image, the overall image was evaluated by visual observation and classified into the following criteria as ○, Δ, and X.

4) Image Storability

Evaluation of Image Stroability (Print-Out):

The image sample obtained by thermally developing each sample was left for 5 days under an illumination condition of fluorescent lamp of 6000 Lux at 40° C. and 50% relative humidity. Thereafter, an optical density of an unexposed portion was measured. The obtained density was denoted as $fog_2$ and a density of the unexposed portion before leaving under a fluorescent lamp was denoted as $fog_1$, and then the difference (Δfog) between $fog_2$ and fog, was calculated as follows;

$$\Delta fog = fog_2 - fog_1$$

tinguishability of images, and excellent quality in fog, gradation, and color tone suitable for medical diagnosis.

Example 2

SBR latex (TP-1) and Isoprene latex (TP-2) were prepared in a similar manner to the process in the preparation of photothermographic material sample Nos. 1 and 5 of Example 1, except that after the completion of reaction, and after the inner temperature was lowered to the room temperature, the pH of the solution was adjusted to 8.4 with 1 mol/L LiOH and 1 mol/L $NH_4OH$ solution. At that time, the ratio of the addition amounts of $NH_4OH$ and LiOH was adjusted so as to make the coating amount of ammonium ion to be the amount shown in Table 4 and Table 5.

Moreover, the addition amounts of nucleator dispersion was adjusted so as to make the photographic properties to be nearly the same as those of sample Nos. 1 and 5, respectively.

The photothermographic material Nos. 11 to 18 were prepared similar to Example 1 except the mentioned above. The obtained samples were evaluated similar to Example 1 and in addition, the following evaluation was performed.

(Evaluation of Storage Stability Stored in High Humidity Condition)

In order to evaluate storage stability of the materials of the present invention, samples were subjected to the following accelerated test (aging test);

The samples were stored for a period of 7 days in a condition of 35° C. and 80 RH %, followed by keeping the samples in a condition of 25° C. and 60 RH %. Thereafter, the sample was subjected to exposure and thermal development, and photographic properties were evaluated. The logarithm of the relative value of sensitivity is expressed as Δlog E according to the following formula.

$$\Delta \log E(1) = -\log(\text{sensitivity after the aging test/sensitivity before the aging test})$$

TABLE 3

| Sample No. | Emulsion No. | Silver Iodide Complex-forming Agent ($g/m^2$) | Haze: Before Thermal Development (A) | Haze: After Thermal Development (B) | Haze: B/A (%) | Fog | Sensitivity (watt · sec · $m^{-2}$) | Gradation | Image Storability | Color: Tone of Developed Silver Images | Color: Distinguishability of Phantom Images | Note |
|---|---|---|---|---|---|---|---|---|---|---|---|---|
| 1 | 2A | 0.46 | 55 | 25 | 45.5 | 0.20 | $1.2 \times 10^{-4}$ | 2.9 | 0.01 | ○ | ◎ | Invention |
| 2 | 2B | 0.46 | 49 | 27 | 55.1 | 0.21 | $1.3 \times 10^{-4}$ | 2.8 | 0.02 | ○ | ◎ | Invention |
| 3 | 2C | 0.46 | 51 | 32 | 62.7 | 0.21 | $1.4 \times 10^{-4}$ | 2.9 | 0.03 | ○ | ◎ | Invention |
| 4 | 2D | 0.46 | 48 | 24 | 50.0 | 0.18 | $3.2 \times 10^{-4}$ | 3.2 | 0.01 | ○ | ◎ | Invention |
| 5 | 2E | 0.46 | 39 | 23 | 59.0 | 0.18 | $1.5 \times 10^{-4}$ | 4.3 | 0.01 | ○ | Δ | Comparative |
| 6 | 2F | 0.46 | 31 | 22 | 74.2 | 0.17 | $5.7 \times 10^{-4}$ | 4.4 | 0.01 | ○ | Δ | Comparative |
| 7 | G | 0.46 | 27 | 22 | 81.4 | 0.17 | 31.8 | 4.6 | 0.01 | Δ | Δ | Comparative |
| 8 | 2A | 0.09 | 55 | 45 | 82.2 | 0.27 | $2.4 \times 10^{-4}$ | 4.6 | 0.56 | X | X | Comparative |
| 9 | 2B | 0.09 | 49 | 41 | 83.7 | 0.28 | $2.6 \times 10^{-4}$ | 4.5 | 0.72 | X | X | Comparative |
| 10 | 2C | 0.09 | 51 | 44 | 86.3 | 0.28 | $2.8 \times 10^{-4}$ | 4.4 | 0.85 | X | X | Comparative |

4-5. Results of Evaluation

The obtained results are shown in Table 3. From the results shown in Table 3, it is revealed that the photothermographic materials of the present invention give a high image quality image having high sensitivity, excellent dis- The obtained results are shown in Table 4 and Table 5. The photothermographic materials of the present invention give an image of high image quality with high sensitivity, excellent distinguishability of images, and excellent quality in fog and gradation suitable for medical diagnosis. Moreover, the photothermographic materials of the invention also exhibit excellent storage stability, so that the increase in fog and sensitivity, and the gradation change during storage in a high humidity condition are slight.

Δ log $E(2)$=−log (sensitivity of sample stored in a high humidity environment/sensitivity of sample stored in a standard temperature and humidity environment)

TABLE 4

| | | | Photographic Properties (Fresh) | | | | | | Photographic Properties (After Stored in a High Humidity Condition) | | | | | | |
|---|---|---|---|---|---|---|---|---|---|---|---|---|---|---|---|
| | | | Haze | | | | | | Haze | | | | | | |
| Sample No. | Emulsion No. | Coating Amount of $NH_4^+$ (mmol/$m^2$) | Before Thermal Development (A) | After Thermal Development (B) | B/A (%) | Fog | Sensitivity (watt · sec · $m^{-2}$) | Gradation | Before Thermal Development (A) | After Thermal Development (B) | B/A (%) | Fog | Sensitivity (watt · sec · $m^{-2}$) | Gradation | Note |
| 1 | 2A | 0.1 | 55 | 25 | 45.5 | 0.20 | $1.2 \times 10^{-4}$ | 2.9 | 55 | 25 | 45.5 | 0.20 | $1.20 \times 10^{-4}$ | 2.9 | Invention |
| 11 | 2A | 0.3 | 55 | 26 | 47.3 | 0.21 | $1.2 \times 10^{-4}$ | 2.9 | 55 | 26 | 47.3 | 0.22 | $1.09 \times 10^{-4}$ | 3.0 | Invention |
| 12 | 2A | 0.8 | 55 | 26 | 47.3 | 0.21 | $1.2 \times 10^{-4}$ | 2.9 | 55 | 27 | 49.1 | 0.23 | $1.05 \times 10^{-4}$ | 3.1 | Invention |
| 13 | 2A | 1.5 | 55 | 27 | 49.1 | 0.22 | $1.2 \times 10^{-4}$ | 3.0 | 55 | 29 | 52.7 | 0.27 | $0.91 \times 10^{-4}$ | 3.4 | Invention |
| 14 | 2A | 3.0 | 55 | 27 | 49.1 | 0.22 | $1.2 \times 10^{-4}$ | 3.1 | 55 | 30 | 54.5 | 0.30 | $0.85 \times 10^{-4}$ | 3.6 | Invention |
| 5 | 2E | 0.1 | 39 | 23 | 59.0 | 0.18 | $1.5 \times 10^{-4}$ | 4.3 | 39 | 27 | 69.2 | 0.22 | $1.25 \times 10^{-3}$ | 4.6 | Comparative |
| 15 | 2E | 0.3 | 39 | 24 | 61.5 | 0.19 | $1.5 \times 10^{-4}$ | 4.3 | 39 | 28 | 71.8 | 0.23 | $1.16 \times 10^{-3}$ | 4.7 | Comparative |
| 16 | 2E | 0.8 | 39 | 24 | 61.5 | 0.19 | $1.5 \times 10^{-4}$ | 4.3 | 39 | 30 | 76.9 | 0.25 | $1.06 \times 10^{-3}$ | 4.9 | Comparative |
| 17 | 2E | 1.5 | 39 | 25 | 64.1 | 0.20 | $1.5 \times 10^{-4}$ | 4.4 | 39 | 33 | 84.6 | 0.35 | $0.72 \times 10^{-3}$ | 5.2 | Comparative |
| 18 | 2E | 3.0 | 39 | 25 | 64.1 | 0.20 | $1.5 \times 10^{-4}$ | 4.5 | 39 | 35 | 89.7 | 0.55 | $0.63 \times 10^{-3}$ | 5.5 | Comparative |

Example 3

The photothermographic material Nos. 1 and 5 of Example 2 were evaluated similar to Example 1 except that the preheating conditions of thermal developing apparatus was changed to the conditions described shown in Table 6, and the environmental condition was adjusted to 25° C. and 60 RH % (standard temperature and humidity). In addition to the above, the following evaluation was performed.

Development Unevenness

Ten sheets (a size of half cut size) of each sample were subjected to X-ray exposure in the above described condition to give an image density of 1.2. The obtained image was sensory evaluated by the visual observation. Results of the evaluation are shown according to the following rankings, ⊚: no development unevenness in the image portion is perceived, ○: slightly development unevenness in the image portion is perceived, but negligible level for inspecting the image, Δ: some development unevenness in the image portion is perceived, and impractical level for inspecting the image, X: apparent development unevenness in the image portion is perceived, and difficult level for the inspection.

Photographic Properties in a High Humidity Environment

Each sample was conditioned for 3 hours in a condition of 25° C. and 80 RH %, and then subjected to thermal development with a thermal developing apparatus which is set in an environmental condition of 25° C. and 60 RH %. Evaluations except the above were performed similar to Example 1. The logarithm of the relative value of sensitivity is expressed as Δlog E according to the following formula.

TABLE 5

| Sample No. | Emulsion No. | Differences ΔFog | ΔlogE | ΔGradation | Note |
|---|---|---|---|---|---|
| 1 | 2A | ±0 | ±0 | ±0 | Invention |
| 11 | 2A | +0.01 | +0.04 | +0.1 | Invention |
| 12 | 2A | +0.02 | +0.06 | +0.2 | Invention |
| 13 | 2A | +0.05 | +0.12 | +0.4 | Invention |
| 14 | 2A | +0.08 | +0.15 | +0.5 | Invention |
| 5 | 2E | +0.02 | +0.08 | +0.3 | Comparative |
| 15 | 2E | +0.04 | +0.11 | +0.4 | Comparative |
| 16 | 2E | +0.06 | +0.15 | +0.6 | Comparative |
| 17 | 2E | +0.15 | +0.32 | +0.8 | Comparative |
| 18 | 2E | +0.35 | +0.38 | +1.0 | Comparative |

<Result of Evaluation>

The obtained results are shown in Table 6. Especially, it is seen from Table 6 that the preheating of the photothermographic materials of the present invention at about 100° C. can produce an image of high image quality with high sensitivity, excellent distinguishability of images, and excellent gradation suitable for medical diagnosis. Furthermore, the photothermographic materials of the present invention exhibit slightly development unevenness, and less variation in photographic properties and development unevenness processed in a high humidity environment. The preheating temperature at 30° C. is ineffective, and the temperature at 120° C. is not preferred because fog is increased.

TABLE 6

| Sample No. | Preheating Conditions ° C. | Preheating Conditions Time (second) | Processing under an Environment of 25° C. and 60% RH: Fog | Sensitivity (watt · sec · m$^2$) | Gradation | Development Unevenness | Processing under an Environment of 25° C. and 80% RH: Fog | Sensitivity (watt · sec · m$^2$) | Gradation | Development Unevenness | Differences Δ: ΔFog | ΔlogE | Gradation | Note |
|---|---|---|---|---|---|---|---|---|---|---|---|---|---|---|
| 1 | 100 | 12 | 0.20 | $1.2 \times 10^{-4}$ | 2.9 | ◎ | 0.21 | $1.17 \times 10^{-4}$ | 3.0 | ◎ | +0.01 | +0.02 | +0.1 | Invention |
| 1 | 90 | 12 | 0.21 | $1.2 \times 10^{-4}$ | 3.0 | ◎ | 0.22 | $1.17 \times 10^{-4}$ | 3.1 | ◎ | +0.01 | +0.03 | +0.1 | Invention |
| 1 | 103 | 12 | 0.20 | $1.2 \times 10^{-4}$ | 2.9 | ◎ | 0.21 | $1.17 \times 10^{-4}$ | 3.0 | ◎ | +0.01 | +0.02 | +0.1 | Invention |
| 1 | — | — | 0.22 | $0.98 \times 10^{-4}$ | 3.3 | ○ | 0.30 | $0.82 \times 10^{-4}$ | 3.6 | Δ | +0.08 | +0.15 | +0.3 | Invention |
| 1 | 30 | 12 | 0.22 | $0.98 \times 10^{-4}$ | 3.3 | ○ | 0.29 | $0.83 \times 10^{-4}$ | 3.5 | Δ | +0.07 | +0.15 | +0.2 | Invention |
| 1 | 120 | 12 | 0.25 | $0.98 \times 10^{-4}$ | 3.2 | ○ | 0.33 | $0.73 \times 10^{-4}$ | 3.4 | ○ | +0.08 | +0.13 | +0.2 | Invention |
| 5 | 100 | 12 | 0.18 | $1.5 \times 10^{-3}$ | 4.3 | ◎ | 0.21 | $1.40 \times 10^{-3}$ | 4.5 | ○ | +0.03 | +0.03 | +0.2 | Comparative |
| 5 | 90 | 12 | 0.19 | $1.5 \times 10^{-3}$ | 4.4 | ◎ | 0.23 | $1.37 \times 10^{-3}$ | 4.7 | Δ | +0.04 | +0.05 | +0.3 | Comparative |
| 5 | 103 | 12 | 0.18 | $1.5 \times 10^{-3}$ | 4.3 | ◎ | 0.21 | $1.40 \times 10^{-3}$ | 4.5 | ○ | +0.03 | +0.03 | +0.2 | Comparative |
| 5 | — | — | 0.25 | $1.2 \times 10^{-3}$ | 4.7 | ○ | 0.43 | $0.79 \times 10^{-3}$ | 5.3 | X | +0.18 | +0.25 | +0.6 | Comparative |
| 5 | 30 | 12 | 0.24 | $1.2 \times 10^{-3}$ | 4.8 | ○ | 0.40 | $0.83 \times 10^{-3}$ | 5.3 | X | +0.16 | +0.25 | +0.5 | Comparative |
| 5 | 120 | 12 | 0.25 | $0.95 \times 10^{-3}$ | 4.6 | ○ | 0.43 | $0.63 \times 10^{-3}$ | 5.1 | Δ | +0.18 | +0.23 | +0.5 | Comparative |

What is claimed is:

1. A photothermographic material used for a method of forming an image, which comprises performing X-ray imagewise exposure with a fluorescent intensifying screen and thermal development, wherein the photothermographic material comprising: on at least one side of a support, an image forming layer comprising at least a photosensitive silver halide, a non-photosensitive organic silver salt, a reducing agent, and a binder, wherein (1) the photosensitive silver halide comprises tabular grains having a mean aspect ratio of 2 to 100 and a mean equivalent spherical diameter of 0.3 μm to 10 μm, (2) an exposure value necessary for obtaining an image density of fog+0.5 after exposing the photothermographic material with monochromatic light having the same wavelength as the main emission peak wavelength of the fluorescent intensifying screen and having a half width of 15 nm±5 nm and thermally developing the photothermographic material is from $1\times10^{-6}$ watt·sec·m$^{-2}$ to $1\times10^{-3}$ watt·sec·m$^{-2}$, and (3) haze of the photothermographic material after thermal devolpment is less than 80% of that before thermal development.

2. The photothermographic material according to claim 1, wherein the fluorescent intensifying screen includes a fluorescent substance, and 50% or more of emission light of the fluorescent substance has a wavelength of 350 nm to 420 nm.

3. The photothermographic material according to claim 2, wherein the fluorescent substance contains a divalent Eu-activated fluorescent substance.

4. The photothermographic material according to claim 3, wherein the fluorescent substance contains a divalent Eu-activated barium halide fluorescent substance.

5. The photothermographic material according to claim 1, wherein the haze after thermal development is less than 75% of that before thermal development.

6. The photothermographic material according to claim 1, wherein an amount of coated silver of the photosensitive silver halide is from 0.04 g/m$^2$ to 0.4 g/m$^2$ per one side of the support.

7. The photothermographic material according to claim 1, further comprising a nucleator, wherein an average gradient of a photographic characteristic curve is 1.8 to 5.0.

8. The photothermographic material according to claim 7, wherein the nucleator is a compound selected from the group consisting of a hydrazine derivative compound, a vinyl compound, a quaternary onium compound, and an olefin compound.

9. The photothermographic material according to claim 1, wherein an $NH_4^+$ content of the photothermographic material is 1 mmol/m$^2$ or less per one side of the support.

10. The photothermographic material according to claim 9, wherein the $NH_4^+$ content of the photothermographic material is 0.3 mmol/m$^2$ or less per one side of the support.

11. The photothermographic material according to claim 1, wherein an average silver iodide content of the photosensitive silver halide is 40 mol % or higher.

12. The photothermographic material according to claim 11, wherein the average silver iodide content of the photosensitive silver halide is 80 mol % or higher.

13. The photothermographic material according to claim 12, wherein the average silver iodide content of the photosensitive silver halide is 90 mol % or higher.

* * * * *